United States Patent [19]

Seitz

[11] Patent Number: 4,501,426

[45] Date of Patent: Feb. 26, 1985

[54] BOWLING GAME

[76] Inventor: John R. Seitz, P.O. Box 1447, Lancaster, Pa. 17604

[21] Appl. No.: 385,977

[22] Filed: Jun. 7, 1982

Related U.S. Application Data

[63] Continuation of Ser. No. 163,016, Jun. 25, 1980, abandoned.

[51] Int. Cl.[3] ..... A63F 3/00

[52] U.S. Cl. ..... 273/277

[58] Field of Search ..... 273/277, 244, 85 R, 273/94, 259

[56] References Cited

U.S. PATENT DOCUMENTS

| | | | |
|---|---|---|---|
| 1,538,307 | 5/1925 | Strehlow | 273/85 R |
| 1,540,288 | 2/1925 | Schallis | 273/277 |
| 2,148,102 | 2/1939 | Brumer | 273/85 R |
| 3,043,594 | 7/1962 | Seitz | 273/94 |
| 3,055,662 | 9/1962 | Kemp | 273/85 R |
| 3,260,526 | 7/1966 | Seitz | 273/245 |
| 3,545,763 | 12/1970 | Seitz | 273/244 |
| 3,690,666 | 9/1972 | Seitz | 273/246 |
| 4,364,569 | 12/1982 | Duwell et al. | 273/245 |

*Primary Examiner*—Richard C. Pinkham
*Assistant Examiner*—Scott L. Brown

[57] ABSTRACT

A bowling game which utilizes a plurality of bowler cards, each carrying ability indicia representing a particular bowler's ability in a statistically accurate manner. Dice are rolled to represent the rolling of a bowling ball, and the reading of the dice indicates specific indicia on the bowler's card. The indicated indicia refers the game player to corresponding strike and spare boards which carry result indicia representing in a statistically accurate manner the score that the particular bowler would probably obtain, based on his average performance.

14 Claims, 34 Drawing Figures

Bowls: Right Year: 1978
Height: 5-5 Weight: 145
Born: 8-4-57 Rehoboth, Mass.

ANTHONY 40

| | x s | | x s | | x s |
|---|---|---|---|---|---|
| 11- | 1-1 | 31- | 1-5 | 51- | 1-5 |
| 12- | 9-9 | 32- | 10-10 | 52- | 11-11 |
| 13- | 2-2 | 33- | 1-1 | 53- | 2-2 |
| 14- | 6-6 | 34- | 7-7 | 54- | 8-8 |
| 15- | 1-4 | 35- | 1-4 | 55- | 1-4 |
| 16- | S-10 | 36- | 5-5 | 56- | O1-9 |
| 21- | 3-3 | 41- | 3-3 | 61- | 4-4 |
| 22- | 1-2 | 42- | 1-7 | 62- | 1-7 |
| 23- | 13-13 | 43- | 14-14 | 63- | 12-12 |
| 24- | T-8 | 44- | 1-2 | 64- | 1-8 |
| 25- | 1-3 | 45- | 5-5 | 65- | T-9 |
| 26- | Q-6 | 46- | Q-6 | 66- | 1-1 |

Bowls: Right Year: 1978
Height: 5-5 Weight: 145
Born: 8-4-57 Rehoboth, Mass.
ANTHONY
40
| | x | s | | x | s | | x | s |
|---|---|---|---|---|---|---|---|---|
| 11- | 1 | 1 | 31- | 1 | 5 | 51- | 1 | 5 |
| 12- | 9 | 9 | 32- | 10 | 10 | 52- | 11 | 11 |
| 13- | 2 | 2 | 33- | 1 | 1 | 53- | 2 | 2 |
| 14- | 6 | 6 | 34- | 7 | 7 | 54- | 8 | 8 |
| 15- | 1 | 4 | 35- | 1 | 4 | 55- | 1 | 4 |
| 16- | S | 10 | 36- | 5 | 5 | 56- | O1 | 9 |
| 21- | 3 | 3 | 41- | 3 | 3 | 61- | 4 | 4 |
| 22- | 1 | 2 | 42- | 1 | 7 | 62- | 1 | 7 |
| 23- | 13 | 13 | 43- | 14 | 14 | 63- | 12 | 12 |
| 24- | T | 8 | 44- | 1 | 2 | 64- | 1 | 8 |
| 25- | 1 | 3 | 45- | 5 | 5 | 65- | T | 9 |
| 26- | Q | 6 | 46- | Q | 6 | 66- | 1 | 1 |
FIG. 4.
Bowls: Left Year: 1978
Height: 5-4 Weight: 150
Born: 9-10-47 Medford, Mass.
41
BILL
| | x | s | | x | s | | x | s |
|---|---|---|---|---|---|---|---|---|
| 11- | 1 | 1 | 31- | 1 | 6 | 51- | 1 | 6 |
| 12- | S | 9 | 32- | S | 9 | 52- | O2 | 15 |
| 13- | 4 | 4 | 33- | 1 | 1 | 53- | 3 | 3 |
| 14- | T | 8 | 34- | T | 8 | 54- | T | 8 |
| 15- | 1 | 6 | 35- | 1 | 7 | 55- | 1 | 4 |
| 16- | 5 | 5 | 36- | 6 | 6 | 56- | 7 | 7 |
| 21- | 8 | 8 | 41- | 9 | 9 | 61- | 2 | 2 |
| 22- | 1 | 2 | 42- | 1 | 7 | 62- | 1 | 7 |
| 23- | 10 | 10 | 43- | 11 | 11 | 63- | 12 | 12 |
| 24- | T | 11 | 44- | 1 | 3 | 64- | 2 | 2 |
| 25- | 1 | 5 | 45- | 13 | 13 | 65- | 14 | 14 |
| 26- | Q | 10 | 46- | Q | 10 | 66- | 1 | 1 |
FIG. 5.
Bowls: Left Year: 1978
Height: 6-1 Weight: 200
Born: 4-27-38 Tacoma, Wash.
42
CARL
| | x | s | | x | s | | x | s |
|---|---|---|---|---|---|---|---|---|
| 11- | 1 | 1 | 31- | 1 | 4 | 51- | 1 | 4 |
| 12- | T | 7 | 32- | T | 7 | 52- | Q | 8 |
| 13- | 1 | 6 | 33- | 1 | 1 | 53- | 1 | 6 |
| 14- | 5 | 5 | 34- | 6 | 6 | 54- | 7 | 7 |
| 15- | 1 | 3 | 35- | 1 | 4 | 55- | 1 | 4 |
| 16- | Q | 9 | 36- | 2 | 2 | 56- | 3 | 3 |
| 21- | 8 | 8 | 41- | 9 | 9 | 61- | 2 | 2 |
| 22- | 1 | 2 | 42- | 1 | 5 | 62- | 1 | 5 |
| 23- | 10 | 10 | 43- | 11 | 11 | 63- | 12 | 12 |
| 24- | 13 | 13 | 44- | 1 | 2 | 64- | 1 | 5 |
| 25- | 1 | 3 | 45- | 1 | 6 | 65- | 14 | 14 |
| 26- | O1 | 8 | 46- | S | 10 | 66- | 1 | 1 |
FIG. 6.
Bowls: Right Year: 1978
Height: 5-11 Weight: 165
Born: 12-24-43 Muscatine, Iowa
43
DAN
| | x | s | | x | s | | x | s |
|---|---|---|---|---|---|---|---|---|
| 11- | 1 | 1 | 31- | 1 | 6 | 51- | 1 | 5 |
| 12- | T | 9 | 32- | T | 9 | 52- | T | 9 |
| 13- | 3 | 3 | 33- | 1 | 1 | 53- | 2 | 4 |
| 14- | 5 | 5 | 34- | 6 | 6 | 54- | 7 | 7 |
| 15- | 1 | 4 | 35- | 1 | 7 | 55- | 1 | 3 |
| 16- | Q | 10 | 36- | Q | 10 | 56- | Q | 8 |
| 21- | 8 | 8 | 41- | 9 | 9 | 61- | 2 | 2 |
| 22- | 1 | 2 | 42- | 1 | 6 | 62- | 1 | 6 |
| 23- | 10 | 10 | 43- | 11 | 11 | 63- | 12 | 12 |
| 24- | 13 | 13 | 44- | 1 | 2 | 64- | 1 | 7 |
| 25- | 1 | 4 | 45- | 14 | 14 | 65- | T | 15 |
| 26- | O2 | 8 | 46- | S | 7 | 66- | 1 | 1 |
FIG. 7.
FIG. 1.
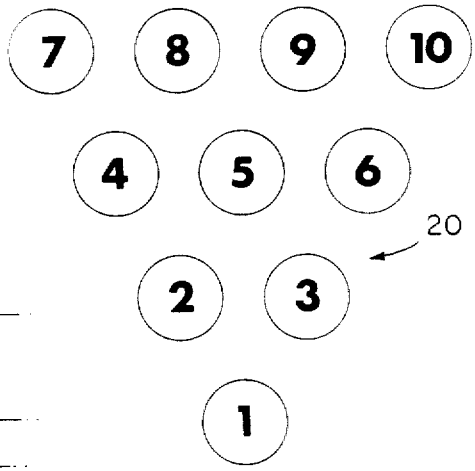
PIN DECK
FIG. 3.
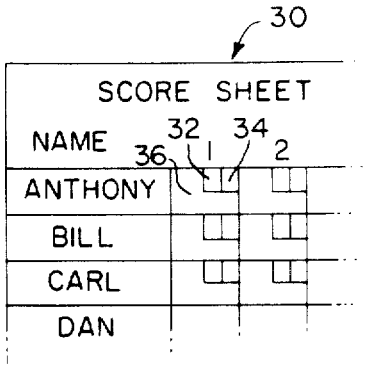
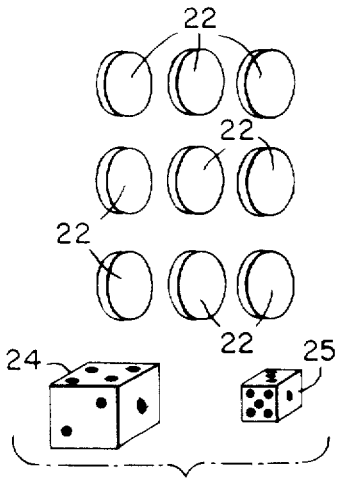
FIG. 2.

STRIKE BOARD

FIG. 8.

USE THIS STRIKE BOARD FOR THE FIRST ROLL OF EACH FRAME.
If a strike is made on the first roll of the Tenth Frame, the Strike Board is used again for the second roll of the frame. If the second roll also is a strike, use the Tenth Frame column a third time for the final roll.

| | | FIRST FRAME | SECOND FRAME | THIRD FRAME | FOURTH FRAME | FIFTH FRAME | SIXTH FRAME | SEVENTH FRAME | EIGHTH FRAME | NINTH FRAME | TENTH FRAME | |
|---|---|---|---|---|---|---|---|---|---|---|---|---|
| | 1 | STRIKE | STRIKE | STRIKE | STRIKE | STRIKE | STRIKE | STRIKE | STRIKE | STRIKE | STRIKE | 1 |
| | 2 | STRIKE | STRIKE | STRIKE | STRIKE | STRIKE | STRIKE | STRIKE | STRIKE | STRIKE | 7† | 2 |
| | 3 | STRIKE | STRIKE | STRIKE | STRIKE | STRIKE | STRIKE | STRIKE | STRIKE | 7 | 10† | 3 |
| | 4 | STRIKE | STRIKE | STRIKE | STRIKE | STRIKE | STRIKE | STRIKE | 9 | 10 | 5† | 4 |
| | 5 | 7 | 10 | 10 | 7 | 10 | 5 | 8 | 2 | 5 | 4 | 5 |
| | 6 | 1† | 9 | 7 | 9 | 5 | 7 | 5 | 4 | 3 | 9 | 6 |
| | 7 | 8 | 2 | 6 | 5 | 3 | 1 | 10 | 8 | 1 | 6 | 7 |
| | 8 | 5 | 7 | 5 | 10 | 7 | 10 | 7 | 10 | 9 | E | 8 |
| | 9 | 2-8 | 5-9 | 4-5 (L: 5-6) | 5-8 | 3-6 | 7-8 (L: 9-10) | 3-6 (R: 2-4) | 5-6 (R: 4-5) | 2-4 (L: 3-6) | 4-7 (L: 6-10) | 9 |
| | 10 | 1-2 (L: 1-3) | 2-4 (L: 3-6) | 5-6 (R: 4-5) | 3-6 (R: 2-4) | 6-10 (R: 4-7) | 2-8 | 3-9 | 4-5 (L: 5-6) | 5-8 | 1-3 (R: 1-2) | 10 |
| | 11 | 3-6 (R: 2-4) | 5-8 | 4-7 | 2-4 | 4-8 | 5-6 | 2-4 (L: 3-6) | 3-9 | 4-5 | 5-8 | 11 |
| | 12 | 6-9 | 4-7 | 3-9 | 4-7 (L: 6-10) | 2-8 | 4-5 | 1-3 (R: 1-2) | 4-8 | 6-10 | 4-5 | 12 |
| | 13 | 5-6 | 9-10 (R: 7-8) | 6-10 (R: 4-7) | 4-8 | 6-9 | 5-8 | 5-9 | 2-8 | 1-2 (L: 1-3) | 3-9 | 13 |
| | 14 | 6-10 | 8-9 | 4-8 | 5-9 | 5-6 | 6-10 (R: 4-7) | 6-9 | 5-9 | 4-7 (L: 6-10) | 5-9 | 14 |
| | 2 | 6-8-9 | 5-6-9 | 4-8-9 | 5-6-8 (R: 4-5-9) | 4-5-8 | 4-5-9 (L: 5-6-8) | 5-6-9 | 1-8-9 | 1-5-9 | 6-8-9 | 2 |
| | 3 | 3-5-6 (R: 2-4-5) | 6-9-10 | 1-2-4 (L: 1-3-6) | 1-5-8 | 5-6-10 | 1-3-5 | 4-7-8 | 3-5-6 (R: 2-4-5) | 4-5-7 | 1-3-6 (R: 1-2-4) | 3 |
| | 4 | 6-9-10 | 4-5-9 | 4-7-8 | 2-4-7 | 3-5-6 (R: 2-4-5) | 4-5-8 (L: 5-6-9) | 3-6-9 | 6-8-9 | 3-6-10 | 2-4-5 (L: 3-5-6) | 4 |
| | 5 | 1-3-6 (R: 1-2-4) | 2-4-5 (L: 3-5-6) | 3-6-9 (R: 2-4-8) | 2-4-8 | 3-6-9 | 2-4-7 (L: 3-6-10) | 2-4-5 (L: 3-5-6) | 1-2-5 | 1-3-6 (R: 1-2-4) | 6-9-10 | 5 |
| T | 6 | 3-6-10 (R: 2-4-7) | 1-3-5 (R: 1-2-5) | 2-4-5 (L: 3-5-6) | 1-3-5 (R: 1-2-5) | 6-9-10 | 4-7-8 | 6-9-10 | 6-9-10 | 3-6-9 | 3-6-10 (R: 2-4-7) | 6 |
| | 7 | 1-2-5 (L: 1-3-5) | 1-2-4 (L: 1-3-6) | 1-3-5 (R: 1-2-5) | 1-2-4 | 1-3-6 (R: 1-2-4) | 3-6-9 (R: 2-4-8) | 1-2-5 (L: 1-3-5) | 1-2-4 (L: 1-3-6) | 1-2-5 (L: 1-3-5) | 2-4-8 | 7 |
| | 8 | 2-4-7 (L: 3-6-10) | 4-7-8 | 6-9-10 | 3-6-10 | 1-2-5 (L: 1-3-5) | 1-2-4 (L: 1-3-6) | 5-6-10 | 4-7-8 | 3-5-6 (R: 2-4-5) | 1-3-5 (R: 1-2-5) | 8 |
| | 9 | 4-7-8 | 2-4-8 (L: 3-6-9) | 5-6-9 | 2-4-5 (L: 3-5-6) | 2-4-5 | 3-5-6 (R: 2-4-5) | 1-2-4 (L: 1-3-6) | 2-4-7 | 2-4-7 | 4-7-8 | 9 |
| | 10 | 2-4-8 | 2-4-7 (L: 3-6-10) | 2-4-7 (L: 3-6-10) | 1-3-6 (R: 1-2-4) | 4-7-8 | 4-5-7 | 3-6-10 (R: 2-4-7) | 2-4-8 | 4-7-8 | 3-5-6 | 10 |
| | 11 | 1-8-9 | 5-6-10 | 4-5-7 | 4-8-9 | 3-6-10 (R: 2-4-7) | 4-5-9 (L: 5-6-8) | 4-8-9 | 1-5-9 | 5-6-9 (R: 4-5-8) | 1-3-6 | 11 |
| | 12 | 4-5-8 | 1-5-8 | 4-5-9 (L: 5-6-8) | 5-6-10 | 6-8-9 | 5-6-9 | 4-5-7 | 4-8-9 | 4-5-8 | 5-6-8 (R: 4-5-9) | 12 |
| | 2 | 2-4-5-7 | 1-2-3-8 | 4-5-8-9 | 3-5-6-10 (R: 2-4-5-7) | 1-2-3-9 | 1-2-8-9 (L: 1-3-8-9) | 5-6-8-9 | 1-2-4-5 (L: 1-3-5-6) | 3-6-9-10 (R: 2-4-7-8) | 1-2-3-4 (L: 1-2-3-6) | 2 |
| | 3 | 3-5-6-9 | 2-4-5-8 | 3-5-6-9 | 2-4-7-8 | 5-6-9-10 | 2-4-5-8 | 4-5-7-8 | 2-4-5-8 | 3-5-6-9 | 3-5-6-10 | 3 |
| | 4 | 1-3-5-9 (R: 1-2-5-8) | 1-3-6-8 (R: 1-2-4-9) | 1-3-6-9 | 1-3-6-8 | 1-3-5-8 | 3-5-6-9 | 1-2-4-9 (L: 1-3-6-8) | 1-3-5-8 (R: 1-2-5-9) | 1-3-6-9 (R: 1-2-4-8) | 1-2-5-8 (L: 1-3-5-9) | 4 |
| | 5 | 1-2-4-7 (L: 1-3-6-10) | 1-2-5-9 | 1-3-5-8 | 3-5-6-9 | 1-3-6-9 (R: 1-2-4-8) | 1-2-5-9 | 1-3-5-8 | 1-3-6-10 (R: 1-2-4-7) | 2-4-5-8 | 1-3-6-8 (R: 1-2-4-9) | 5 |
| Q | 6 | 1-3-5-8 | 1-2-4-8 (L: 1-3-6-9) | 1-3-5-9 (R: 1-2-5-8) | 1-3-6-10 | 1-2-5-9 (L: 1-3-5-8) | 1-2-5-8 (L: 1-3-5-9) | 1-3-6-9 (R: 1-2-4-8) | 1-2-5-8 (L: 1-3-5-9) | 1-2-5-9 | 1-3-6-10 (R: 1-2-4-7) | 6 |
| | 7 | 1-2-5-9 | 1-3-6-10 (R: 1-2-4-7) | 2-4-5-8 | 1-2-5-8 (L: 1-3-5-9) | 1-2-4-9 (L: 1-3-6-8) | 1-3-6-10 (R: 1-2-4-7) | 1-2-5-9 | 3-5-6-9 | 1-2-4-7 (L: 1-3-6-10) | 2-4-5-8 | 7 |
| | 8 | 1-2-4-9 | 1-3-5-8 | 1-2-4-7 (L: 1-3-6-10) | 1-2-5-9 | 2-4-5-8 | 1-2-4-8 (L: 1-3-6-9) | 1-2-4-7 | 1-2-5-9 | 1-3-5-8 | 1-2-5-9 | 8 |
| | 9 | 2-4-5-8 | 1-2-5-8 | 1-2-5-9 | 1-2-4-8 (L: 1-3-6-9) | 1-2-4-7 (L: 1-3-6-10) | 1-3-5-8 | 1-3-5-9 | 1-3-6-8 (R: 1-2-4-9) | 1-3-5-9 (R: 1-2-5-8) | 1-2-4-8 (L: 1-3-6-9) | 9 |
| | 10 | 1-3-6-9 (R: 1-2-4-8) | 3-5-6-9 | 1-2-4-9 (L: 1-3-6-8) | 1-3-5-8 | 1-3-5-9 (R: 1-2-5-8) | 1-3-6-8 (R: 1-2-4-9) | 3-5-6-9 | 1-2-4-8 | 1-2-4-9 (L: 1-3-6-8) | 1-3-5-8 | 10 |
| | 11 | 5-6-8-9 | 3-6-9-10 | 5-6-9-10 | 2-4-5-8 | 3-5-6-9 | 2-4-7-8 (L: 3-6-9-10) | 2-4-5-8 | 4-5-8-9 | 2-5-8-9 | 3-5-6-9 | 11 |
| | 12 | 1-2-3-9 | 4-5-7-8 | 1-2-3-6 (R: 1-2-3-4) | 3-5-6-8 | 2-4-5-7 (L: 3-5-6-10) | 1-3-5-6 (R: 1-2-4-5) | 1-2-3-8 | 2-4-5-9 | 1-3-8-9 (R: 1-2-8-9) | 3-5-8-9 | 12 |
| | 2 | RPS Column 8* | 4-6-7-10 | 4-6-7-8-10 | 7-9 | 4-6-10 | 4-10 | *RPS Column 1-6 | 4-6-7 | 6-8 | 4-6-7-10 | 2 |
| | 3 | 4-10 | 4-7-10 | 6-7-10 | 1-2-4-10 (L: 1-3-6-7) | *RPS Column 1-6 | 4-6-10 | 4-10 | 1-2-8 | *RPS Column 1-6 | 6-7 | 3 |
| | 4 | 6-8 | 8-10 | *RPS Column 1-6 | 4-7-10 | 5-7 | 7-10 | 8-10 | 1-2-4-10 (L: 1-3-6-7) | 4-6-7 | 4-7-9 | 4 |
| | 5 | 2-7 | 1-2-10 | 5-10 | 6-7 | 3-8 (R: 2-9) | 1-3-9 (R: 1-2-8) | 6-7 | 1-3-7 | 5-7 | 1-3-9 | 5 |
| S | 6 | 1-3-7 | 3-10 (R: 2-7) | 4-9 | 3-7-10 | 4-6 | 2-9 (L: 3-8) | 4-7-9 | 2-7 (L: 3-10) | 1-2-10 | 7-10 | 6 |
| | 7 | 5-7 | 4-7-9 | 4-6-7 | 1-2-8 (L: 1-3-9) | 6-8 | 2-7-10 | 6-8-10 | 5-10 | 3-10 | 8-10 | 7 |
| | 8 | 3-7-10 (R: 2-7-10) | 2-9 | 2-7-10 (L: 3-7-10) | 2-7 | 6-7-10 | 5-10 | 3-10 | 3-7-10 | 7-10 | 4-9 | 8 |
| | 9 | 1-2-8 | 5-7 | 7-10 | 6-8 | 8-10 | 4-9 | 1-2-10 (L: 1-3-7) | 4-6 | 2-7-10 | 2-9 | 9 |
| | 10 | 3-8 | 7-9 | 4-6 | RPS Column 8* | 1-3-7 (R: 1-2-10) | 4-6-7-10 | 4-7-10 | RPS Column 8* | 3-8 | 5-10 | 10 |
| | 11 | 4-6-7-9-10 | RPS Column 7* | 1-3-9 | 4-10 | 7-9 | 4-7-9 | 1-3-6-7 (R: 1-2-4-10) | 7-9 | 4-6-10 | RPS Column 7* | 11 |
| | 12 | 4-9 | 4-6-10 | 6-8-10 | 4-6 | 4-6-7-8-10 | RPS Column 7* | 6-7-10 | 6-7 | 4-6-7-9-10 | 6-8-10 | 12 |
| | 2 | 1-4-6 | RPO Column 1** | 1-8 | RPO Column 1** | 5-8-9 | RPO Column 1** | 3-5-9 | RPO Column 1** | 1-5-6 | RPO Column 1** | 2 |
| | 3 | 7-8-9 | 1-2-3 | 3-5-8 | 3-5-9 | 2-5-8 | 1-4-6 | 1-5 | 2-5-9 | 1-3-4-5 | 7-8-9 | 3 |
| | 4 | 1-2-3 | 1-2-3-5 | 1-2-5-6 | 1-9 | 1-3-4-5 | 7-8-9 | 1-2-5-6 | 1-4-6 | 8-9-10 | 3-5-8 | 4 |
| | 5 | RPO Column 1** | 5-8-9 | RPO Column 1** | RPO Column 1** | RPO Column 1** | 5-8-9 | RPO Column 1** | RPO Column 1** | 5-7-8 | 1-2-3-5 | 5 |
| 01 | 6 | 5-9-10 | 1-8 | 5-9-10 | 2-5 (L: 3-5) | 1-5-6 | 2-5-8 (L: 3-5-9) | 2-5-9 (L: 3-5-8) | 3-5-9 (R: 2-5-8) | 1-2-3 | 5-9-10 | 6 01 |
| | 7 | 1-5 | 7-8-9 | 2-5-8 | 1-2-3-5 | 1-4-5 | 3-5-8 | 1-2-3 | 2-5 | 1-3-4-5 | 3-5 | 7 |
| | 8 | 8-9-10 | 3-5-9 | 1-9 | 5-7-8 | 1-2-3 | 3-5 (R: 2-5) | 2-5 | 1-4-5 | RPO Column 1** | 1-2-5-6 | 8 |
| | 9 | 5-7-8 | 1-4-5 (L: 1-5-6) | 5-8-9 | 1-4-6 | 1-2-5-6 | RPO Column 1** | 1-9 | 5-9-10 | 2-5-9 | RPO Column 1** | 9 |
| | 10 | 1-2-5-6 | RPO Column 1** | 1-3-4-5 | 5-9-10 | 3-5-8 (R: 2-5-9) | 8-9-10 | 5-7-8 | 1-2-3-5 | 7-8-9 | 1-5-6 (R: 1-4-5) | 10 |
| | 11 | 3-5 | 1-5 | 8-9-10 | 1-5-6 | 5-9-10 | 5-7-8 | 8-9-10 | 1-8 | 1-4-5 | 2-5-8 | 11 |
| | 12 | RPO Column 1** | 5-7-8 | RPO Column 1** | 2-5-9 | RPO Column 1** | 7-8-9 | RPO Column 1** | 1-2-3 | RPO Column 1** | 5-8-9 | 12 |
| | 2 | 3-5-8 (R: 2-5-9) | 5-8-9 | RPO Column 1** | 3-5-9 | RPO Column 1** | 1-2-3-5 | RPO Column 1** | 5-9-10 | RPO Column 1** | 5-7-8 | 2 |
| | 3 | RPO Column 1** | 1-2-5-6 | 1-4-5 | RPO Column 1** | 5-7-8 | RPO Column 1** | 1-4-6 | RPO Column 1** | 1-2-3 | RPO Column 1** | 3 |
| | 4 | 1-5-6 | RPO Column 1** | 3-5-9 (R: 2-5-8) | 5-8-9 | RPO Column 1** | 1-9 | RPO Column 1** | 1-2-5-6 | RPO Column 1** | 1-4-5 | 4 |
| | 5 | RPO Column 1** | 2-5-8 | RPO Column 1** | 3-5-8 | 1-2-3 | RPO Column 1** | 1-5 | RPO Column 1** | 1-5-6 | 1-2-3-5 | 5 |
| 02 | 6 | 1-2-3-5 | RPO Column 1** | 1-3-4-5 | 1-9 | RPO Column 1** | 1-4-5 (L: 1-5-6) | RPO Column 1** | 1-8 | 2-5 (L: 3-5) | RPO Column 1** | 6 02 |
| | 7 | 8-9-10 | 1-5 | 7-8-9 | RPO Column 1** | 3-5 (R: 2-5) | 2-5-9 | 5-7-8 | 1-3-4-5 | RPO Column 1** | 2-5-8 (L: 3-5-9) | 7 |
| | 8 | 1-8 | RPO Column 1** | 2-5 | 8-9-10 | RPO Column 1** | 1-5-6 (R: 1-4-5) | 8-9-10 | RPO Column 1** | 1-9 | 5-8-9 | 8 |
| | 9 | 5-9-10 | 1-2-3 | RPO Column 1** | 1-2-5-6 | 7-8-9 | RPO Column 1** | 3-5-9 | 2-5-9 | 5-9-10 | RPO Column 1** | 9 |
| | 10 | RPO Column 1** | 8-9-10 | 2-5-9 | RPO Column 1** | 2-5-8 | 2-5 (L: 3-5) | 5-8-9 | 3-5 | 3-5-8 (R: 2-5-9) | RPO Column 1** | 10 |
| | 11 | 1-4-5 | RPO Column 1** | RPO Column 1** | 1-5 | 1-8 | RPO Column 1** | 1-2-5-6 | RPO Column 1** | 1-3-4-5 | 1-4-6 | 11 |
| | 12 | RPO Column 1** | 3-5 (R: 2-5) | 1-4-6 | RPO Column 1** | 1-3-4-5 | 3-5-9 | RPO Column 1** | 7-8-9 | RPO Column 1** | 2-5-9 | 12 |

FIG. 9.

RP SPLIT BOARD

First find proper RP Column, as explained on Strike Board, then roll both dice to find the line in that column for the spare result.

| | RPS Column 1 | RPS Column 2 | RPS Column 3 | RPS Column 4 | | RPS Column 5 | RPS Column 6 | RPS Column 7 | RPS Column 8 | |
|---|---|---|---|---|---|---|---|---|---|---|
| 11 | 2-6-8-9 | 3-5-7-9 | 2-6-9-10 | 1-2-3-5-6-7-9-10 | 11 | 2-7-8-10 | 3-5-6-7 | 1-8-10 | 2-9-10 | 11 |
| 12 | 1-2-3-4-5-7-10 | 2-8-9-10 | 4-5-7-10 | 3-4-8-10 | 12 | 3-5-9-10 | 3-4-6-10 | 1-4 | 2-6-7 | 12 |
| 13 | 3-4-7-9 | 1-3-4-6-8-10 | 3-4-6-8 | 1-3-4-7-8-10 | 13 | 1-3-4-6-7-8 | 1-2-4-6-7-8-10 | 2-8-10 | 1-10 | 13 |
| 14 | 1-2-4-7-8-10 | 1-2-3-5-7 | 1-2-6-7-8-10 | 1-5-7-9 | 14 | 2-4-5-8-10 | 3-4-7-8-10 | 4-9-10 | 3-7-8 | 14 |
| 15 | 3-4-7-9-10 | 6-8-9-10 | 3-5-7-10 | 1-3-4-8 | 15 | 3-4-6-7-8-10 | 4-6-7-8 | 2-6 | 1-4-10 | 15 |
| 16 | 1-2-3-4-5-10 | 2-4-5-7-8-10 | 1-2-3-9-10 | 3-5-8-10 | 16 | 1-5-6-8 | 1-3-5-6-7-10 | 1-6-10 | 4-8-10 | 16 |
| 21 | 4-6-8-9 | 1-3-4-6 | 2-4-6-7-8-10 | 1-4-7-8 | 21 | 4-6-8-10 | 6-7-8-10 | 4-5-10 | 3-4 | 21 |
| 22 | 1-2-3-5-7-10 | 2-4-6-10 | 1-5-8-10 | 1-2-3-6-7-9-10 | 22 | 1-4-5-10 | 1-6-7-8 | 1-2-6 | 3-8-9 | 22 |
| 23 | 6-7-9-10 | 1-4-8-10 | 1-2-7-8 | 1-6-8-10 | 23 | 3-7-8-10 | 1-2-3-7-9-10 | 4-6-9 | 1-6-7 | 23 |
| 24 | 1-2-4-5-7-10 | 1-2-3-8-10 | 5-6-7-8 | 2-4-7-10 | 24 | 1-6-9-10 | 4-7-9-10 | 1-4-7 | 2-6-9 | 24 |
| 25 | 1-4-6-8 | 3-6-7-9-10 | 1-2-3-4-7-10 | 1-2-7-9 | 25 | 1-2-3-7-8 | 1-2-6-8 | 3-4-10 | 1-5-7 | 25 |
| 26 | 4-8-9-10 | 1-2-4-6 | 1-4-9-10 | 3-7-8-9 | 26 | 2-6-7-9-10 | 2-4-6-8 | 1-2-9 | 2-8-9 | 26 |
| 31 | 1-2-3-7-10 | 2-6-7-8 | 5-7-9-10 | 1-8-9-10 | 31 | 4-5-9-10 | 5-6-7-9-10 | 2-5-10 | 1-3-10 | 31 |
| 32 | 2-4-6-9 | 1-2-6-10 | 1-3-4-7 | 1-2-5-10 | 32 | 1-2-7-10 | 1-2-3-7-9 | 1-7-9 | 3-5-7 | 32 |
| 33 | 1-6-7-9 | 3-6-8-9 | 1-6-8-9 | 4-7-8-9 | 33 | 2-4-8-9 | 3-6-7-9 | 3-6-8 | 2-4-9 | 33 |
| 34 | 1-3-5-7 | 1-2-3-4-7-9 | 1-2-3-5-6-7-10 | 1-2-3-6-7-10 | 34 | 1-3-7-10 | 1-2-8-10 | 1-3-8 | 3-6-7 | 34 |
| 35 | 3-6-7-10 | 2-5-7-8 | 4-5-7-8-10 | 3-6-7-9-10 | 35 | 3-6-7-8 | 2-5-9-10 | 3-7-9 | 1-3-4 | 35 |
| 36 | 3-5-6-7-9-10 | 1-4-5-7 | 3-6-8-10 | 4-6-8-10 | 36 | 1-2-3-5-6-7 | 6-8-9-10 | 2-7-9 | 3-9-10 | 36 |
| 41 | 1-2-3-10 | 1-6-7-10 | 1-2-5-7 | 1-3-7-9 | 41 | 6-7-8-9 | 1-3-8-10 | 1-5-10 | 2-5-7 | 41 |
| 42 | 1-4-8-9 | 6-7-9-10 | 2-4-5-10 | 2-6-7-8-10 | 42 | 1-2-6-7 | 3-7-9-10 | 2-6-10 | 1-6-9 | 42 |
| 43 | 3-8-9-10 | 1-2-3-5-8-10 | 1-4-5-8 | 5-6-7-9 | 43 | 2-4-6-7 | 1-2-3-7 | 5-7-9 | 3-4-9 | 43 |
| 44 | 1-2-6-9 | 4-6-8-10 | 2-4-7-9 | 3-5-6-7-9 | 44 | 4-7-8-10 | 1-5-6-9 | 1-4-9 | 1-9-10 | 44 |
| 45 | 1-7-8-10 | 3-4-8-9-10 | 1-2-3-6-7-9 | 1-2-3-4-8-10 | 45 | 5-6-7-8-10 | 1-2-3-5-7-9 | 3-4-8 | 5-6-7 | 45 |
| 46 | 1-3-9-10 | 1-2-3-4-7-8-10 | 4-6-9-10 | 2-5-7-10 | 46 | 1-2-4-6-9-10 | 5-6-8-10 | 2-4-6 | 1-2-7 | 46 |
| 51 | 2-4-7-8-10 | 5-6-7-9-10 | 2-6-7-8-9 | 1-4-5-9 | 51 | 1-5-7-10 | 3-6-7-8-9 | 3-5-10 | 6-7-8 | 51 |
| 52 | 5-7-8-9 | 1-4-6-9 | 1-2-3-5-10 | 2-4-6-7-9-10 | 52 | 1-2-3-7-8-10 | 1-3-6-7-8-10 | 3-7 | 2-7-8 | 52 |
| 53 | 1-2-3-4-10 | 1-2-4-6-7-8 | 3-5-6-7-8 | 5-8-9-10 | 53 | 5-6-7-10 | 1-4-7-10 | 3-4-6 | 1-7-8 | 53 |
| 54 | 3-6-7-8-10 | 5-7-8-10 | 1-2-4-6-7-9 | 1-2-3-6-7 | 54 | 3-5-6-7-10 | 4-6-7-9 | 2-6-8 | 2-6-7-10 | 54 |
| 55 | 1-2-9-10 | 1-3-5-6-7-9-10 | 2-5-7-9 | 4-5-7-9-10 | 55 | 1-3-4-9 | 1-3-4-10 | 5-8-10 | 1-4-8 | 55 |
| 56 | 2-4-9-10 | 1-7-9-10 | 1-4-6-10 | 1-2-4-6-7-10 | 56 | 2-5-8-10 | 1-7-8-9 | 1-5-6 | 7-8-10 | 56 |
| 61 | 1-5-6-10 | 1-3-5-10 | 2-6-7-9 | 1-5-6-7 | 61 | 1-4-7-9 | 2-4-8-10 | 7-9-10 | 3-4-7 | 61 |
| 62 | 1-3-4-6-7-10 | 2-4-7-9-10 | 1-3-7-8 | 2-4-5-7-10 | 62 | 5-7-8-10 | 1-4-6-7 | 2-4-10 | 2-10 | 62 |
| 63 | 3-5-7-8 | 1-2-4-7-9-10 | 2-4-8-9-10 | 1-2-6-7-9-10 | 63 | 1-3-4-7-9-10 | 2-4-5-9-10 | 1-7 | 5-7-10 | 63 |
| 64 | 1-3-6-7-9-10 | 3-4-7-10 | 1-3-4-6-9-10 | 4-5-8-10 | 64 | 3-4-9-10 | 3-4-6-7-9-10 | 6-7-9 | 1-7-10 | 64 |
| 65 | 3-4-6-7 | 4-5-7-9 | 3-4-8-9 | 3-4-6-9 | 65 | 1-2-4-5-7-8-10 | 1-3-4-6-7-9 | 1-6-8 | 1-6 | 65 |
| 66 | 1-3-4-6-7-9-10 | 2-6-8-10 | 1-2-3-4-5-7-8-10 | 2-7-8-9 | 66 | 3-4-7-8 | 2-7-9-10 | 3-8-10 | 4-6-8 | 66 |

All the spare leaves shown in the above eight columns are SPLITS and therefore will be found on one of the SPLIT BOARDS. The number of pins in the split will determine on which SPLIT BOARD it will be located. For example, if four pins are left in the split, look for the board headed FOUR-PIN SPLITS, which is SPLIT BOARD S-2 or SPLIT SPLIT BOARD S-3. If two pin numbers are given, look for the TWO-PIN SPLIT BOARD (S-1) and so on.

FIG. 10.

RPO BOARD

In the case of a gutter ball use the Strike Board again for the bowler's second (spare attempt) roll of the frame.

No. 1. Because of this interference the bowler has the option of accepting the resulting pinfall or of discounting this roll and rebowling. Therefore, roll the dice again in order to determine the pinfall for this roll. You then have the option of accepting this result or of rolling again and accepting the second result, for better or for worse.

No. 2. The bowler's effectiveness is lessened for remainder of game and tournament (if you happen to be playing one). Decrease numbers 3 through 10 in his strike (X) column by two points. All other numbers remain unchanged. Decrease numbers 1 through 10 in his spare (S) column by two points. All others remain the same.

No. 3. Increase bowler's numbers 6 through 10 in strike (X) column by one point and numbers 5 through 10 in spare (S) column by one point for remainder of this game and for his next game only. All other numbers remain the same.

No. 4. Increase numbers 4 through 12 in strike (X) column by two points and numbers 5 through 10 in spare (S) column by two points for remainder of this game and for his next two games only. All other numbers remain the same.

No. 5. Increase numbers 3 through 14 in strike (X) column by two points and numbers 3 through 11 in spare (S) column by two points for remainder of this game and for his next four games only. All other numbers remain the same.

If an efficiency increase number should happen to come up while one is already in effect, it must be ignored. It does not add on to the one currently in effect, nor does it carry over and follow the current one.

| | RPO Column One | RPO Column Two | | RPO Column Three | RPO Column Four | |
|---|---|---|---|---|---|---|
| 11 | Use Column 2; roll dice again | Use Column 3; roll dice again | 11 | 1-2-3-5-6-9-10 (R: 1-2-3-4-5-7-8) | Gutter ball; bowler slips and misses all ten pins. | 11 |
| 12 | 1-2-3-5-6 (R: 1-2-3-4-5) | 1-3-4-7-8-9 (L: 1-2-6-8-9-10) | 12 | 1-2-3-4-5-6-7 (L: 1-2-3-4-5-6-10) | 1-2-3-4-5-6-7-8 (L: 1-2-3-4-5-6-9-10) | 12 |
| 13 | Use Column 2; roll dice again | Use Column 3; roll dice again | 13 | Use Column 4; roll dice again | Bowler injured; leg trouble; must forfeit game. | 13 |
| 14 | 1-2-3-6-9 (R: 1-2-3-4-8) | 1-2-3-4-5-6 | 14 | 1-2-3-4-7-8-9 (L: 1-2-3-6-8-9-10) | Foul; bowler encroaches beyond foul line; roll counts, no pins credited. | 14 |
| 15 | Use Column 2; roll dice again | Use Column 3; roll dice again | 15 | 1-2-3-6-8-9-10 (R: 1-2-3-4-7-8-9) | 1-2-3-4-5-7-8-9 (L: 1-2-3-5-6-8-9-10) | 15 |
| 16 | 1-2-3-4-9 (L: 1-2-3-6-8) | 1-3-5-6-9-10 (R: 1-2-4-5-7-8) | 16 | 1-2-3-4-5-7-8 (L: 1-2-3-5-6-9-10) | Bowler's efficiency increases; see explanation No. 3 above. | 16 |
| 21 | 4-5-7-8-9 | 1-2-3-6-8-10 (R: 1-2-3-4-7-9) | 21 | Use Column 4; roll dice again | 1-2-3-4-5-6-7-8-9 (L: 1-2-3-4-5-6-8-9-10) | 21 |
| 22 | 1-2-3-8-9 | Use Column 3; roll dice again | 22 | 1-2-3-5-6-8-10 (R: 1-2-3-4-5-7-9) | Spectator interference; see explanation No. 1 above. | 22 |
| 23 | 1-2-3-5-8 | 1-2-3-7-8-9 (L: 1-2-3-8-9-10) | 23 | Use Column 4; roll dice again | 1-2-3-4-5-6-9-10 (R: 1-2-3-4-5-6-7-8) | 23 |
| 24 | 5-6-8-9-10 | 1-2-4-7-8-9 (L: 1-3-6-8-9-10) | 24 | 1-2-3-4-5-7-9 (L: 1-2-3-5-6-8-10) | Gutter ball; bowler loses balance and misses all ten pins. | 24 |
| 25 | 2-4-5-7-9 | Use Column 3; roll dice again | 25 | 1-2-4-5-7-8-9 (L: 1-3-5-6-8-9-10) | Bowler develops finger blister; see explanation No. 2 above. | 25 |
| 26 | 1-2-3-4-6 | 1-2-3-4-5-7 (L: 1-2-3-5-6-10) | 26 | 1-2-3-4-5-6-7 (L: 1-2-3-4-5-6-10) | 1-2-3-5-6-8-9-10 (R: 1-2-3-4-5-7-8-9) | 26 |
| 31 | Use Column 2; roll dice again | Use Column 3; roll dice again | 31 | Use Column 4; roll dice again | Bowler's efficiency increases; see explanation No. 4 above. | 31 |
| 32 | 1-2-3-5-9 | 1-2-4-5-7-8 (L: 1-3-5-6-9-10) | 32 | 1-2-3-4-6-9-10 (R: 1-2-3-4-6-7-8) | Gutter ball; bowler slips and misses all ten pins. | 32 |
| 33 | 2-4-5-7-8 | Use Column 3; roll dice again | 33 | Use Column 4; roll dice again | 1-2-3-4-5-6-8-9-10 (R: 1-2-3-4-5-6-7-8-9) | 33 |
| 34 | Use Column 2; roll dice again | 1-2-3-4-7-9 (L: 1-2-3-6-8-10) | 34 | 1-2-3-4-6-7-8 (L: 1-2-3-4-6-9-10) | Foul; bowler encroaches beyond foul line; roll counts, no pins credited. | 34 |
| 35 | 3-5-6-8-10 | Use Column 3; roll dice again | 35 | Use Column 4; roll dice again | 1-2-3-4-5-6-9-10 (R: 1-2-3-4-5-6-7-8) | 35 |
| 36 | 1-2-3-4-8 (L: 1-2-3-6-9) | 1-2-3-4-7-8 (L: 1-2-3-6-9-10) | 36 | 1-2-3-4-5-7-8 (L: 1-2-3-5-6-9-10) | Foul; bowler encroaches beyond foul line; roll counts, no pins credited. | 36 |
| 41 | Use Column 2; roll dice again | 2-4-5-7-8-9 (R: 3-5-6-8-9-10) | 41 | 1-2-3-5-6-9-10 (R: 1-2-3-4-5-7-8) | Bowler injured; twists ankle; see explanation No 2 above. | 41 |
| 42 | 3-5-6-9-10 | Use Column 3; roll dice again | 42 | Use Column 4; roll dice again | Distraction by moving object; see explanation No. 1 above. | 42 |
| 43 | 1-2-3-5-9 | 1-2-3-5-6-10 (R: 1-2-3-4-5-7) | 43 | 1-2-3-4-5-7-9 (L: 1-2-3-5-6-8-10) | 1-2-3-4-5-6-7-8-9 (L: 1-2-3-4-5-6-8-9-10) | 43 |
| 44 | 2-4-5-7-9 (L: 3-5-6-8-10) | Use Column 3; roll dice again | 44 | 1-3-5-6-8-9-10 (R: 1-2-4-5-7-8-9) | Bowler's efficiency increases; see explanation No. 3 above. | 44 |
| 45 | Use Column 2; roll dice again | Use Column 3; roll dice again | 45 | Use Column 4; roll dice again | Foul; bowler encroaches beyond foul line; roll counts, no pins credited. | 45 |
| 46 | 1-2-3-4-7 (L: 1-2-3-6-10) | 1-2-3-4-8-9 (L: 1-2-3-6-8-9) | 46 | 1-2-3-4-5-6-10 (R: 1-2-3-4-5-6-7) | 1-2-3-4-5-6-7-8 (L: 1-2-3-4-5-6-9-10) | 46 |
| 51 | 1-2-3-8-9 | Use Column 3; roll dice again | 51 | Use Column 4; roll dice again | Bowler's efficiency increases; see explanation No. 3 above. | 51 |
| 52 | Use Column 2; roll dice again | 1-2-3-8-9-10 (R: 1-2-3-7-8-9) | 52 | 1-2-3-4-7-8-9 (L: 1-2-3-6-8-9-10) | Bowler disqualified for unreasonable delay; must forfeit this game. | 52 |
| 53 | 1-2-3-5-8 | 1-3-6-8-9-10 (R: 1-2-4-7-8-9) | 53 | Use Column 4; roll dice again | Gutter ball; bowler brushes leg with ball on approach to the line. | 53 |
| 54 | Use Column 2; roll dice again | 1-2-3-6-8-9 (R: 1-2-3-4-8-9) | 54 | 1-2-3-4-6-7-8 (L: 1-2-3-4-6-9-10) | Bowler's efficiency increases; see explanation No. 5 above. | 54 |
| 55 | 2-4-5-7-8 (L: 3-5-6-9-10) | Use Column 3; roll dice again | 55 | Use Column 4; roll dice again | 1-2-3-4-5-7-8-9 (L: 1-2-3-5-6-8-9-10) | 55 |
| 56 | 1-2-3-4-6 | 1-2-6-8-9-10 (R: 1-3-4-7-8-9) | 56 | 1-2-3-4-6-9-10 (R: 1-2-3-4-6-7-8) | Bowler injured; twists knee; see explanation No. 2 above. | 56 |
| 61 | 4-5-7-8-9 (R: 5-6-8-9-10) | Use Column 3; roll dice again | 61 | 1-3-5-6-8-9-10 (R: 1-2-4-5-7-8-9) | Foul; bowler encroaches beyond foul line; roll counts, no pins credited. | 61 |
| 62 | 1-2-3-6-8 (R: 1-2-3-4-9) | 1-2-3-4-5-6 | 62 | 1-2-3-6-8-9-10 (R: 1-2-3-4-7-8-9) | Bowler's efficiency increases; see explanation No. 4 above. | 62 |
| 63 | Use Column 2; roll dice again | 3-5-6-8-9-10 (L: 2-4-5-7-8-9) | 63 | 1-2-3-4-5-6-10 (R: 1-2-3-4-5-6-7) | 1-2-3-5-6-8-9-10 (R: 1-2-3-4-5-7-8-9) | 63 |
| 64 | 1-2-3-4-5 (L: 1-2-3-5-6) | 1-2-3-6-9-10 (R: 1-2-3-4-7-8) | 64 | Use Column 4; roll dice again | Bowler's efficiency increases; see explanation No. 3 above. | 64 |
| 65 | 1-2-3-6-10 (R: 1-2-3-4-7) | Use Column 3; roll dice again | 65 | 1-2-3-5-6-8-10 (R: 1-2-3-4-5-7-9) | Gutter ball; bowler slips and misses all ten pins. | 65 |
| 66 | Use Column 2; roll dice again | Use Column 3; roll dice again | 66 | 1-2-4-5-7-8-9 (L: 1-3-5-6-8-9-10) | 1-2-3-4-5-6-8-9-10 (R: 1-2-3-4-5-6-7-8-9) | 66 |

FIG. 11A.

A-1 SPARE BOARD A-1

SINGLE-PIN SPARES

| | 1 | 2 | 3 | 4 | 5 | 6 | (L) 7 (R) | 8 | 9 | (L) 10 (R) |
|---|---|---|---|---|---|---|---|---|---|---|
| 1 | S | S | S | S | S | S | S S | S | S | S S |
| 2 | S | S | S | S | S | S | S S | S | S | S S |
| 3 | S | S | S | S | S | S | S S | S | S | S S |
| 4 | S | S | S | S | S | S | S S | S | S | S S |
| 5 | S | S | S | S | S | S | S S | S | S | S S |
| 6 | S | S | S | S | S | S | S S | S | S | S S |
| 7 | S | S | S | S | S | S | S S | S | S | S S |
| 8 | S | S | S | S | S | S | S S | S | S | S S |
| 9 | S | S | S | S | S | S | S S | S | S | S S |
| 10 | S | S | S | S | S | S | S S | S | S | S S |
| 11 | S | S | S | S | S | S | S S | S | S | S S |
| 12 | S | S | S | S | S | S | S S | S | S | S S |
| 13 | S | S | S | S | S | S | 0 S | S | S | S 0 |
| 14 | RP1 | RP1 | RP1 | RP2 | RP1 | RP2 | 0 0 | RP1 | RP1 | 0 0 |
| 15 | RP2 | RP2 | RP2 | RP2 | RP2 | RP2 | 0 0 | RP2 | RP2 | 0 0 |

TWO-PIN SPARES

| | 1-2 | 1-3 | 2-4 | 2-8 | 3-6 |
|---|---|---|---|---|---|
| 1 | S | S | S | S | S |
| 2 | S | S | S | S | S |
| 3 | S | S | S | S | S |
| 4 | S | S | S | S | S |
| 5 | S | S | S | S | S |
| 6 | S | S | S | S | S |
| 7 | S | S | S | S | S |
| 8 | S | S | S | S | S |
| 9 | S | S | S | S | S |
| 10 | S | S | S | S | S |
| 11 | S | S | S | S | S |
| 12 | S | S | S | RP3 | S |
| 13 | RP3 | RP3 | RP3 | RP4 | RP3 |
| 14 | RP3 | RP3 | RP3 | 1 | RP3 |
| 15 | RP4 | RP4 | RP4 | 1 | RP4 |

RP COLUMNS

| | RP1 | | RP2 | |
|---|---|---|---|---|
| 1 | S | 1 | S | 1 |
| 2 | S | 2 | S | 2 |
| 3 | S | 3 | S | 3 |
| 4 | S | 4 | S | 4 |
| 5 | S | 5 | S | 5 |
| 6 | S | 6 | S | 6 |
| 7 | S | 7 | S | 7 |
| 8 | S | 8 | S | 8 |
| 9 | S | 9 | S | 9 |
| 10 | S | 10 | S | 10 |
| 11 | S | 11 | 0 | 11 |
| 12 | S | 12 | 0 | 12 |
| 13 | 0 | 13 | 0 | 13 |
| 14 | 0 | 14 | 0 | 14 |
| 15 | 0 | 15 | 0 | 15 |

TWO-PIN SPARES

| | 3-9 | 4-5 | (L) 4-7 (R) | 4-8 | 5-6 | 5-8 | 5-9 | 6-9 | (L) 6-10 (R) | (L) 7-8 (R) | 8-9 | (L) 9-10 (R) |
|---|---|---|---|---|---|---|---|---|---|---|---|---|
| 1 | S | S | S S | S | S | S | S | S | S S | S S | S | S S |
| 2 | S | S | S S | S | S | S | S | S | S S | S S | S | S S |
| 3 | S | S | S S | S | S | S | S | S | S S | S S | S | S S |
| 4 | S | S | S S | S | S | S | S | S | S S | S S | S | S S |
| 5 | S | S | S S | S | S | S | S | S | S S | S S | S | S S |
| 6 | S | S | S S | S | S | S | S | S | S S | S S | S | S S |
| 7 | S | S | S S | S | S | S | S | S | S S | S S | S | S S |
| 8 | S | S | S S | S | S | S | S | S | S S | S S | S | S S |
| 9 | S | S | S S | S | S | S | S | S | S S | S S | S | S S |
| 10 | S | S | S S | S | S | S | S | S | S S | S S | S | S S |
| 11 | S | S | S S | S | S | S | S | S | S S | RP3 S | S | S RP3 |
| 12 | RP3 | S | S S | S | S | S | S | S | S S | RP3 RP3 | RP3 | RP3 RP3 |
| 13 | RP4 | RP4 | RP4 RP3 | RP3 | RP4 | RP3 | RP3 | RP3 | RP3 RP4 | RP4 RP4 | RP4 | RP4 RP4 |
| 14 | 1 | RP3 | RP3 RP3 | RP3 | RP3 | RP3 | RP3 | RP3 | RP3 RP3 | RP3 RP3 | 1 | RP3 RP' |
| 15 | 1 | 1 | 1 RP4 | RP4 | 1 | RP4 | RP4 | RP4 | RP4 1 | 1 1 | 1 | 1 1 |

RP COLUMNS

| | RP3 | | RP4 | |
|---|---|---|---|---|
| 1 | S | 1 | S | 1 |
| 2 | S | 2 | S | 2 |
| 3 | S | 3 | S | 3 |
| 4 | S | 4 | S | 4 |
| 5 | S | 5 | S | 5 |
| 6 | S | 6 | S | 6 |
| 7 | S | 7 | S | 7 |
| 8 | S | 8 | S | 8 |
| 9 | S | 9 | S | 9 |
| 10 | S | 10 | 1 | 10 |
| 11 | S | 11 | 1 | 11 |
| 12 | 1 | 12 | 1 | 12 |
| 13 | 1 | 13 | 1 | 13 |
| 14 | 0 | 14 | 0 | 14 |
| 15 | 0 | 15 | 0 | 15 |

THREE-PIN SPARES

| | (L) 1-2-4 (R) | 1-2-5 | 1-3-5 | (L) 1-3-6 (R) | 1-5-8 | 1-5-9 | 1-8-9 | 2-4-5 | (L) 2-4-7 (R) | 2-4-8 | 3-5-6 | |
|---|---|---|---|---|---|---|---|---|---|---|---|---|
| 1 | S S | S | S | S S | S | S | S | S | S S | S | S | 1 |
| 2 | S S | S | S | S S | S | S | S | S | S S | S | S | 2 |
| 3 | S S | S | S | S S | S | S | S | S | S S | S | S | 3 |
| 4 | S S | S | S | S S | S | S | S | S | S S | S | S | 4 |
| 5 | S S | S | S | S S | S | S | S | S | S S | S | S | 5 |
| 6 | S S | S | S | S S | S | S | S | S | S S | S | S | 6 |
| 7 | S S | S | S | S S | S | S | S | S | S S | S | S | 7 |
| 8 | S S | S | S | S S | RP5 | RP5 | S | S | S S | S | S | 8 |
| 9 | S S | S | S | S S | RP5 | RP5 | S | S | S S | S | S | 9 |
| 10 | S S | S | S | S S | RP6 | RP6 | RP5 | S | S S | S | S | 10 |
| 11 | S S | S | S | S S | RP7 | RP7 | RP6 | S | S S | S | S | 11 |
| 12 | S S | S | S | S S | 2 | 2 | RP7 | S | RP5 S | S | S | 12 |
| 13 | RP5 S | S | S | S RP5 | 2 | 2 | 2 | S | RP6 RP5 | RP5 | S | 13 |
| 14 | RP6 RP5 | RP5 | RP5 | RP5 RP6 | 2 | 2 | 1 | RP5 | RP7 RP6 | RP5 | RP5 | 14 |
| 15 | RP7 RP6 | RP6 | RP6 | RP6 RP7 | 1 | 1 | 1 | RP5 | 2 RP7 | RP5 | RP5 | 15 |

THREE-PIN SPARES

| | 3-6-9 | (L) 3-6-10 (R) | (L) 4-5-7 (R) | 4-5-8 | 4-5-9 | (L) 4-7-8 (R) | (L) 4-8-9 (R) | 5-6-8 | |
|---|---|---|---|---|---|---|---|---|---|
| 1 | S | S S | S S | S | S | S S | S S | S | 1 |
| 2 | S | S S | S S | S | S | S S | S S | S | 2 |
| 3 | S | S S | S S | S | S | S S | S S | S | 3 |
| 4 | S | S S | S S | S | S | S S | S S | S | 4 |
| 5 | S | S S | S S | S | S | S S | S S | S | 5 |
| 6 | S | S S | S S | S | S | S S | S S | S | 6 |
| 7 | S | S S | S S | S | S | S S | S S | S | 7 |
| 8 | S | S S | S S | S | S | S S | S S | S | 8 |
| 9 | S | S S | S S | S | S | S S | S S | S | 9 |
| 10 | S | S S | RP5 S | S | S | S S | S S | S | 10 |
| 11 | S | S S | RP5 S | S | RP5 | S S | S RP5 | RP5 | 11 |
| 12 | S | S RP5 | RP6 RP5 | RP5 | RP6 | S S | RP5 RP6 | RP6 | 12 |
| 13 | RP5 | RP5 RP6 | RP7 RP6 | RP5 | RP6 | RP5 S | RP5 RP7 | RP6 | 13 |
| 14 | RP5 | RP6 RP7 | 2 RP7 | RP6 | 2 | RP6 RP5 | RP6 2 | 2 | 14 |
| 15 | RP5 | RP7 2 | 2 2 | RP7 | 2 | RP7 RP6 | 2 2 | 2 | 15 |

RP COLUMNS

| | RP5 | RP6 | RP7 | RP8 | RP9 | |
|---|---|---|---|---|---|---|
| 1 | S | S | S | S | S | 1 |
| 2 | S | S | S | S | S | 2 |
| 3 | S | S | S | S | S | 3 |
| 4 | S | S | S | S | S | 4 |
| 5 | S | S | S | S | S | 5 |
| 6 | S | S | S | S | S | 6 |
| 7 | S | S | S | S | S | 7 |
| 8 | S | S | S | S | S | 8 |
| 9 | S | S | RP8 | S | 2 | 9 |
| 10 | S | RP8 | RP8 | S | 2 | 10 |
| 11 | RP8 | RP8 | RP8 | 2 | 1 | 11 |
| 12 | RP8 | RP8 | RP8 | 1 | 1 | 12 |
| 13 | RP9 | RP8 | RP9 | 1 | 0 | 13 |
| 14 | RP8 | 2 | 1 | 0 | 0 | 14 |
| 15 | RP9 | 2 | 1 | 0 | 0 | 15 |

THREE-PIN SPARES

| | 5-6-9 | (L) 5-6-10 (R) | (L) 6-8-9 (R) | (L) 6-9-10 (R) | |
|---|---|---|---|---|---|
| 1 | S | S S | S S | S S | 1 |
| 2 | S | S S | S S | S S | 2 |
| 3 | S | S S | S S | S S | 3 |
| 4 | S | S S | S S | S S | 4 |
| 5 | S | S S | S S | S S | 5 |
| 6 | S | S S | S S | S S | 6 |
| 7 | S | S S | S S | S S | 7 |
| 8 | S | S S | S S | S S | 8 |
| 9 | S | S S | S S | S S | 9 |
| 10 | S | S RP5 | S S | S S | 10 |
| 11 | S | S RP5 | RP5 S | S S | 11 |
| 12 | S | RP5 RP6 | RP6 RP5 | S S | 12 |
| 13 | S | RP6 RP7 | RP7 RP5 | S RP5 | 13 |
| 14 | RP5 | RP7 2 | 2 RP6 | RP5 RP6 | 14 |
| 15 | RP5 | 2 2 | 2 2 | RP6 RP7 | 15 |

FIG. 11B.

FIG. 11C.

FIG. 12C.

| |
|---|
| FIG. 11A |
| FIG. 11B |

| |
|---|
| FIG. 12A |
| FIG. 12B |

FIG. 12 A.

A–2 SPARE BOARD A–2

FOUR-PIN SPARES

| | 1-2-3-4 | | 1-2-3-6 | | 1-2-3-8 | 1-2-3-9 | 1-2-4-5 | 1-2-4-7 | | 1-2-4-8 | | 1-2-4-9 | | 1-2-5-8 | | 1-2-5-9 | | 1-2-8-9 | | 1-3-5-6 | 1-3-5-8 | | 1-3-5-9 | | 1-3-6-8 | | 1-3-6-9 | | |
|---|---|---|---|---|---|---|---|---|---|---|---|---|---|---|---|---|---|---|---|---|---|---|---|---|---|---|---|---|---|
| 1 | S | S | S | S | S | S | S | S | S | S | S | S | S | S | S | S | S | S | S | S | S | S | S | S | S | S | S | S | 1 |
| 2 | S | S | S | S | S | S | S | S | S | S | S | S | S | S | S | S | S | S | S | S | S | S | S | S | S | S | S | S | 2 |
| 3 | S | S | S | S | S | S | S | S | S | S | S | S | S | S | S | S | S | RP3 | S | S | S | S | S | S | S | S | S | S | 3 |
| 4 | S | S | S | S | S | S | S | S | S | S | S | S | S | S | S | S | S | RP4 | S | S | S | S | S | S | S | S | S | S | 4 |
| 5 | S | S | S | S | S | S | S | S | S | S | S | RP1 | S | S | S | S | S | RP4 | S | S | S | S | S | S | S | RP1 | S | S | 5 |
| 6 | S | S | S | S | S | S | S | S | S | S | S | RP2 | S | S | S | S | S | RP4 | RP3 | S | S | S | S | S | S | RP2 | S | S | 6 |
| 7 | S | S | S | S | S | S | S | S | S | S | S | RP2 | S | S | S | S | S | 3 | RP4 | S | S | S | S | S | S | RP2 | S | S | 7 |
| 8 | S | S | S | S | S | S | S | S | S | S | S | RP2 | RP1 | S | S | S | S | 3 | 3 | S | S | S | S | S | RP1 | RP2 | S | S | 8 |
| 9 | S | S | S | S | S | S | S | S | S | S | S | 3 | RP2 | S | S | S | S | 3 | 3 | S | S | S | S | S | RP2 | 3 | S | S | 9 |
| 10 | S | S | S | S | S | S | S | S | S | S | S | 3 | RP2 | S | S | S | S | 3 | 3 | S | S | S | S | S | RP2 | 3 | S | S | 10 |
| 11 | S | S | S | S | S | S | S | S | S | RP1 | S | 3 | RP2 | S | RP1 | S | RP1 | 2 | 3 | S | RP1 | S | RP1 | S | RP2 | 3 | S | RP1 | 11 |
| 12 | S | S | S | S | RP3 | RP3 | S | RP1 | S | RP1 | RP1 | 2 | 3 | RP1 | RP2 | RP1 | RP2 | 2 | 2 | S | RP2 | RP1 | RP2 | RP1 | 3 | 2 | RP1 | RP1 | 12 |
| 13 | RP1 | S | S | RP1 | RP3 | RP3 | S | RP1 | S | RP2 | RP2 | 2 | 3 | RP2 | RP1 | RP1 | RP1 | 2 | 2 | S | RP1 | RP1 | RP1 | RP1 | 3 | 2 | RP2 | RP2 | 13 |
| 14 | RP1 | RP1 | RP1 | RP1 | RP3 | RP3 | RP1 | RP1 | RP1 | 3 | RP2 | 2 | 2 | RP1 | 3 | RP2 | 3 | 2 | 2 | RP1 | 3 | RP2 | 3 | RP2 | 2 | 2 | RP2 | 3 | 14 |
| 15 | RP2 | RP2 | RP2 | RP2 | 3 | 3 | RP2 | 3 | RP2 | 3 | 3 | 2 | 2 | 3 | 3 | 3 | 3 | 1 | 1 | RP2 | 3 | 3 | 3 | 3 | 2 | 2 | 3 | 3 | 15 |

FOUR-PIN SPARES

| | 1-3-6-10 | | 1-3-8-9 | | 2-4-5-7 | | 2-4-5-8 | 2-4-5-9 | | 2-4-7-8 | | 2-5-8-9 | 3-5-6-8 | | 3-5-6-9 | 3-5-6-10 | | 3-5-8-9 | 3-6-9-10 | | 4-5-7-8 | | 4-5-8-9 | 5-6-8-9 | 5-6-9-10 | | |
|---|---|---|---|---|---|---|---|---|---|---|---|---|---|---|---|---|---|---|---|---|---|---|---|---|---|---|---|
| 1 | S | S | S | S | S | S | S | S | S | S | S | S | S | S | S | S | S | S | S | S | S | S | S | S | S | S | 1 |
| 2 | S | S | S | S | S | S | S | S | S | S | S | S | S | S | S | S | S | S | S | S | S | S | S | S | S | S | 2 |
| 3 | S | S | S | RP3 | S | S | S | S | S | S | S | S | S | S | S | S | S | S | S | S | S | S | S | S | S | S | 3 |
| 4 | S | S | S | RP4 | S | S | S | S | S | S | S | S | S | S | S | S | S | S | S | S | S | S | S | S | S | S | 4 |
| 5 | S | S | S | RP4 | S | S | S | S | S | S | S | S | S | S | S | S | S | S | S | S | S | S | S | S | S | S | 5 |
| 6 | S | S | RP3 | RP4 | S | S | S | S | S | S | S | S | S | S | S | S | S | S | S | S | S | S | S | S | S | S | 6 |
| 7 | S | S | RP4 | 3 | S | S | S | S | S | S | S | S | S | S | S | S | S | S | S | S | S | S | S | S | S | S | 7 |
| 8 | S | S | 3 | 3 | S | S | S | S | S | S | S | S | S | S | S | S | S | S | S | S | S | S | S | S | S | S | 8 |
| 9 | S | S | 3 | 3 | S | S | S | S | S | S | S | S | S | S | S | S | S | S | S | S | S | S | S | S | S | S | 9 |
| 10 | S | S | 3 | 3 | S | S | S | S | S | S | S | S | S | S | S | S | S | S | S | S | S | S | S | S | S | S | 10 |
| 11 | S | S | 3 | 2 | S | S | S | S | S | S | S | S | S | S | S | S | S | S | S | S | RP1 | S | S | S | S | RP1 | 11 |
| 12 | S | RP1 | 2 | 2 | S | S | S | S | S | S | S | S | S | S | S | S | S | S | S | S | RP2 | S | S | S | S | RP2 | 12 |
| 13 | S | RP1 | 2 | 2 | RP1 | S | S | S | RP1 | RP1 | S | S | RP1 | S | S | S | RP1 | S | S | RP1 | RP1 | S | S | S | S | RP1 | 13 |
| 14 | RP1 | RP1 | 2 | 2 | RP1 | RP1 | RP1 | RP1 | RP1 | RP2 | RP1 | RP1 | RP1 | RP1 | RP1 | RP1 | RP1 | RP1 | RP1 | RP2 | RP3 | RP1 | RP1 | RP1 | RP1 | RP3 | 14 |
| 15 | RP2 | 3 | 1 | 1 | RP2 | RP2 | RP2 | RP2 | RP2 | 3 | RP2 | RP2 | RP2 | RP2 | RP2 | RP2 | RP2 | RP2 | RP2 | 3 | RP4 | RP2 | RP2 | RP2 | RP2 | RP4 | 15 |

FIG. 12B.

FIVE-PIN SPARES

| | 1-2-3-4-5 | 1-2-3-4-6 | 1-2-3-4-7 | 1-2-3-4-8 | 1-2-3-4-9 | 1-2-3-5-6 | 1-2-3-5-8 | 1-2-3-5-9 | 1-2-3-6-8 |
|---|---|---|---|---|---|---|---|---|---|
| 1 | S | S | S S | S S | S S | S | S S | S S | S S |
| 2 | S | S | S S | S S | S S | S | S S | S S | S S |
| 3 | S | S | S S | S S | S S | S | S S | S S | S S |
| 4 | S | S | S S | S S | S S | S | S S | S S | S S |
| 5 | S | S | S S | S S | S S | S | S S | S S | S S |
| 6 | S | S | S S | S S | S S | S | S S | S S | S S |
| 7 | S | S | S S | S S | S S | S | S S | S S | S S |
| 8 | S | S | S S | S S | S S | S | S S | S S | S S |
| 9 | S | S | S S | S S | S S | S | S S | S S | S S |
| 10 | S | S | S S | S S | RP5 S | S | S S | S S | S RP5 |
| 11 | S | S | S S | S RP5 | RP6 S | S | S S | S S | S RP6 |
| 12 | S | S | RP5 S | S RP6 | RP7 RP5 | S | S S | S S | RP5 RP7 |
| 13 | S | RP5 | RP5 S | RP5 RP6 | 4 RP6 | S | S RP5 | RP5 S | RP6 4 |
| 14 | RP5 | RP6 | RP6 RP5 | RP6 4 | 4 4 | RP5 | RP5 RP5 | RP5 RP5 | 4 4 |
| 15 | RP6 | 4 | 4 RP6 | 4 3 | 4 4 | RP6 | RP6 RP6 | RP6 RP6 | 4 4 |

FIVE-PIN SPARES

| | 1-2-3-6-9 | 1-2-3-6-10 | 1-2-3-8-9 | 2-4-5-7-8 | 2-4-5-7-9 | 3-5-6-8-10 | 3-5-6-9-10 | 4-5-7-8-9 | 5-6-8-9-10 |
|---|---|---|---|---|---|---|---|---|---|
| 1 | S S | S S | S | S S | S S | S S | S S | S S | S S |
| 2 | S S | S S | S | S S | S S | S S | S S | S S | S S |
| 3 | S S | S S | S | S S | S S | S S | S S | S S | S S |
| 4 | S S | S S | S | S S | S S | S S | S S | S S | S S |
| 5 | S S | S S | S | S S | S S | S S | S S | S S | S S |
| 6 | S S | S S | S | S S | S S | S S | S S | S S | S S |
| 7 | S S | S S | S | S S | S S | S S | S S | S S | S S |
| 8 | S S | S S | S | S S | S S | S S | S S | S S | S S |
| 9 | S S | S S | S | S S | S S | S S | S S | S S | S S |
| 10 | S S | S S | RP5 | S S | S S | S S | S S | S S | S S |
| 11 | RP5 S | S S | RP5 | S S | RP5 S | S RP5 | S S | RP5 S | S RP5 |
| 12 | RP6 S | S RP5 | RP6 | RP5 S | RP5 S | S RP5 | S RP5 | RP5 S | S RP5 |
| 13 | RP6 RP5 | S RP5 | RP6 | RP5 S | RP5 RP5 | RP5 RP5 | S RP5 | RP5 S | S RP5 |
| 14 | 4 RP6 | RP5 RP6 | RP7 | RP6 RP5 | RP6 RP5 | RP5 RP6 | RP5 RP6 | RP6 RP5 | RP5 RP6 |
| 15 | 3 4 | RP6 4 | 4 | RP6 RP6 | RP6 RP6 | RP6 RP6 | RP6 RP6 | RP6 RP6 | RP6 RP6 |

EIGHT-PIN SPARES

| | 1-2-3-4-5-6-7-8 | 1-2-3-4-5-6-9-10 | 1-2-3-4-5-7-8-9 | 1-2-3-5-6-8-9-10 | |
|---|---|---|---|---|---|
| 1 | S | S | S S | S S | 1 |
| 2 | S | S | S S | S S | 2 |
| 3 | S | S | S S | S S | 3 |
| 4 | S | S | S S | S S | 4 |
| 5 | S | S | S S | S S | 5 |
| 6 | S | S | S S | S S | 6 |
| 7 | S | S | S S | S S | 7 |
| 8 | S | S | S S | S S | 8 |
| 9 | S | S | S S | S S | 9 |
| 10 | S | S | S S | S S | 10 |
| 11 | S | S | S S | S S | 11 |
| 12 | RP8 | RP8 | RP8 S | S RP8 | 12 |
| 13 | RP8 | RP8 | RP8 RP8 | RP8 RP8 | 13 |
| 14 | RP8 | RP8 | RP8 RP8 | RP8 RP8 | 14 |
| 15 | RP8 | RP8 | RP9 RP8 | RP8 RP9 | 15 |

NINE-PIN SPARES

| | 1-2-3-4-5-6-7-8-9 | 1-2-3-4-5-6-8-9-10 | |
|---|---|---|---|
| 1 | S | S | 1 |
| 2 | S | S | 2 |
| 3 | S | S | 3 |
| 4 | S | S | 4 |
| 5 | S | S | 5 |
| 6 | S | S | 6 |
| 7 | S | S | 7 |
| 8 | S | S | 8 |
| 9 | S | S | 9 |
| 10 | S | S | 10 |
| 11 | S | S | 11 |
| 12 | RP8 | RP8 | 12 |
| 13 | RP8 | RP8 | 13 |
| 14 | RP8 | RP8 | 14 |
| 15 | RP8 | RP8 | 15 |

RP COLUMNS

| | 1 | 2 | 3 | 4 | 5 | |
|---|---|---|---|---|---|---|
| 1 | S | S | S | S | S | 1 |
| 2 | S | S | S | S | S | 2 |
| 3 | S | S | S | S | S | 3 |
| 4 | S | S | S | S | S | 4 |
| 5 | S | S | S | 3 | S | 5 |
| 6 | S | S | S | 3 | S | 6 |
| 7 | S | S | S | 3 | S | 7 |
| 8 | S | S | 3 | 2 | S | 8 |
| 9 | S | 3 | 3 | 2 | S | 9 |
| 10 | S | 3 | 2 | 2 | 4 | 10 |
| 11 | 3 | 2 | 2 | 1 | 3 | 11 |
| 12 | 2 | 2 | 1 | 1 | 2 | 12 |
| 13 | 1 | 1 | 1 | 1 | 1 | 13 |
| 14 | RP3 | RP3 | 0 | 0 | RP7 | 14 |
| 15 | RP3 | RP3 | 0 | 0 | RP7 | 15 |

RP COLUMNS

| | 6 | 7 | 8 | 9 | 10 | |
|---|---|---|---|---|---|---|
| 1 | S | S | S | S | S | 1 |
| 2 | S | S | S | S | S | 2 |
| 3 | S | S | S | S | S | 3 |
| 4 | S | S | S | S | S | 4 |
| 5 | S | S | S | S | S | 5 |
| 6 | S | 4 | S | S | 7 | 6 |
| 7 | S | 4 | S | S | 7 | 7 |
| 8 | 4 | 3 | S | 7 | 6 | 8 |
| 9 | 3 | 3 | S | 6 | 5 | 9 |
| 10 | 3 | 2 | 7 | 6 | 4 | 10 |
| 11 | 2 | 2 | 6 | 5 | 3 | 11 |
| 12 | 2 | 2 | RP9 | 5 | 2 | 12 |
| 13 | 1 | 1 | RP9 | 4 | 1 | 13 |
| 14 | RP7 | 0 | RP9 | RP10 | 0 | 14 |
| 15 | RP7 | 0 | RP9 | RP10 | 0 | 15 |

B–1 SPARE BOARD B–1

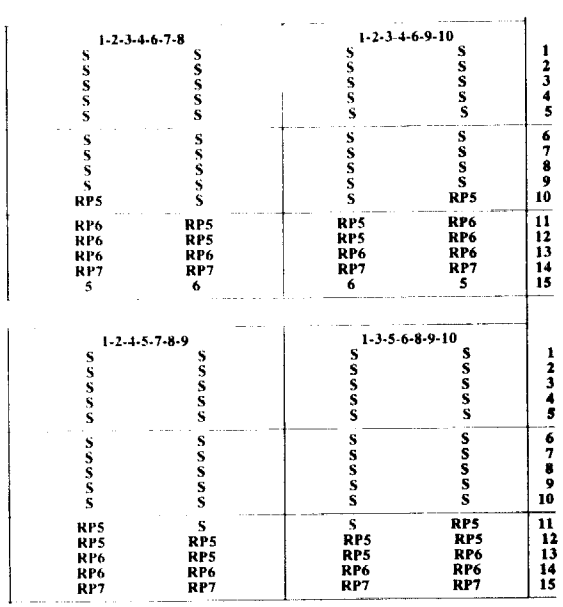
FIG. 13B.
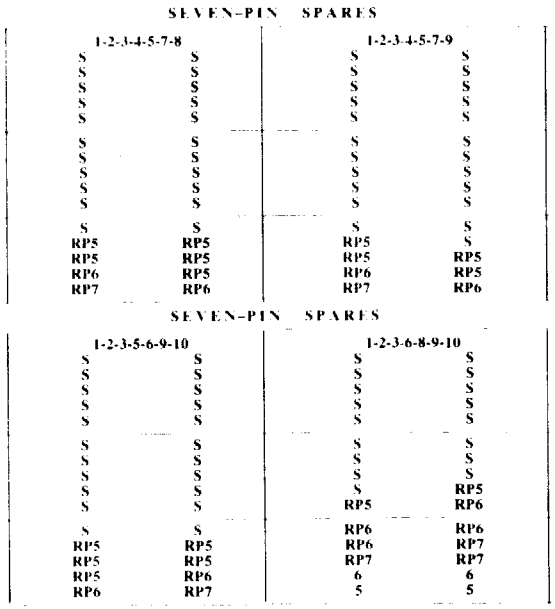
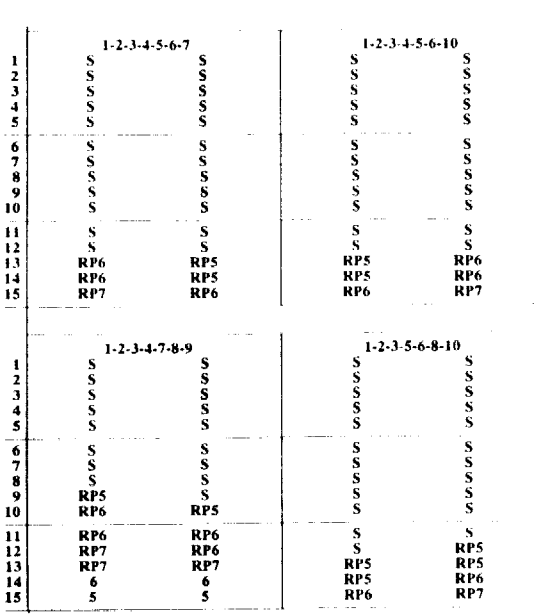
FIG. 13C.
| FIG. 13A |
|---|
| FIG. 13B |

B–2 SPARE BOARD B–2

RARE • TWO-PIN SPARES • RARE

| | 1-5 | 1-8 | 1-9 | 2-5 | 3-5 | |
|---|---|---|---|---|---|---|
| 1 | S | S | S | S | S | 1 |
| 2 | S | S | S | S | S | 2 |
| 3 | S | S | S | S | S | 3 |
| 4 | S | S | S | S | S | 4 |
| 5 | S | S | S | S | S | 5 |
| 6 | S | S | S | S | S | 6 |
| 7 | S | S | S | S | S | 7 |
| 8 | S | S | S | S | S | 8 |
| 9 | S | S | S | S | S | 9 |
| 10 | S | S | S | S | S | 10 |
| 11 | S | RP3 | RP3 | S | S | 11 |
| 12 | RP2 | RP4 | RP4 | S | S | 12 |
| 13 | RP2 | 1 | 1 | RP1 | RP1 | 13 |
| 14 | 1 | 1 | 1 | RP1 | RP1 | 14 |
| 15 | 1 | 1 | 1 | RP2 | RP2 | 15 |

RARE • FOUR-PIN SPARES • RARE

| | 1-2-3-5 | 1-2-5-6 | | 1-3-4-5 | | |
|---|---|---|---|---|---|---|
| 1 | S | S | S | S | S | 1 |
| 2 | S | S | S | S | S | 2 |
| 3 | S | S | S | S | S | 3 |
| 4 | S | S | RP8 | RP8 | S | 4 |
| 5 | S | S | RP8 | RP8 | S | 5 |
| 6 | S | S | RP8 | RP8 | S | 6 |
| 7 | S | RP8 | RP8 | RP8 | RP8 | 7 |
| 8 | S | RP8 | RP8 | RP8 | RP8 | 8 |
| 9 | S | RP8 | RP8 | RP8 | RP8 | 9 |
| 10 | S | RP8 | RP8 | RP8 | RP8 | 10 |
| 11 | S | RP8 | RP8 | RP8 | RP8 | 11 |
| 12 | S | RP8 | RP8 | RP8 | RP8 | 12 |
| 13 | RP8 | RP8 | RP9 | RP9 | RP8 | 13 |
| 14 | RP8 | RP9 | RP9 | RP9 | RP9 | 14 |
| 15 | RP9 | RP9 | RP9 | RP9 | RP9 | 15 |

RP COLUMNS

| | RP1 | RP2 | RP3 | RP4 | RP5 | RP6 | RP7 | RP8 | RP9 | |
|---|---|---|---|---|---|---|---|---|---|---|
| 1 | S | S | S | S | S | S | S | S | S | 1 |
| 2 | S | S | S | S | S | S | S | S | S | 2 |
| 3 | S | S | S | S | S | S | S | S | S | 3 |
| 4 | S | S | S | S | S | S | S | S | S | 4 |
| 5 | S | S | S | S | S | S | S | S | S | 5 |
| 6 | S | S | S | S | S | S | S | S | S | 6 |
| 7 | S | S | S | 1 | S | S | 2 | S | S | 7 |
| 8 | S | S | 1 | 1 | S | S | 2 | S | S | 8 |
| 9 | S | 1 | 1 | 1 | S | 2 | 2 | S | S | 9 |
| 10 | S | 1 | 1 | 1 | S | 2 | 1 | S | 3 | 10 |
| 11 | 1 | 1 | 1 | 1 | 2 | 2 | 1 | S | 3 | 11 |
| 12 | 1 | 1 | 1 | 1 | 2 | 1 | 1 | 3 | 2 | 12 |
| 13 | 1 | 1 | 1 | 1 | 2 | 1 | 0 | 2 | 2 | 13 |
| 14 | 1 | 0 | 1 | 0 | 1 | 0 | 0 | 1 | 1 | 14 |
| 15 | 0 | 0 | 0 | 0 | 0 | 0 | 0 | 0 | 0 | 15 |

RARE • THREE-PIN SPARES • RARE

| | 1-2-3 | 1-4-5 | | 1-4-6 | 1-5-6 | | 2-5-8 | 2-5-9 | | 3-5-8 | | 3-5-9 | 5-7-8 | | 5-8-9 | 5-9-10 | | 7-8-9 | | 8-9-10 | | |
|---|---|---|---|---|---|---|---|---|---|---|---|---|---|---|---|---|---|---|---|---|---|---|
| 1 | S | S | S | S | S | S | S | S | S | S | S | S | S | S | S | S | S | S | S | S | S | 1 |
| 2 | S | S | S | S | S | S | S | S | S | S | S | S | S | S | S | S | S | S | S | S | S | 2 |
| 3 | S | S | S | 2 | S | S | S | S | S | S | S | S | S | S | S | S | S | S | S | S | S | 3 |
| 4 | S | S | S | 2 | S | S | S | S | S | S | S | S | S | S | S | S | S | S | S | S | S | 4 |
| 5 | S | S | S | 2 | S | S | S | S | S | S | S | S | S | S | S | S | S | S | S | S | S | 5 |
| 6 | S | S | S | 2 | S | S | S | S | S | S | S | S | S | S | S | S | S | S | S | S | S | 6 |
| 7 | S | S | S | 1 | S | S | S | S | S | S | S | S | S | S | S | S | S | S | S | S | S | 7 |
| 8 | S | S | S | 1 | S | S | S | S | S | S | S | S | S | S | S | S | S | S | S | S | S | 8 |
| 9 | S | S | S | 1 | S | S | S | S | S | S | S | S | S | S | S | S | S | RP6 | S | S | RP6 | 9 |
| 10 | S | S | S | 1 | S | S | S | S | S | S | S | S | S | S | S | S | S | RP7 | RP6 | RP6 | RP7 | 10 |
| 11 | S | RP5 | S | 1 | S | RP5 | S | S | RP5 | RP5 | S | S | RP5 | S | S | S | RP5 | RP7 | RP6 | RP6 | RP7 | 11 |
| 12 | S | RP5 | RP5 | 1 | RP5 | RP5 | RP5 | RP5 | RP5 | RP5 | RP5 | RP5 | RP5 | RP5 | S | RP5 | RP5 | 2 | RP7 | RP7 | 2 | 12 |
| 13 | S | RP5 | RP5 | 1 | RP5 | RP5 | RP5 | RP5 | RP6 | RP6 | RP5 | RP5 | RP6 | RP5 | RP5 | RP5 | RP6 | 2 | 2 | 2 | 2 | 13 |
| 14 | RP5 | RP6 | RP5 | 0 | RP5 | RP6 | RP5 | RP6 | RP6 | RP6 | RP6 | RP5 | RP6 | RP6 | RP5 | RP6 | RP6 | 1 | 1 | 1 | 1 | 14 |
| 15 | RP6 | RP6 | RP6 | 0 | RP6 | RP6 | RP6 | RP6 | 2 | 2 | RP6 | RP6 | 2 | 2 | RP6 | 2 | 2 | 0 | 0 | 0 | 0 | 15 |

RP COLUMNS

| | RP10 | RP11 | RP12 | RP13 | RP14 | RP15 | RP16 | |
|---|---|---|---|---|---|---|---|---|
| 1 | S | S | S | S | S | S | S | 1 |
| 2 | S | S | S | S | S | S | S | 2 |
| 3 | S | S | S | S | S | S | S | 3 |
| 4 | S | S | S | S | S | S | 5 | 4 |
| 5 | S | S | S | S | S | 5 | 4 | 5 |
| 6 | S | S | S | S | 5 | 4 | 4 | 6 |
| 7 | S | S | 5 | S | 4 | 4 | 4 | 7 |
| 8 | S | 5 | 5 | S | 4 | 4 | 3 | 8 |
| 9 | 5 | 5 | 4 | S | 4 | 3 | 3 | 9 |
| 10 | 5 | 4 | 4 | 5 | 3 | 3 | 2 | 10 |
| 11 | 4 | 4 | 3 | 4 | 3 | 3 | 2 | 11 |
| 12 | 4 | 3 | 3 | 3 | 3 | 2 | 1 | 12 |
| 13 | 3 | 3 | 3 | 2 | 2 | 2 | 1 | 13 |
| 14 | 3 | 3 | 2 | 1 | 1 | 1 | 1 | 14 |
| 15 | 2 | 2 | 1 | 0 | 1 | 1 | 0 | 15 |

FIG. 14A.

SIX-PIN SPLITS

| | 1-2-4-7-8-10 | | 1-2-4-7-9-10 | 1-2-6-7-8-10 | 1-2-6-7-9-10 | 1-3-4-6-7-8 | 1-3-4-6-7-9 | 1-3-4-6-7-10 | | 1-3-4-6-8-10 | | 1-3-4-6-9-10 | | 1-3-4-7-8-10 | |
|---|---|---|---|---|---|---|---|---|---|---|---|---|---|---|---|
| 1 | S | S | S | S | S | S | S | S | S | S | S | S | S | S | 1 |
| 2 | S | S | S | S | S | S | S | S | S | S | S | S | S | S | 2 |
| 3 | S | RP12 | S | S | S | S | S | S | S | S | S | S | S | S | 3 |
| 4 | RP12 | RP14 | S | S | S | S | S | S | S | S | S | S | S | S | 4 |
| 5 | RP14 | RP15 | S | S | S | S | S | S | S | S | S | S | S | S | 5 |
| 6 | RP15 | RP15 | S | S | RP10 | S | S | S | S | S | S | S | S | RP10 | 6 |
| 7 | RP15 | 5 | RP10 | S | RP11 | S | S | S | S | S | S | S | S | RP11 | 7 |
| 8 | 5 | 5 | RP11 | RP10 | RP12 | S | S | RP10 | S | RP10 | S | RP10 | S | RP12 | 8 |
| 9 | 5 | 5 | RP12 | RP11 | 5 | S | RP10 | RP10 | RP10 | RP10 | RP10 | RP10 | RP10 | 5 | 9 |
| 10 | 5 | 4 | 5 | RP12 | 4 | S | RP11 | RP10 | RP10 | RP10 | RP10 | RP10 | RP10 | 4 | 10 |
| 11 | 4 | 3 | 5 | 5 | 4 | S | 5 | RP10 | RP10 | RP10 | RP10 | RP10 | RP10 | 4 | 11 |
| 12 | 3 | 2 | 4 | 4 | 3 | RP10 | 4 | RP11 | RP10 | RP11 | RP10 | RP11 | RP10 | 3 | 12 |
| 13 | RP16 | RP16 | 3 | 3 | 3 | RP10 | 4 | RP11 | RP11 | RP11 | RP11 | RP11 | RP11 | 3 | 13 |
| 14 | 2 | 1 | RP13 | RP13 | RP13 | RP11 | RP13 | RP12 | RP11 | RP12 | RP11 | RP12 | RP11 | RP13 | 14 |
| 15 | 1 | 1 | 2 | 2 | 2 | RP13 | 3 | RP13 | RP13 | RP13 | RP13 | RP13 | RP13 | 2 | 15 |

FIG. 14B.

SIX-PIN SPLITS

| | 1-3-4-7-9-10 | 1-3-5-6-7-10 | | 1-3-6-7-8-10 | 1-3-6-7-9-10 | | 2-4-5-7-8-10 | | 2-4-6-7-8-10 | | 2-4-6-7-9-10 | | 3-4-6-7-8-10 | | 3-4-6-7-9-10 | | 3-5-6-7-9-10 | | |
|---|---|---|---|---|---|---|---|---|---|---|---|---|---|---|---|---|---|---|---|
| 1 | S | S | S | S | S | S | S | S | S | S | S | S | S | S | S | S | S | S | 1 |
| 2 | S | S | S | S | S | S | S | S | S | S | S | S | S | S | S | S | S | S | 2 |
| 3 | S | S | S | S | RP12 | S | S | S | S | S | S | S | S | S | S | S | S | S | 3 |
| 4 | S | S | S | S | RP14 | RP12 | S | S | S | RP12 | S | RP12 | RP12 | S | RP12 | S | S | S | 4 |
| 5 | S | S | S | S | RP15 | RP14 | S | S | RP12 | RP14 | RP12 | RP14 | RP14 | RP12 | RP14 | RP12 | S | S | 5 |
| 6 | S | S | RP12 | S | RP15 | RP15 | S | S | RP14 | RP15 | RP14 | RP15 | RP15 | RP14 | RP15 | RP14 | S | S | 6 |
| 7 | S | RP11 | RP12 | RP10 | 5 | RP15 | S | S | RP15 | RP15 | RP15 | RP15 | RP15 | RP15 | RP15 | RP15 | S | S | 7 |
| 8 | RP10 | RP11 | RP12 | RP11 | 5 | 5 | S | S | RP15 | 5 | RP15 | 5 | 5 | RP15 | 5 | RP15 | S | S | 8 |
| 9 | RP11 | RP12 | RP14 | RP12 | 5 | 5 | S | RP11 | 5 | 4 | 5 | 4 | 4 | 5 | 4 | 5 | RP11 | S | 9 |
| 10 | RP12 | RP12 | RP14 | 5 | 4 | 5 | RP11 | RP12 | 4 | 4 | 4 | 4 | 4 | 4 | 4 | 4 | RP12 | RP11 | 10 |
| 11 | 5 | RP14 | RP15 | 5 | 3 | 4 | RP12 | 5 | 4 | 4 | 4 | 3 | 3 | 4 | 4 | 4 | 5 | RP12 | 11 |
| 12 | 4 | RP15 | RP16 | 4 | 2 | 3 | 5 | 5 | 4 | 3 | 3 | 3 | 3 | 3 | 3 | 4 | 5 | 5 | 12 |
| 13 | RP13 | RP16 | 5 | RP13 | 1 | 2 | 5 | 4 | 3 | 2 | 3 | 2 | 2 | 3 | 2 | 3 | 4 | 5 | 13 |
| 14 | 3 | 5 | 4 | 3 | RP16 | 1 | RP13 | RP13 | RP16 | RP16 | RP16 | RP16 | RP16 | RP16 | RP16 | RP16 | 3 | 4 | 14 |
| 15 | 2 | 4 | 3 | 2 | 1 | RP16 | 4 | 3 | 2 | 2 | 2 | 2 | 2 | 2 | 2 | 2 | RP13 | RP13 | 15 |

FIG. 14C.

| |
|---|
| FIG. 14A |
| FIG. 14B |

FIG. 15A.

S–1 SPLIT BOARD S–1

TWO-PIN SPLITS

| | 1-4 | 1-6 | 1-7 | 1-10 | 2-6 | 2-7 | 2-9 | 2-10 | 3-4 | 3-7 | 3-8 | 3-10 | 4-6 | 4-9 | 4-10 | 5-7 | 5-10 | 6-7 | 6-8 | 7-9 | 7-10 | 8-10 | |
|---|---|---|---|---|---|---|---|---|---|---|---|---|---|---|---|---|---|---|---|---|---|---|---|
| 1 | S | S | S | S | S S | S S | S S | S S | S S | S S | S S | S S | RP6 | S S | S S | S S | S S | S S | S S | RP6 RP6 | RP7 | RP6 RP6 | 1 |
| 2 | S | S | S | S | S S | S S | S S | S S | S S | S S | S S | S S | RP7 | S S | S S | S S | S S | S S | S S | RP7 RP6 | 1 | RP6 RP7 | 2 |
| 3 | S | S | S | S | S S | S S | S S | S S | S S | S S | S S | S S | RP7 | S S | S RP4 | S S | S S | RP4 S | S S | 1 RP7 | 1 | RP7 1 | 3 |
| 4 | S | S | S | S | S S | S S | S S | S S | S S | S S | S S | S S | 1 | S RP4 | RP4 RP5 | S S | S S | RP5 RP4 | RP4 S | 1 1 | 1 | 1 1 | 4 |
| 5 | S | S | S | S | S RP4 | S S | S S | S RP4 | RP4 S | RP4 S | S S | S S | 1 | RP4 RP5 | RP5 RP5 | S S | S S | RP5 RP5 | RP5 RP4 | 1 1 | 1 | 1 1 | 5 |
| 6 | S | S | S | S | RP4 RP5 | S S | S S | RP4 RP5 | RP5 RP4 | RP5 RP4 | S S | S S | 1 | RP5 RP5 | RP5 1 | RP2 S | S RP2 | 1 RP5 | RP5 RP5 | 1 1 | 0 | 1 1 | 6 |
| 7 | S | S | RP3 | RP3 | RP5 RP5 | S S | S S | RP5 RP5 | RP5 RP5 | RP5 RP5 | S S | S S | 1 | RP5 RP5 | 1 1 | RP3 RP2 | RP2 RP3 | 1 1 | RP5 RP5 | 1 1 | 0 | 1 1 | 7 |
| 8 | S | S | RP3 | RP3 | RP5 RP5 | S S | S S | RP5 1 | RP5 RP5 | 1 RP5 | S S | S S | 1 | RP5 1 | 1 1 | RP4 RP3 | RP3 RP4 | 1 1 | 1 RP5 | 1 1 | 0 | 1 1 | 8 |
| 9 | S | S | RP4 | RP4 | RP5 1 | RP2 S | S RP1 | 1 1 | 1 RP5 | 1 1 | RP1 S | S RP2 | 0 | 1 1 | 1 1 | RP5 RP4 | RP4 RP5 | 1 1 | 1 1 | 1 1 | 0 | 1 1 | 9 |
| 10 | RP1 | RP1 | 1 | 1 | 1 1 | RP2 RP2 | RP1 RP1 | 1 1 | 1 1 | 1 1 | RP1 RP1 | RP2 RP2 | 0 | 1 1 | 1 1 | 1 RP5 | RP5 1 | 1 1 | 1 1 | 0 1 | 0 | 1 0 | 10 |
| 11 | RP1 | RP1 | 1 | 1 | 1 1 | RP2 RP2 | RP1 RP1 | 1 1 | 1 1 | 1 1 | RP1 RP1 | RP2 RP2 | 0 | 1 1 | 1 1 | 1 1 | 1 1 | 1 1 | 1 1 | 0 0 | 0 | 0 0 | 11 |
| 12 | RP1 | RP1 | 1 | 1 | 1 1 | RP2 RP2 | RP1 RP2 | 1 1 | 1 1 | 1 1 | RP2 RP1 | RP2 RP2 | 0 | 1 1 | 1 1 | 1 1 | 1 1 | 1 1 | 1 1 | 0 0 | 0 | 0 0 | 12 |
| 13 | RP2 | RP2 | 1 | 1 | 1 1 | RP3 RP2 | RP2 RP2 | 1 1 | 1 1 | 1 1 | RP2 RP2 | RP2 RP3 | 0 | 1 1 | 1 1 | 1 1 | 1 1 | 1 1 | 1 1 | 0 0 | 0 | 0 0 | 13 |
| 14 | RP2 | RP2 | 0 | 0 | 1 0 | RP3 RP3 | RP2 1 | 1 0 | 0 1 | 0 1 | 1 RP2 | RP3 RP3 | 0 | 1 0 | 1 0 | 0 1 | 1 0 | 0 1 | 0 1 | 0 0 | 0 | 0 0 | 14 |
| 15 | 1 | 1 | 0 | 0 | 0 0 | 1 1 | 1 1 | 0 0 | 0 0 | 0 0 | 1 1 | 1 1 | 0 | 0 0 | 0 0 | 0 0 | 0 0 | 0 0 | 0 0 | 0 0 | 0 | 0 0 | 15 |

THREE-PIN SPLITS

| | 1-2-6 | 1-2-7 | 1-2-8 | 1-2-9 | 1-2-10 | 1-3-4 | 1-3-7 | 1-3-8 | 1-3-9 | 1-3-10 | 1-4-7 | 1-4-8 | 1-4-9 | 1-4-10 | 1-5-7 | 1-5-10 | | RP COLUMNS 1 | 2 | 3 | 4 | 5 | 6 | 7 | |
|---|---|---|---|---|---|---|---|---|---|---|---|---|---|---|---|---|---|---|---|---|---|---|---|---|---|
| 1 | S S | S S | S S | S | S S | S S | S S | S | S S | S S | S S | S S | S | S | S | S | 1 | S | S | S | S | S | S | S | 1 |
| 2 | S S | S S | S S | S | S S | S S | S S | S | S S | S S | S S | S S | S | S | S | S | 2 | S | S | S | S | S | S | 1 | 2 |
| 3 | S S | S S | S S | S | S S | S S | S S | S | S S | S S | S S | S S | S | S | S | S | 3 | S | S | S | S | S | 1 | 1 | 3 |
| 4 | S S | S S | S S | S | S S | S S | S S | S | S S | S S | S S | S S | S | S | S | S | 4 | S | S | S | S | 1 | 1 | 1 | 4 |
| 5 | S S | S S | S S | S | S S | S S | S S | S | S S | S S | S S | S S | S | RP9 | S | S | 5 | S | S | S | S | 1 | 1 | 1 | 5 |
| 6 | S S | S S | S S | S | S S | S S | S S | S | S S | S S | S S | S S | RP8 | RP10 | RP8 | RP8 | 6 | S | S | S | 1 | 1 | 1 | 0 | 6 |
| 7 | S S | S S | S S | S | S RP9 | S S | RP9 S | S | S S | S S | S S | S S | RP8 | RP10 | RP8 | RP9 | 7 | S | S | 1 | 1 | 1 | 0 | 0 | 7 |
| 8 | S S | S S | S S | S | RP8 RP9 | S S | RP9 RP8 | S | S S | S S | S S | RP8 S | RP9 | 2 | RP10 | RP10 | 8 | S | 1 | 1 | 1 | 1 | 0 | 0 | 8 |
| 9 | S S | S S | S S | RP8 | RP9 RP9 | S S | RP9 RP9 | RP8 | S S | S S | RP8 S | RP9 RP8 | RP9 | 2 | RP10 | RP10 | 9 | S | 1 | 1 | 1 | 1 | 0 | 0 | 9 |
| 10 | S S | S S | RP8 S | RP8 | RP9 RP10 | S S | RP10 RP9 | RP8 | S RP8 | S S | RP8 RP8 | RP9 RP9 | RP9 | 2 | 2 | 2 | 10 | 1 | 1 | 1 | 1 | 1 | 0 | 0 | 10 |
| 11 | S RP8 | RP8 S | RP9 RP8 | RP9 | RP9 RP10 | RP8 S | RP10 RP9 | RP9 | RP8 RP9 | S RP8 | RP8 RP8 | RP9 RP9 | RP9 | 2 | 2 | 2 | 11 | 1 | 1 | 1 | 1 | 1 | 0 | 0 | 11 |
| 12 | RP8 RP8 | RP9 RP8 | RP9 RP9 | RP9 | RP10 RP10 | RP8 RP8 | RP10 RP10 | RP9 | RP9 RP9 | RP8 RP9 | RP9 RP8 | 1 RP9 | RP10 | 2 | 2 | 2 | 12 | 1 | 1 | 1 | 1 | 1 | 0 | 0 | 12 |
| 13 | RP8 RP9 | RP9 RP9 | RP9 RP9 | 2 | RP10 2 | RP9 RP8 | 2 RP10 | 2 | RP9 RP9 | RP9 RP9 | RP9 RP9 | 1 1 | RP10 | 1 | 1 | 1 | 13 | 1 | 1 | 1 | 0 | 0 | 0 | 0 | 13 |
| 14 | RP9 2 | 2 RP9 | 2 RP9 | 2 | 2 2 | 2 RP9 | 2 2 | 2 | RP9 2 | RP9 2 | 1 RP9 | 2 1 | 2 | 1 | 1 | 1 | 14 | 1 | 1 | 0 | 0 | 0 | 0 | 0 | 14 |
| 15 | 2 1 | 1 2 | 1 2 | 1 | 2 2 | 1 2 | 2 2 | 1 | 2 1 | 2 1 | 2 1 | 2 2 | 1 | 0 | 1 | 1 | 15 | 1 | 0 | 0 | 0 | 0 | 0 | 0 | 15 |

THREE-PIN SPLITS

| | 1-6-7 | 1-6-8 | 1-6-9 | 1-6-10 | 1-7-8 | 1-7-9 | 1-7-10 | 1-8-10 | 1-9-10 | 2-4-6 | 2-4-9 | 2-4-10 | 2-5-7 | 2-5-10 | 2-6-7 | 2-6-8 | 2-6-9 | 2-6-10 | 2-7-8 | 2-7-9 | 2-7-10 | |
|---|---|---|---|---|---|---|---|---|---|---|---|---|---|---|---|---|---|---|---|---|---|---|
| 1 | S | S | S S | S S | S | S | RP10 | S | S | S S | S S | S S | S S | S S | S | S S | S S | S S | S | S | S | 1 |
| 2 | S | S | S S | S S | S | S | RP11 | S | S | S S | S S | S S | S S | S S | S | S S | S S | S S | S | S | RP12 | 2 |
| 3 | S | S | S S | S S | S | RP8 | RP11 | RP8 | S | S S | S S | S S | S S | S S | S | S RP10 | S S | S S | S | RP10 | RP13 | 3 |
| 4 | S | S | S S | S S | S | RP9 | RP12 | RP9 | S | S RP9 | S S | S S | S S | S S | S | S RP11 | S S | S S | S | RP10 | 2 | 4 |
| 5 | RP9 | S | S S | S S | S | RP9 | RP12 | RP9 | S | S RP9 | S S | S RP10 | S S | S S | RP10 | RP10 RP12 | S RP11 | S RP11 | S | RP11 | 2 | 5 |
| 6 | RP10 | RP8 | S S | S S | S | RP10 | 2 | RP10 | S | RP9 RP10 | S RP9 | S RP11 | S S | S S | RP10 | RP11 RP12 | RP11 RP12 | RP11 RP12 | S | RP11 | 2 | 6 |
| 7 | RP10 | RP8 | S S | S S | S | RP10 | 2 | RP10 | S | RP9 RP10 | S RP10 | RP10 RP11 | S S | S RP8 | RP11 | RP11 RP13 | RP12 RP13 | RP12 RP13 | S | RP12 | 2 | 7 |
| 8 | 2 | RP9 | S RP8 | S S | RP8 | RP10 | 2 | RP10 | RP8 | RP10 RP10 | RP9 RP10 | RP11 RP12 | RP9 S | S RP9 | RP11 | RP12 2 | RP12 RP13 | RP12 RP13 | S | RP12 | 2 | 8 |
| 9 | 2 | RP9 | RP8 RP9 | S RP8 | RP8 | 2 | 2 | 2 | RP8 | RP10 RP11 | RP9 RP11 | RP11 2 | RP9 RP9 | RP8 RP10 | RP12 | RP13 2 | RP13 2 | RP13 2 | S | 2 | 1 | 9 |
| 10 | 2 | RP9 | RP9 RP9 | RP8 RP8 | RP9 | 2 | 2 | 2 | RP9 | RP11 2 | RP10 RP11 | RP12 2 | RP9 RP9 | RP9 RP10 | 2 | 2 2 | 2 2 | 2 2 | RP8 | 2 | 1 | 10 |
| 11 | 2 | RP9 | RP9 RP9 | RP8 RP8 | RP9 | 2 | 2 | 2 | RP9 | 2 2 | RP10 2 | 2 2 | RP10 RP9 | RP10 2 | 2 | 2 1 | 2 1 | 2 1 | RP8 | 1 | 1 | 11 |
| 12 | 2 | RP10 | RP9 1 | RP8 RP9 | RP10 | 2 | 1 | 2 | RP10 | 2 2 | RP11 2 | 2 2 | RP10 RP10 | 2 2 | 1 | 1 1 | 2 1 | 1 1 | RP9 | 1 | 1 | 12 |
| 13 | 1 | RP10 | 1 1 | RP9 RP9 | 2 | 1 | 1 | 1 | 2 | 2 1 | 2 2 | 2 2 | RP11 RP10 | 2 1 | 1 | 1 0 | 1 1 | 1 1 | RP9 | 1 | 0 | 13 |
| 14 | 1 | 2 | 1 2 | RP9 1 | 2 | 1 | 1 | 1 | 2 | 1 1 | 2 1 | 2 1 | 2 2 | 1 1 | 1 | 0 0 | 1 0 | 1 0 | 2 | 1 | 0 | 14 |
| 15 | 0 | 1 | 2 2 | 1 2 | 1 | 1 | 0 | 1 | 1 | 1 0 | 1 1 | 1 1 | 1 1 | 1 0 | 0 | 0 0 | 0 0 | 0 0 | 1 | 0 | 0 | 15 |

FIG. 15B.

THREE-PIN SPLITS

| | 2-8-9 | 2-8-10 | | 2-9-10 | | 3-4-6 | | 3-4-7 | | 3-4-8 | | 3-4-9 | | 3-4-10 | | 3-5-7 | | 3-5-10 | | 3-6-7 | | 3-6-8 | | 3-7-8 | | 3-7-9 | | 3-7-10 | 3-8-9 | 3-8-10 | | RP COLUMNS 8 | 9 | 10 | 11 | 12 | 13 | |
|---|---|---|---|---|---|---|---|---|---|---|---|---|---|---|---|---|---|---|---|---|---|---|---|---|---|---|---|---|---|---|---|---|---|---|---|---|---|---|
| 1 | S | S | RP8 | S | S | S | S | S | S | S | S | S | S | S | | S | S | S | S | S | S | S | S | S | S | RP8 | S | S | S | S | 1 | S | S | S | S | S | S | 1 |
| 2 | S | RP8 | RP9 | S | S | S | S | S | S | S | S | S | S | S | | S | S | S | S | S | S | S | S | S | S | RP9 | RP8 | RP12 | S | S | 2 | S | S | S | S | S | 2 | 2 |
| 3 | S | RP9 | RP10 | S | RP8 | S | S | S | S | S | S | RP10 | S | S | | S | S | S | S | S | S | S | S | RP8 | S | RP10 | RP9 | RP13 | S | RP10 | 3 | S | S | S | S | 2 | 2 | 3 |
| 4 | S | RP10 | RP11 | S | RP8 | RP9 | S | S | S | S | S | RP11 | S | S | | S | S | S | S | S | S | S | S | RP8 | S | RP11 | RP10 | 2 | S | RP10 | 4 | S | S | S | S | 2 | 2 | 4 |
| 5 | S | RP11 | 2 | RP8 | RP9 | RP9 | S | RP11 | S | RP11 | S | RP12 | RP10 | RP10 | | S | S | S | S | RP10 | S | S | S | RP9 | RP8 | 2 | RP11 | 2 | S | RP11 | 5 | S | S | S | 2 | 2 | 1 | 5 |
| 6 | S | 2 | 2 | RP9 | RP10 | RP10 | RP9 | RP12 | RP11 | RP12 | RP11 | RP12 | RP11 | RP10 | | S | S | S | S | RP11 | S | RP9 | S | RP10 | RP9 | 2 | 2 | 2 | S | RP11 | 6 | S | S | 2 | 2 | 1 | 1 | 6 |
| 7 | S | 2 | 2 | RP10 | RP11 | RP10 | RP9 | RP13 | RP12 | RP13 | RP12 | RP13 | RP11 | RP11 | | RP8 | S | S | S | RP11 | RP10 | RP10 | S | RP11 | RP10 | 2 | 2 | 2 | S | RP12 | 7 | S | S | 2 | 2 | 1 | 1 | 7 |
| 8 | S | 2 | 2 | RP11 | RP12 | RP10 | RP10 | RP13 | RP12 | RP13 | RP12 | 2 | RP12 | RP11 | | RP9 | S | S | RP9 | RP12 | RP11 | RP10 | RP9 | RP12 | RP11 | 2 | 2 | 2 | S | RP12 | 8 | S | 2 | 2 | 1 | 1 | 1 | 8 |
| 9 | S | 2 | 2 | RP12 | RP13 | RP11 | RP10 | 2 | RP13 | 2 | RP13 | 2 | RP13 | RP12 | | RP10 | RP8 | RP9 | RP9 | 2 | RP11 | RP11 | RP9 | RP13 | RP12 | 2 | 2 | 1 | S | 2 | 9 | S | 2 | 2 | 1 | 1 | 1 | 9 |
| 10 | S | 2 | 1 | RP13 | 2 | 2 | RP11 | 2 | 2 | 2 | 2 | 2 | 2 | 2 | | RP10 | RP9 | RP9 | RP9 | 2 | RP12 | RP11 | RP10 | 2 | RP13 | 1 | 2 | 1 | S | 2 | 10 | 2 | 2 | 2 | 1 | 1 | 1 | 10 |
| 11 | RP8 | 1 | 1 | 2 | 2 | 2 | 2 | 1 | 2 | 1 | 2 | 1 | 2 | 2 | | 2 | RP10 | RP9 | RP10 | 2 | 2 | 2 | RP10 | 2 | 2 | 1 | 1 | 1 | RP8 | 1 | 11 | 2 | 2 | 2 | 1 | 1 | 0 | 11 |
| 12 | RP8 | 1 | 1 | 2 | 1 | 2 | 2 | 1 | 1 | 1 | 2 | 1 | 1 | 1 | | 2 | 2 | RP10 | RP10 | 2 | 2 | 2 | RP11 | 1 | 2 | 1 | 1 | 1 | RP8 | 1 | 12 | 2 | 2 | 1 | 1 | 0 | 0 | 12 |
| 13 | RP9 | 1 | 1 | 1 | 1 | 1 | 2 | 1 | 1 | 1 | 1 | 0 | 1 | 1 | | 1 | 2 | RP10 | RP11 | 2 | 2 | 2 | 2 | 1 | 1 | 1 | 1 | 0 | RP9 | 1 | 13 | 2 | 1 | 1 | 0 | 0 | 0 | 13 |
| 14 | 2 | 1 | 1 | 1 | 1 | 1 | 1 | 0 | 1 | 0 | 1 | 0 | 0 | 1 | | 1 | 1 | 2 | 2 | 1 | 2 | 1 | 2 | 1 | 1 | 1 | 1 | 0 | 2 | 1 | 14 | 1 | 1 | 0 | 0 | 0 | 0 | 14 |
| 15 | 1 | 1 | 0 | 1 | 0 | 0 | 1 | 0 | 0 | 0 | 0 | 0 | 0 | 0 | | 0 | 1 | 1 | 1 | 1 | 1 | 1 | 1 | 0 | 1 | 0 | 1 | 0 | 1 | 0 | 15 | 1 | 0 | 0 | 0 | 0 | 0 | 15 |

THREE-PIN SPLITS

| | 3-9-10 | 4-5-10 | | 4-6-7 | 4-6-8 | | 4-6-9 | | 4-6-10 | | 4-7-9 | | 4-7-10 | | 4-8-10 | | 4-9-10 | | 5-6-7 | | 5-7-9 | | 5-7-10 | 5-8-10 | | 6-7-8 | | 6-7-9 | | 6-7-10 | | 6-8-10 | | 7-8-10 | | 7-9-10 | | |
|---|---|---|---|---|---|---|---|---|---|---|---|---|---|---|---|---|---|---|---|---|---|---|---|---|---|---|---|---|---|---|---|---|---|---|---|---|---|---|
| 1 | S | S | S | RP12 | RP12 | RP11 | RP11 | RP12 | RP12 | | S | S | S | RP8 | RP12 | RP12 | S | S | S | S | S | S | S | S | S | S | S | RP12 | RP12 | RP8 | S | S | S | RP12 | RP12 | RP12 | RP12 | 1 |
| 2 | S | S | S | RP13 | RP13 | RP12 | RP12 | RP13 | RP13 | | S | RP8 | RP9 | RP9 | RP12 | RP13 | S | S | S | S | S | S | RP12 | S | S | S | S | RP13 | RP12 | RP9 | RP9 | RP8 | S | RP13 | RP12 | RP12 | RP13 | 2 |
| 3 | S | S | S | RP13 | 2 | RP13 | RP13 | 2 | RP13 | | S | RP9 | RP10 | RP10 | RP13 | 2 | S | RP11 | S | S | S | S | RP13 | S | S | RP11 | S | 2 | RP13 | RP10 | RP10 | RP9 | S | 2 | RP13 | RP13 | 2 | 3 |
| 4 | S | S | S | 2 | 2 | 2 | 2 | 2 | 2 | | RP8 | RP10 | RP11 | RP11 | 2 | 2 | RP11 | RP12 | S | S | S | S | 2 | S | S | RP12 | RP11 | 2 | 2 | RP11 | RP11 | RP10 | RP8 | 2 | 2 | 2 | 2 | 4 |
| 5 | S | S | RP8 | 2 | 2 | 2 | 2 | 2 | 2 | | RP9 | RP11 | RP12 | RP12 | 2 | 2 | RP12 | RP13 | RP8 | S | S | S | 2 | S | S | RP13 | RP12 | 2 | 2 | RP12 | RP12 | RP11 | RP9 | 2 | 2 | 2 | 2 | 5 |
| 6 | S | S | RP9 | 2 | 2 | 2 | 2 | 2 | 2 | | RP10 | RP12 | RP13 | 2 | 2 | 2 | RP12 | RP13 | RP9 | S | RP8 | S | 2 | S | RP8 | RP13 | RP12 | 2 | 2 | 2 | RP13 | RP12 | RP10 | 2 | 2 | 2 | 2 | 6 |
| 7 | S | RP9 | RP10 | 2 | 2 | 2 | 2 | 2 | 2 | | RP11 | RP13 | 2 | 2 | 2 | 2 | RP13 | 2 | RP10 | RP9 | RP9 | RP8 | 1 | RP8 | RP9 | 2 | RP13 | 2 | 2 | 2 | 2 | RP13 | RP11 | 2 | 2 | 2 | 2 | 7 |
| 8 | S | RP10 | RP11 | 2 | 1 | 2 | 2 | 1 | 2 | | RP12 | 2 | 2 | 2 | 2 | 1 | 2 | 2 | RP11 | RP10 | RP10 | RP9 | 1 | RP9 | RP10 | 2 | 2 | 1 | 2 | 2 | 2 | 2 | RP12 | 1 | 2 | 2 | 1 | 8 |
| 9 | S | RP11 | RP12 | 1 | 1 | 1 | 1 | 1 | 1 | | RP13 | 2 | 2 | 2 | 2 | 1 | 2 | 2 | RP12 | RP11 | RP11 | RP10 | 1 | RP10 | RP11 | 2 | 2 | 1 | 2 | 2 | 2 | 2 | RP13 | 1 | 2 | 2 | 1 | 9 |
| 10 | RP8 | RP12 | 2 | 1 | 1 | 1 | 1 | 1 | 1 | | 2 | 1 | 2 | 1 | 1 | 1 | 2 | 1 | 2 | RP12 | 2 | RP11 | 1 | RP11 | 2 | 1 | 2 | 1 | 1 | 1 | 2 | 1 | 2 | 1 | 1 | 1 | 1 | 10 |
| 11 | RP8 | 2 | 2 | 1 | 1 | 1 | 1 | 1 | 1 | | 2 | 1 | 1 | 1 | 1 | 0 | 1 | 1 | 2 | 2 | 2 | 2 | 0 | 2 | 2 | 1 | 1 | 0 | 1 | 1 | 1 | 1 | 2 | 0 | 1 | 1 | 0 | 11 |
| 12 | RP9 | 2 | 2 | 0 | 1 | 1 | 1 | 1 | 0 | | 2 | 1 | 1 | 1 | 1 | 0 | 1 | 1 | 2 | 2 | 2 | 2 | 0 | 2 | 2 | 1 | 1 | 0 | 1 | 1 | 1 | 1 | 2 | 0 | 0 | 0 | 0 | 12 |
| 13 | RP9 | 2 | 1 | 0 | 1 | 1 | 1 | 1 | 0 | | 1 | 1 | 1 | 1 | 0 | 0 | 1 | 0 | 1 | 2 | 1 | 2 | 0 | 2 | 1 | 0 | 1 | 0 | 0 | 1 | 1 | 1 | 1 | 0 | 0 | 0 | 0 | 13 |
| 14 | 2 | 1 | 1 | 0 | 0 | 1 | 1 | 0 | 0 | | 1 | 0 | 1 | 0 | 0 | 0 | 0 | 0 | 1 | 1 | 1 | 1 | 0 | 1 | 1 | 0 | 0 | 0 | 0 | 0 | 1 | 0 | 1 | 0 | 0 | 0 | 0 | 14 |
| 15 | 1 | 1 | 0 | 0 | 0 | 0 | 0 | 0 | 0 | | 0 | 0 | 0 | 0 | 0 | 0 | 0 | 0 | 0 | 1 | 0 | 1 | 0 | 1 | 0 | 0 | 0 | 0 | 0 | 0 | 0 | 0 | 0 | 0 | 0 | 0 | 0 | 15 |

FIG. 15C

| |
|---|
| FIG. 15A |
| FIG. 15B |

FIG. 16A.

S—2 SPLIT BOARD S—2

FOUR-PIN SPLITS (More on SPLIT BOARD S-3)

| | 1-2-3-7 | | 1-2-3-10 | | 1-2-4-6 | | 1-2-4-10 | | 1-2-5-7 | | 1-2-5-10 | | 1-2-6-7 | | 1-2-6-8 | | 1-2-6-9 | | 1-2-6-10 | | 1-2-7-8 | | 1-2-7-9 | 1-2-7-10 | 1-2-8-10 | 1-2-9-10 | | 1-3-4-6 | | |
|---|---|---|---|---|---|---|---|---|---|---|---|---|---|---|---|---|---|---|---|---|---|---|---|---|---|---|---|---|---|---|
| 1 | S | S | S | S | S | S | S | S | S | S | S | S | S | S | S | | S | S | S | S | S | S | S | S | S | S | S | S | S | 1 |
| 2 | S | S | S | S | S | S | S | S | S | S | S | S | S | S | S | | S | S | S | S | S | S | S | S | S | S | S | S | S | 2 |
| 3 | S | S | S | S | S | S | S | S | S | S | S | S | S | S | S | | S | S | S | S | S | S | S | RP4 | S | S | S | S | S | 3 |
| 4 | S | S | S | S | S | S | S | S | S | S | S | S | S | S | S | | S | S | S | S | S | S | RP4 | RP4 | RP4 | S | S | S | S | 4 |
| 5 | S | S | S | S | S | S | S | S | S | S | S | S | S | S | S | | S | S | S | S | S | S | RP4 | RP5 | RP4 | S | RP3 | S | S | 5 |
| 6 | S | S | S | S | S | S | S | S | S | S | S | RP2 | S | S | S | | S | S | S | S | S | S | RP4 | 3 | RP4 | RP3 | RP3 | S | S | 6 |
| 7 | S | S | S | S | S | S | S | RP2 | S | S | RP2 | RP3 | S | RP2 | S | | S | S | S | S | S | S | 3 | 3 | 3 | RP3 | RP3 | S | S | 7 |
| 8 | RP2 | S | S | RP2 | S | S | RP2 | RP2 | S | S | RP3 | RP3 | RP2 | RP3 | S | | S | S | S | S | S | S | 3 | 3 | 3 | RP3 | RP4 | S | S | 8 |
| 9 | RP3 | RP2 | RP2 | RP3 | S | RP1 | RP2 | RP3 | S | S | RP3 | 3 | RP3 | 3 | S | | S | S | S | S | RP1 | S | 3 | 2 | 2 | RP4 | RP4 | RP1 | S | 9 |
| 10 | RP3 | RP3 | RP2 | RP3 | RP1 | RP1 | RP3 | RP3 | RP1 | S | 3 | 3 | 3 | 2 | RP1 | | S | RP1 | S | RP1 | RP1 | RP1 | 2 | 2 | 2 | RP4 | 3 | RP1 | RP1 | 10 |
| 11 | 3 | 3 | 3 | 3 | RP1 | RP2 | RP3 | 3 | RP1 | RP1 | 3 | 2 | 2 | 2 | RP1 | | RP1 | RP2 | RP1 | RP2 | RP2 | RP1 | 2 | 2 | 2 | 3 | 3 | RP2 | RP1 | 11 |
| 12 | 3 | 3 | 3 | 3 | RP2 | RP3 | 3 | 3 | RP2 | RP1 | 2 | 2 | 2 | 2 | RP2 | | RP2 | RP3 | RP2 | RP3 | RP3 | RP2 | 2 | 2 | 2 | 3 | 2 | RP3 | RP2 | 12 |
| 13 | 2 | 3 | 3 | 2 | RP3 | 3 | 3 | 2 | RP2 | RP2 | 2 | 2 | 2 | 2 | RP3 | | RP3 | 3 | RP3 | 3 | 3 | RP3 | 2 | 2 | 2 | 3 | 2 | 3 | RP3 | 13 |
| 14 | RP4 | RP4 | RP4 | RP4 | RP4 | RP4 | RP4 | RP4 | RP4 | RP4 | RP4 | RP4 | RP4 | RP4 | RP4 | | RP4 | RP4 | RP4 | RP4 | RP4 | RP4 | 2 | 1 | 1 | 2 | 2 | RP4 | RP4 | 14 |
| 15 | 2 | 2 | 2 | 2 | 3 | 2 | 2 | 1 | 2 | 3 | 2 | 1 | 2 | 1 | 3 | | 3 | 2 | 3 | 2 | 2 | 2 | 1 | 1 | 1 | 2 | 1 | 2 | 3 | 15 |

FOUR-PIN SPLITS (More on SPLIT BOARD S-3)

| | 1-3-4-7 | | 1-3-4-8 | | 1-3-4-9 | 1-3-4-10 | | 1-3-5-7 | | 1-3-5-10 | | 1-3-6-7 | | 1-3-7-8 | | 1-3-7-9 | 1-3-7-10 | 1-3-8-10 | 1-3-9-10 | | 1-4-5-7 | | 1-4-5-8 | | RP COLUMNS 1 | 2 | 3 | |
|---|---|---|---|---|---|---|---|---|---|---|---|---|---|---|---|---|---|---|---|---|---|---|---|---|---|---|---|---|
| 1 | S | S | S | S | S | S | S | S | S | S | S | S | S | S | S | S | S | S | S | S | S | S | S | S | 1 | S | S | S | 1 |
| 2 | S | S | S | S | S | S | S | S | S | S | S | S | S | S | S | S | S | S | S | S | S | S | S | S | 2 | S | S | S | 2 |
| 3 | S | S | S | S | S | S | S | S | S | S | S | S | S | S | S | S | RP4 | S | S | S | S | S | S | S | 3 | S | S | S | 3 |
| 4 | S | S | S | S | S | S | S | S | S | S | S | S | S | S | S | RP4 | RP4 | RP4 | S | S | S | S | S | S | 4 | S | S | S | 4 |
| 5 | S | S | S | S | S | S | S | S | S | S | S | S | S | RP3 | S | RP4 | RP5 | RP5 | S | S | S | S | S | S | 5 | S | S | S | 5 |
| 6 | S | S | S | S | S | S | S | RP2 | S | S | S | S | S | RP3 | RP3 | RP4 | 3 | RP5 | S | S | S | S | S | S | 6 | S | S | S | 6 |
| 7 | S | S | S | S | S | RP2 | S | RP3 | RP2 | S | S | RP2 | S | RP3 | RP3 | 3 | 3 | 3 | S | S | S | S | S | S | 7 | S | S | 3 | 7 |
| 8 | S | S | S | S | S | RP3 | RP2 | RP3 | RP3 | S | S | RP2 | RP2 | RP4 | RP3 | 3 | 3 | 3 | S | S | RP3 | S | S | S | 8 | S | S | 3 | 8 |
| 9 | S | S | S | S | S | 3 | RP3 | 3 | RP3 | S | S | RP3 | RP2 | RP4 | RP4 | 2 | 2 | 3 | S | RP1 | RP4 | RP3 | S | S | 9 | S | 3 | 3 | 9 |
| 10 | RP1 | S | RP1 | S | RP1 | 2 | 3 | 3 | 3 | S | RP1 | RP3 | RP3 | 3 | RP4 | 2 | 2 | 2 | RP1 | RP1 | 3 | RP4 | RP1 | 10 | S | 3 | 3 | 10 |
| 11 | RP2 | RP1 | RP2 | RP1 | RP1 | 2 | 2 | 2 | 3 | RP1 | RP1 | 3 | RP3 | 3 | 3 | 2 | 2 | 2 | RP1 | RP2 | 3 | 3 | RP2 | 11 | 3 | 3 | 2 | 11 |
| 12 | RP3 | RP2 | RP3 | RP2 | RP2 | 2 | 2 | 2 | 2 | RP1 | RP2 | 3 | 3 | 2 | 3 | 2 | 2 | 2 | RP2 | RP3 | 2 | 3 | RP3 | 12 | 3 | 3 | 2 | 12 |
| 13 | 3 | RP3 | 3 | RP3 | RP3 | 2 | 2 | 2 | 2 | RP2 | RP2 | 2 | 3 | 2 | 3 | 2 | 2 | 2 | RP3 | 3 | 2 | 2 | 3 | 13 | 3 | 2 | 2 | 13 |
| 14 | RP4 | RP4 | RP4 | RP4 | RP4 | RP4 | RP4 | RP4 | RP4 | RP4 | RP4 | RP4 | RP4 | 2 | 2 | 1 | 1 | 2 | RP4 | RP4 | 2 | 2 | RP4 | 14 | 2 | 1 | 1 | 14 |
| 15 | 2 | 3 | 2 | 3 | 3 | 1 | 2 | 1 | 2 | 3 | 2 | 1 | 2 | 1 | 2 | 1 | 1 | 1 | 2 | 2 | 1 | 2 | 2 | 15 | 1 | 1 | 1 | 15 |

FOUR-PIN SPLITS (More on SPLIT BOARD S-3)

| | 1-4-5-9 | 1-4-5-10 | 1-4-6-7 | 1-4-6-8 | 1-4-6-9 | 1-4-6-10 | 1-4-7-8 | | 1-4-7-9 | | 1-4-7-10 | | 1-4-8-9 | 1-4-8-10 | | 1-4-9-10 | 1-5-6-7 | 1-5-6-8 | RP COLUMNS 4 | 5 | 6 | |
|---|---|---|---|---|---|---|---|---|---|---|---|---|---|---|---|---|---|---|---|---|---|---|
| 1 | S | S | S | S | S | S | S | S | S | S | RP5 | S | S | S | S | S | S | S | S | S | S | 1 |
| 2 | S | S | RP5 | RP5 | RP5 | RP5 | S | S | RP5 | S | RP5 | RP5 | S | RP5 | S | S | S | S | S | S | 3 | 2 |
| 3 | S | S | RP5 | RP5 | RP5 | RP5 | S | S | RP5 | RP5 | RP5 | RP5 | S | RP6 | RP5 | RP3 | S | S | S | 3 | 3 | 3 |
| 4 | S | S | RP5 | RP5 | RP5 | RP5 | S | S | RP6 | RP5 | RP6 | RP5 | S | 3 | RP6 | RP5 | S | S | 3 | 3 | 2 | 4 |
| 5 | S | S | RP6 | RP6 | RP6 | RP6 | S | S | RP6 | RP6 | 3 | RP6 | RP3 | 3 | 3 | RP5 | S | S | 3 | 3 | 2 | 5 |
| 6 | S | RP3 | 3 | RP6 | RP6 | 3 | S | S | 3 | RP6 | 3 | 3 | RP3 | 3 | 3 | RP5 | RP3 | S | 3 | 3 | 2 | 6 |
| 7 | S | RP3 | 3 | 3 | 3 | 3 | S | S | 3 | 3 | 3 | 3 | RP5 | 3 | 3 | RP6 | RP3 | S | 3 | 2 | 2 | 7 |
| 8 | S | RP3 | 2 | 3 | 3 | 2 | S | S | 3 | 3 | 2 | 3 | RP5 | 3 | 3 | 3 | RP3 | S | 3 | 2 | 2 | 8 |
| 9 | RP1 | RP4 | 2 | 3 | 3 | 2 | RP1 | S | 3 | 3 | 2 | 2 | RP6 | 2 | 3 | 3 | RP4 | RP1 | 2 | 2 | 1 | 9 |
| 10 | RP2 | 3 | 2 | 2 | 2 | 2 | RP2 | RP1 | 3 | 3 | 2 | 2 | 3 | 2 | 2 | 3 | 3 | RP2 | 2 | 2 | 1 | 10 |
| 11 | RP3 | 3 | 2 | 2 | 2 | 2 | RP3 | RP2 | 2 | 3 | 2 | 2 | 3 | 2 | 2 | 2 | 3 | RP3 | 2 | 1 | 1 | 11 |
| 12 | 3 | 2 | 2 | 2 | 2 | 2 | 3 | RP3 | 2 | 2 | 2 | 2 | 3 | 2 | 2 | 2 | 2 | 3 | 2 | 1 | 1 | 12 |
| 13 | 2 | 2 | 1 | 2 | 2 | 1 | 2 | 3 | 2 | 2 | 1 | 2 | 2 | 2 | 2 | 2 | 2 | 2 | 1 | 1 | 1 | 13 |
| 14 | RP4 | 2 | 1 | 1 | 1 | 1 | RP4 | RP4 | 1 | 2 | 1 | 1 | 2 | 1 | 2 | 2 | 2 | RP4 | 1 | 1 | 1 | 14 |
| 15 | 2 | 1 | 1 | 1 | 1 | 1 | 1 | 2 | 1 | 1 | 1 | 1 | 1 | 1 | 1 | 1 | 1 | 2 | 0 | 1 | 0 | 15 |

FOUR-PIN SPLITS (More on SPLIT BOARD S-3)

| | 1-5-6-9 | 1-5-6-10 | 1-5-7-9 | 1-5-7-10 | 1-5-8-10 | 1-6-7-8 | 1-6-7-9 | 1-6-7-10 | 1-6-8-9 | 1-6-8-10 | 1-6-9-10 | 1-7-8-9 | 1-7-8-10 | 1-7-9-10 | 1-8-9-10 | 2-4-5-10 | |
|---|---|---|---|---|---|---|---|---|---|---|---|---|---|---|---|---|---|
| 1 | S | S S | S | RP4 | S | S | S S | S RP5 | S | S S | S S | S | RP5 | RP5 | S | S S | 1 |
| 2 | S | S S | S | RP5 | S | S | S RP5 | RP5 RP5 | S | S RP5 | S S | S | RP5 | RP5 | S | S S | 2 |
| 3 | S | S S | S | RP6 | S | RP3 | RP5 RP6 | RP5 RP5 | S | RP5 RP5 | S S | S | RP6 | RP6 | S | S S | 3 |
| 4 | S | S S | S | RP6 | S | RP5 | RP6 3 | RP5 RP6 | S | RP5 RP6 | S S | S | 3 | 3 | S | S S | 4 |
| 5 | S | S S | RP3 | 3 | RP3 | RP5 | 3 3 | RP6 3 | RP3 | RP6 RP6 | S S | S | 3 | 3 | S | S S | 5 |
| 6 | S | S S | RP4 | 3 | RP4 | RP5 | 3 3 | 3 3 | RP3 | RP6 3 | S S | RP2 | 3 | 3 | RP2 | S RP3 | 6 |
| 7 | S | S S | RP5 | 3 | RP5 | RP6 | 3 3 | 3 3 | RP5 | 3 3 | S S | RP3 | 3 | 3 | RP3 | S RP3 | 7 |
| 8 | S | S RP3 | RP5 | 2 | RP5 | 3 | 3 3 | 3 2 | RP5 | 3 3 | S S | RP3 | 2 | 2 | RP3 | RP2 RP3 | 8 |
| 9 | S | RP3 RP4 | 3 | 2 | 3 | 3 | 3 2 | 2 2 | RP6 | 3 3 | S RP1 | RP4 | 2 | 2 | RP4 | RP3 RP4 | 9 |
| 10 | RP1 | RP4 3 | 3 | 2 | 3 | 3 | 2 2 | 2 2 | 3 | 3 3 | RP1 RP2 | 3 | 2 | 2 | 3 | RP4 RP5 | 10 |
| 11 | RP2 | 3 3 | 3 | 2 | 3 | 2 | 2 2 | 2 2 | 3 | 3 2 | RP2 RP3 | 3 | 2 | 2 | 3 | RP5 3 | 11 |
| 12 | RP3 | 3 2 | 2 | 2 | 2 | 2 | 2 2 | 2 2 | 3 | 2 2 | RP3 3 | 2 | 2 | 2 | 2 | 3 3 | 12 |
| 13 | 3 | 2 2 | 2 | 2 | 2 | 2 | 2 2 | 2 1 | 2 | 2 2 | 3 2 | 2 | 2 | 2 | 2 | 3 3 | 13 |
| 14 | RP4 | 2 2 | 2 | 1 | 2 | 2 | 2 1 | 1 1 | 2 | 2 1 | RP4 RP4 | 2 | 2 | 2 | 2 | 3 2 | 14 |
| 15 | 2 | 2 1 | 1 | 1 | 1 | 1 | 1 1 | 1 1 | 1 | 1 1 | 2 1 | 1 | 1 | 1 | 1 | 2 2 | 15 |

FIG. 16B.

FOUR-PIN SPLITS (More on SPLIT BOARD S-3)

| | 2-4-6-7 | 2-4-6-8 | 2-4-6-9 | 2-4-6-10 | 2-4-7-9 | 2-4-7-10 | 2-4-8-9 | 2-4-8-10 | 2-4-9-10 | 2-5-7-8 | 2-5-7-9 | 2-5-7-10 | 2-5-8-10 | 2-5-9-10 | 2-6-7-8 | 2-6-7-9 | |
|---|---|---|---|---|---|---|---|---|---|---|---|---|---|---|---|---|---|
| 1 | S | S S | S S | S S | S S | S S | S S | S S | S S | S | S | S | S S | S S | S S | S | 1 |
| 2 | S | S S | S RP5 | S RP5 | S S | S RP5 | S S | S RP4 | S S | S | S | S | S S | S S | S S | S | 2 |
| 3 | S | S RP4 | RP4 RP5 | RP4 RP6 | S S | RP4 RP5 | S S | RP4 RP5 | S S | S | S | RP4 | S S | S S | S S | S | 3 |
| 4 | S | RP4 RP5 | RP5 RP6 | RP5 3 | S RP3 | RP5 RP5 | S S | RP5 RP5 | S RP3 | S | S | RP5 | S S | S S | S RP3 | RP3 | 4 |
| 5 | S | RP5 RP5 | RP6 3 | 3 3 | S RP4 | RP5 RP5 | S S | RP5 3 | RP3 RP4 | S | RP3 | RP5 | S S | S S | RP3 RP4 | RP4 | 5 |
| 6 | RP3 | RP5 3 | 3 3 | 3 2 | RP3 RP5 | RP5 RP6 | S S | 3 3 | RP4 RP5 | S | RP4 | 3 | S S | S S | RP4 RP5 | RP5 | 6 |
| 7 | RP3 | 3 3 | 3 2 | 2 2 | RP3 3 | RP5 3 | S RP2 | 3 3 | RP5 3 | S | RP5 | 3 | S RP1 | S S | RP5 3 | 3 | 7 |
| 8 | RP4 | 3 3 | 2 2 | 2 2 | RP4 3 | 3 3 | RP2 RP3 | 3 3 | 3 3 | S | 3 | 3 | RP1 RP2 | S S | 3 3 | 3 | 8 |
| 9 | RP5 | 3 2 | 2 2 | 2 2 | 3 3 | 3 3 | RP3 RP4 | 3 2 | 3 2 | RP1 | 3 | 2 | RP2 RP3 | S RP1 | 3 3 | 3 | 9 |
| 10 | 3 | 2 2 | 2 2 | 2 2 | 3 2 | 3 2 | RP4 3 | 2 2 | 2 2 | RP2 | 3 | 2 | RP3 RP4 | RP1 RP2 | 3 2 | 2 | 10 |
| 11 | 3 | 2 2 | 2 2 | 2 2 | 3 2 | 2 2 | 3 3 | 2 2 | 2 2 | RP3 | 2 | 2 | RP4 3 | RP2 RP3 | 2 2 | 2 | 11 |
| 12 | 3 | 2 2 | 2 2 | 2 1 | 2 2 | 2 2 | 3 3 | 2 2 | 2 2 | RP4 | 2 | 2 | 3 3 | RP3 RP4 | 2 2 | 2 | 12 |
| 13 | 2 | 2 2 | 2 1 | 1 1 | 2 2 | 2 2 | 3 3 | 2 1 | 2 2 | 3 | 2 | 2 | 3 3 | RP4 3 | 2 2 | 2 | 13 |
| 14 | 2 | 2 1 | 1 1 | 1 1 | 2 2 | 2 1 | 2 2 | 1 1 | 2 1 | 3 | 2 | 1 | 3 2 | 3 2 | 2 2 | 2 | 14 |
| 15 | 1 | 1 1 | 1 1 | 1 1 | 2 1 | 1 1 | 2 1 | 1 1 | 1 1 | 2 | 1 | 1 | 2 1 | 2 2 | 2 1 | 1 | 15 |

FIG. 16C.

| |
|---|
| FIG. 16A |
| FIG. 16B |

FIG. 17A.

S–3 SPLIT BOARD S–3

FOUR-PIN SPLITS (More on SPLIT BOARD S-2)

| | 2-6-7-10 | 2-6-8-9 | 2-6-8-10 | 2-6-9-10 | 2-7-8-9 | 2-7-8-10 | 2-7-9-10 | 2-8-9-10 | 3-4-6-7 | 3-4-6-8 | 3-4-6-9 | 3-4-6-10 | 3-4-7-8 | 3-4-7-9 | 3-4-7-10 | 3-4-8-9 | |
|---|---|---|---|---|---|---|---|---|---|---|---|---|---|---|---|---|---|
| 1 | S | S S | S S | S S | S | S RP5 | S S | S | S S | S S | S S | S | S S | S S | S | S S | 1 |
| 2 | S | S S | S S | S S | S | RP5 RP5 | S RP4 | S | RP5 S | RP5 S | S S | S | S S | S S | S | S S | 2 |
| 3 | RP4 | S S | S S | S S | S | RP5 RP5 | RP4 RP5 | S | RP6 RP4 | RP5 RP4 | RP4 S | S | S S | S S | RP4 | S S | 3 |
| 4 | RP5 | S S | S S | S S | S | RP5 RP6 | RP5 RP5 | S | 3 RP5 | RP6 RP5 | RP5 RP4 | S | S S | S S | RP5 | S S | 4 |
| 5 | RP6 | S RP3 | S RP3 | S RP2 | S | RP6 3 | RP5 3 | S | 3 3 | 3 RP6 | RP5 RP5 | S | RP2 S | RP3 S | RP6 | RP3 S | 5 |
| 6 | 3 | RP3 RP4 | RP3 RP4 | RP2 RP3 | S | 3 3 | 3 3 | S | 2 3 | 3 3 | 3 RP5 | RP3 | RP3 RP2 | RP4 RP3 | 3 | RP4 RP3 | 6 |
| 7 | 3 | RP4 RP5 | RP4 RP5 | RP3 RP4 | RP2 | 3 3 | 3 3 | S | 2 2 | 2 3 | 3 3 | RP3 | RP4 RP3 | RP5 RP4 | 3 | RP5 RP4 | 7 |
| 8 | 3 | RP5 RP6 | RP5 RP6 | RP4 RP5 | RP3 | 3 3 | 3 2 | S | 2 2 | 2 2 | 3 3 | RP4 | RP5 RP4 | RP6 RP5 | 3 | RP6 RP5 | 8 |
| 9 | 2 | RP6 3 | RP6 3 | RP5 RP6 | RP4 | 3 2 | 2 2 | RP1 | 2 2 | 2 2 | 2 3 | RP5 | RP6 RP5 | 3 RP6 | 2 | 3 RP6 | 9 |
| 10 | 2 | 3 3 | 3 3 | RP6 3 | 3 | 2 2 | 2 2 | RP2 | 2 2 | 2 2 | 2 2 | 3 | 3 RP6 | 3 3 | 2 | 3 3 | 10 |
| 11 | 2 | 3 3 | 3 3 | 3 3 | 3 | 2 2 | 2 2 | RP3 | 2 2 | 2 2 | 2 2 | 3 | 3 3 | 3 3 | 2 | 3 3 | 11 |
| 12 | 1 | 3 2 | 3 2 | 3 2 | 2 | 2 2 | 2 2 | RP4 | 1 2 | 2 2 | 2 2 | 3 | 2 3 | 2 3 | 1 | 2 3 | 12 |
| 13 | 1 | 2 2 | 2 2 | 2 2 | 2 | 2 2 | 2 2 | 3 | 1 1 | 1 2 | 2 2 | 2 | 2 2 | 2 2 | 1 | 2 2 | 13 |
| 14 | 1 | 2 1 | 2 1 | 2 1 | 1 | 2 1 | 2 1 | 2 | 1 1 | 1 1 | 1 2 | 2 | 1 2 | 1 2 | 1 | 1 2 | 14 |
| 15 | 0 | 1 1 | 1 1 | 1 0 | 1 | 1 1 | 1 1 | 2 | 1 1 | 1 1 | 1 1 | 1 | 0 1 | 1 1 | 0 | 1 1 | 15 |

FOUR-PIN SPLITS (More on SPLIT BOARD S-2)

| | 3-4-8-10 | 3-4-9-10 | 3-5-6-7 | 3-5-7-8 | 3-5-7-9 | 3-5-7-10 | 3-5-8-10 | 3-5-9-10 | 3-6-7-8 | 3-6-7-9 | 3-6-7-10 | 3-6-8-9 | 3-6-8-10 | 3-7-8-9 | 3-7-8-10 | 3-7-9-10 | |
|---|---|---|---|---|---|---|---|---|---|---|---|---|---|---|---|---|---|
| 1 | S | S S | S S | S S | S S | S | S | S | S S | S S | S S | S S | S S | S | S S | RP5 S | 1 |
| 2 | S | S S | S S | S S | S S | S | S | S | S S | RP4 S | RP5 S | S S | S S | S | RP4 S | RP5 RP5 | 2 |
| 3 | S | S S | S S | S S | S S | RP4 | S | S | S S | RP5 RP4 | RP5 RP4 | S S | S S | S | RP5 RP4 | RP5 RP5 | 3 |
| 4 | RP3 | RP3 S | S S | S S | S S | RP5 | S | S | RP3 S | RP5 RP5 | RP5 RP5 | S S | RP3 S | S | RP5 RP5 | RP6 RP5 | 4 |
| 5 | RP4 | RP4 RP3 | S S | S S | S S | RP5 | RP3 | S | RP4 RP3 | 3 RP5 | RP5 RP5 | S S | RP4 S | S | 3 RP5 | 3 RP6 | 5 |
| 6 | RP5 | RP5 RP4 | RP3 S | S S | S S | 3 | RP4 | S | RP5 RP4 | 3 3 | RP6 RP5 | S S | RP5 RP3 | S | 3 3 | 3 3 | 6 |
| 7 | 3 | 3 RP5 | RP3 S | S S | RP1 S | 3 | RP5 | S | 3 RP5 | 3 3 | 3 RP5 | RP2 S | 3 RP3 | S | 3 3 | 3 3 | 7 |
| 8 | 3 | 3 3 | RP3 RP2 | S S | RP2 RP1 | 3 | 3 | S | 3 3 | 3 3 | 3 3 | RP3 RP2 | 3 RP4 | S | 2 3 | 3 3 | 8 |
| 9 | 3 | 3 3 | RP4 RP3 | RP1 S | RP3 RP2 | 2 | 3 | RP1 | 2 3 | 2 3 | 3 3 | RP4 RP3 | 3 3 | RP1 | 2 2 | 2 3 | 9 |
| 10 | 2 | 2 3 | RP5 RP4 | RP2 RP1 | RP4 RP3 | 2 | 3 | RP2 | 2 2 | 2 2 | 2 3 | 3 RP4 | 2 3 | RP2 | 2 2 | 2 2 | 10 |
| 11 | 2 | 2 2 | 3 RP5 | RP3 RP2 | 3 RP4 | 2 | 2 | RP3 | 2 2 | 2 2 | 2 2 | 3 3 | 2 3 | RP3 | 2 2 | 2 2 | 11 |
| 12 | 2 | 2 2 | 3 3 | RP4 RP3 | 3 3 | 2 | 2 | RP4 | 2 2 | 2 2 | 2 2 | 3 3 | 2 2 | RP4 | 2 2 | 2 2 | 12 |
| 13 | 2 | 2 2 | 3 3 | 3 RP4 | 3 3 | 2 | 2 | 3 | 2 2 | 1 2 | 2 2 | 3 3 | 2 2 | 3 | 2 2 | 2 2 | 13 |
| 14 | 2 | 2 2 | 2 3 | 2 3 | 2 3 | 1 | 2 | 3 | 1 2 | 1 1 | 1 2 | 2 2 | 2 2 | 2 | 1 2 | 1 2 | 14 |
| 15 | 1 | 1 2 | 2 2 | 2 2 | 1 2 | 1 | 1 | 2 | 1 1 | 1 1 | 1 1 | 1 2 | 1 2 | 2 | 1 1 | 1 1 | 15 |

FOUR-PIN SPLITS (More on SPLIT BOARD S-2)

| | 3-8-9-10 | 4-5-7-9 | 4-5-7-10 | 4-5-8-10 | 4-5-9-10 | 4-6-7-8 | 4-6-7-9 | 4-6-7-10 | 4-6-8-9 | 4-6-8-10 | 4-6-9-10 | |
|---|---|---|---|---|---|---|---|---|---|---|---|---|
| 1 | S | S | S | S | S | RP4 RP4 | RP4 RP4 | RP5 | RP5 | RP4 RP4 | RP4 RP4 | 1 |
| 2 | S | S | S | S | S | RP5 RP5 | RP5 RP5 | RP5 | RP5 | RP5 RP5 | RP5 RP5 | 2 |
| 3 | S | S | S | S | S | RP6 3 | RP6 3 | RP6 | RP5 | 3 RP6 | 3 RP6 | 3 |
| 4 | S | S | S | S | S | 3 3 | 3 3 | RP6 | RP6 | 3 3 | 3 3 | 4 |
| 5 | S | S | S | S | S | 3 3 | 3 3 | 3 | 3 | 3 3 | 3 3 | 5 |
| 6 | S | S | RP3 | S | S | 3 3 | 3 2 | 3 | 3 | 2 3 | 3 3 | 6 |
| 7 | RP2 | S | RP4 | RP2 | S | 3 2 | 2 2 | 2 | 3 | 2 2 | 2 3 | 7 |
| 8 | RP3 | S | RP5 | RP3 | RP1 | 2 2 | 2 2 | 2 | 3 | 2 2 | 2 2 | 8 |
| 9 | RP4 | S | 3 | RP4 | RP2 | 2 2 | 2 2 | 2 | 2 | 2 2 | 2 2 | 9 |
| 10 | 3 | RP1 | 3 | RP5 | RP3 | 2 2 | 2 2 | 2 | 2 | 2 2 | 2 2 | 10 |
| 11 | 3 | RP2 | 3 | 3 | RP4 | 2 2 | 2 2 | 2 | 2 | 2 2 | 2 2 | 11 |
| 12 | 2 | RP3 | 3 | 3 | RP5 | 2 2 | 2 2 | 2 | 2 | 2 2 | 2 2 | 12 |
| 13 | 2 | RP4 | 2 | 3 | 3 | 2 2 | 2 1 | 2 | 2 | 1 2 | 2 2 | 13 |
| 14 | 1 | 3 | 2 | 2 | 3 | 2 1 | 1 1 | 1 | 1 | 1 1 | 1 2 | 14 |
| 15 | 1 | 2 | 1 | 2 | 2 | 1 0 | 1 0 | 1 | 0 | 0 1 | 0 1 | 15 |

RP COLUMNS

| | 1 | 2 | 3 | 4 | 5 | 6 | 7 | 8 | 9 | |
|---|---|---|---|---|---|---|---|---|---|---|
| 1 | S | S | S | S | S | S | S | S | S | 1 |
| 2 | S | S | S | S | S | 3 | S | S | S | 2 |
| 3 | S | S | S | S | 3 | 3 | S | S | S | 3 |
| 4 | S | S | S | 3 | 3 | 2 | S | S | S | 4 |
| 5 | S | S | S | 3 | 3 | 2 | S | 6 | S | 5 |
| 6 | S | S | S | 3 | 3 | 2 | 6 | 6 | 7 | 6 |
| 7 | S | S | 3 | 3 | 2 | 2 | 6 | 6 | 7 | 7 |
| 8 | S | S | 3 | 3 | 2 | 2 | 6 | 5 | 7 | 8 |
| 9 | S | 3 | 3 | 2 | 2 | 1 | 6 | 5 | 6 | 9 |
| 10 | S | 3 | 3 | 2 | 2 | 1 | 5 | 4 | 5 | 10 |
| 11 | 3 | 3 | 2 | 2 | 1 | 1 | 5 | 4 | 4 | 11 |
| 12 | 3 | 3 | 2 | 2 | 1 | 1 | 5 | 3 | 3 | 12 |
| 13 | 3 | 2 | 2 | 1 | 1 | 1 | 4 | 2 | 2 | 13 |
| 14 | 2 | 1 | 1 | 1 | 1 | 1 | 4 | 0 | 0 | 14 |
| 15 | 1 | 1 | 1 | 0 | 1 | 0 | 3 | 1 | 1 | 15 |

FOUR-PIN SPLITS (More on SPLIT BOARD S-2)

| | 4-7-8-9 | | 4-7-8-10 | | 4-7-9-10 | | 4-8-9-10 | | 5-6-7-8 | 5-6-7-9 | 5-6-7-10 | 5-6-8-10 | 5-7-8-9 | | 5-7-8-10 | 5-7-9-10 | 5-8-9-10 | | 6-7-8-9 | | 6-7-8-10 | | 6-7-9-10 | | 6-8-9-10 | | |
|---|---|---|---|---|---|---|---|---|---|---|---|---|---|---|---|---|---|---|---|---|---|---|---|---|---|---|---|
| 1 | S | S | RP4 | RP4 | S | S | S | S | S | S | S | S | S | S | S | S | S | S | S | S | S | S | RP4 | RP4 | S | S | 1 |
| 2 | S | S | RP5 | RP5 | S | S | S | S | S | S | S | S | S | S | S | S | S | S | S | S | S | S | RP5 | RP5 | S | S | 2 |
| 3 | S | S | RP5 | RP6 | S | RP3 | S | RP4 | S | S | S | S | S | S | S | S | S | S | RP4 | S | RP3 | S | RP6 | RP5 | S | S | 3 |
| 4 | S | S | RP6 | 3 | RP3 | RP4 | RP4 | RP5 | S | S | S | S | S | S | S | S | S | S | RP5 | RP4 | RP4 | RP3 | 3 | RP6 | S | S | 4 |
| 5 | S | S | 3 | 3 | RP4 | RP5 | RP5 | RP5 | S | S | S | S | S | S | RP2 | RP2 | S | S | RP5 | RP5 | RP5 | RP4 | 3 | 3 | S | S | 5 |
| 6 | S | S | 3 | 3 | RP5 | 3 | RP5 | RP6 | S | S | RP3 | S | S | S | RP3 | RP3 | S | S | RP6 | RP5 | 3 | RP5 | 3 | 3 | S | S | 6 |
| 7 | S | RP1 | 3 | 3 | 3 | 3 | RP6 | 3 | S | RP2 | RP4 | S | RP1 | S | RP4 | RP4 | S | RP1 | 3 | RP6 | 3 | 3 | 3 | 3 | RP1 | S | 7 |
| 8 | RP1 | RP2 | 3 | 3 | 3 | 3 | 3 | 3 | RP1 | RP3 | RP5 | S | RP2 | RP1 | 3 | 3 | RP1 | RP2 | 3 | 3 | 3 | 3 | 3 | 3 | RP2 | RP1 | 8 |
| 9 | RP2 | RP3 | 3 | 2 | 3 | 2 | 3 | 3 | RP2 | RP4 | 3 | S | RP3 | RP2 | 3 | 3 | RP2 | RP3 | 3 | 3 | 2 | 3 | 2 | 3 | RP3 | RP2 | 9 |
| 10 | RP3 | RP4 | 2 | 2 | 2 | 2 | 3 | 3 | RP3 | RP5 | 3 | RP1 | RP4 | RP3 | 3 | 3 | RP3 | RP4 | 3 | 3 | 2 | 2 | 2 | 2 | RP4 | RP3 | 10 |
| 11 | RP4 | 3 | 2 | 2 | 2 | 2 | 3 | 2 | RP4 | 3 | 3 | RP2 | 3 | RP4 | 3 | 3 | RP4 | 3 | 2 | 3 | 2 | 2 | 2 | 2 | 3 | RP4 | 11 |
| 12 | 3 | 3 | 2 | 2 | 2 | 2 | 2 | 2 | RP5 | 3 | 3 | RP3 | 3 | 3 | 2 | 2 | 3 | 3 | 2 | 2 | 2 | 2 | 2 | 2 | 3 | 3 | 12 |
| 13 | 3 | 2 | 2 | 2 | 2 | 2 | 2 | 2 | 3 | 3 | 2 | RP4 | 2 | 3 | 2 | 2 | 3 | 2 | 2 | 2 | 2 | 2 | 2 | 2 | 2 | 3 | 13 |
| 14 | 2 | 2 | 2 | 1 | 2 | 1 | 2 | 2 | 3 | 2 | 2 | 3 | 2 | 2 | 2 | 2 | 2 | 2 | 2 | 2 | 1 | 2 | 1 | 2 | 2 | 2 | 14 |
| 15 | 2 | 2 | 1 | 1 | 1 | 1 | 2 | 1 | 2 | 2 | 1 | 2 | 2 | 2 | 2 | 2 | 2 | 2 | 1 | 2 | 1 | 1 | 1 | 1 | 2 | 2 | 15 |

SEVEN-PIN SPLITS

| | 1-2-3-4-5-7-10 | 1-2-3-4-7-8-10 | 1-2-3-5-6-7-10 | 1-2-3-6-7-9-10 | 1-2-4-5-7-8-10 | | 1-2-4-6-7-8-10 | | 1-3-4-6-7-9-10 | | 1-3-5-6-7-9-10 | | |
|---|---|---|---|---|---|---|---|---|---|---|---|---|---|
| 1 | S | S | S | S | S | S | S | S | S | S | S | S | 1 |
| 2 | S | S | S | S | S | S | S | S | S | S | S | S | 2 |
| 3 | S | S | S | S | S | S | S | S | S | S | S | S | 3 |
| 4 | S | S | S | S | S | S | S | S | S | S | S | S | 4 |
| 5 | S | S | S | S | S | S | S | S | S | S | S | S | 5 |
| 6 | S | S | S | S | S | S | S | RP7 | RP7 | S | S | S | 6 |
| 7 | S | S | S | S | S | S | RP7 | RP7 | RP7 | RP7 | S | S | 7 |
| 8 | S | RP7 | S | RP7 | S | RP7 | RP7 | RP7 | RP7 | RP7 | RP7 | S | 8 |
| 9 | S | RP7 | S | RP7 | RP7 | RP7 | RP7 | RP7 | RP7 | RP7 | RP7 | RP7 | 9 |
| 10 | RP7 | RP7 | RP7 | RP7 | RP7 | RP7 | RP7 | RP7 | RP7 | RP7 | RP7 | RP7 | 10 |
| 11 | RP7 | RP7 | RP7 | RP7 | RP7 | RP7 | RP7 | RP7 | RP7 | RP7 | RP7 | RP7 | 11 |
| 12 | RP7 | RP7 | RP7 | RP7 | RP7 | RP7 | RP7 | RP7 | RP7 | RP7 | RP7 | RP7 | 12 |
| 13 | RP7 | RP7 | RP7 | RP7 | RP7 | RP7 | RP7 | RP7 | RP7 | RP7 | RP7 | RP7 | 13 |
| 14 | RP8 | RP8 | RP8 | RP8 | RP8 | RP8 | RP8 | RP8 | RP8 | RP8 | RP8 | RP8 | 14 |
| 15 | RP7 | RP7 | RP7 | RP7 | RP7 | RP7 | RP7 | RP7 | RP7 | RP7 | RP7 | RP7 | 15 |

EIGHT-PIN SPLITS

| | 1-2-3-4-5-7-8-10 | | 1-2-3-5-6-7-9-10 | | |
|---|---|---|---|---|---|
| 1 | S | S | S | S | 1 |
| 2 | S | S | S | S | 2 |
| 3 | S | S | S | S | 3 |
| 4 | S | S | S | S | 4 |
| 5 | S | S | S | S | 5 |
| 6 | S | S | S | S | 6 |
| 7 | S | S | S | S | 7 |
| 8 | S | S | S | S | 8 |
| 9 | S | S | S | S | 9 |
| 10 | S | S | S | S | 10 |
| 11 | S | RP9 | RP9 | S | 11 |
| 12 | RP9 | RP9 | RP9 | RP9 | 12 |
| 13 | RP9 | RP9 | RP9 | RP9 | 13 |
| 14 | RP9 | RP9 | RP9 | RP9 | 14 |
| 15 | RP9 | RP9 | RP9 | RP9 | 15 |

FIG. 17B.

FIG. 17C.

| |
|---|
| FIG. 17A |
| FIG. 17B |

FIG. 18A.

S–4 SPLIT BOARD S–4

FIVE-PIN SPLITS

| | 1-2-3-4-10 | 1-2-3-5-7 | 1-2-3-5-10 | 1-2-3-6-7 | 1-2-3-7-8 | 1-2-3-7-9 | 1-2-3-7-10 | 1-2-3-8-10 | 1-2-3-9-10 | 2-4-5-7-10 | | 2-4-5-8-10 | | 2-4-5-9-10 | | 2-4-7-8-10 | | |
|---|---|---|---|---|---|---|---|---|---|---|---|---|---|---|---|---|---|---|
| 1 | S | S | S | S | S | S | S | S | S | S | S | S | S | S | S | S | S | 1 |
| 2 | S | S | S | S | S | S | S | S | S | S | S | S | S | S | S | S | S | 2 |
| 3 | S | S | S | S | S | S | RP6 | S | S | S | S | S | S | S | S | S | RP6 | 3 |
| 4 | S | S | S | S | S | S | RP7 | S | S | S | RP5 | S | S | S | S | RP6 | RP6 | 4 |
| 5 | S | S | S | S | S | S | 4 | S | S | RP5 | RP6 | S | RP5 | S | S | RP6 | RP7 | 5 |
| 6 | S | S | S | S | S | RP5 | 4 | RP5 | S | RP6 | RP7 | RP5 | RP6 | S | S | RP7 | RP7 | 6 |
| 7 | S | S | S | S | S | RP6 | 4 | RP6 | S | RP7 | 4 | RP6 | RP7 | S | S | RP7 | 4 | 7 |
| 8 | S | S | S | S | S | RP7 | 4 | RP7 | S | 4 | 4 | RP7 | 4 | S | S | 4 | 4 | 8 |
| 9 | S | S | S | S | RP2 | 4 | 3 | 4 | RP2 | 4 | 4 | 4 | 4 | S | S | 4 | 4 | 9 |
| 10 | RP1 | S | S | RP1 | RP3 | 4 | 3 | 4 | RP3 | 4 | 3 | 4 | 4 | S | S | 4 | 3 | 10 |
| 11 | RP1 | S | S | RP1 | RP3 | 3 | 3 | 3 | RP3 | 3 | 3 | 4 | 4 | S | S | 3 | 3 | 11 |
| 12 | RP2 | RP1 | RP1 | RP2 | 4 | 3 | 3 | 3 | 4 | 3 | 3 | 4 | 3 | S | RP1 | 3 | 3 | 12 |
| 13 | RP3 | RP2 | RP2 | RP3 | 4 | 3 | 3 | 3 | 4 | 3 | 2 | 3 | 3 | RP1 | RP2 | 3 | 2 | 13 |
| 14 | RP4 | RP4 | RP4 | RP4 | RP4 | RP8 | RP8 | RP8 | RP4 | RP8 | RP8 | RP8 | RP8 | RP4 | RP4 | RP8 | RP8 | 14 |
| 15 | 4 | RP3 | RP3 | 4 | 3 | 2 | 2 | 2 | 3 | 2 | 2 | 2 | 2 | RP2 | 4 | 2 | 2 | 15 |

FIVE-PIN SPLITS

| | 2-4-7-9-10 | | 2-4-8-9-10 | | 2-6-7-8-9 | | 2-6-7-8-10 | | 2-6-7-9-10 | | 3-4-7-8-10 | | 3-4-7-9-10 | | 3-4-8-9-10 | | 3-5-6-7-8 | | 3-5-6-7-9 | | |
|---|---|---|---|---|---|---|---|---|---|---|---|---|---|---|---|---|---|---|---|---|---|
| 1 | S | S | S | S | S | S | S | S | S | S | S | S | S | S | S | S | S | S | S | S | 1 |
| 2 | S | S | S | S | S | S | S | S | S | S | S | S | S | S | S | S | S | S | S | S | 2 |
| 3 | S | S | S | S | S | S | S | RP6 | S | S | S | S | RP6 | S | S | S | S | S | S | S | 3 |
| 4 | S | S | S | S | S | RP5 | RP6 | RP6 | S | S | S | S | RP6 | RP6 | RP5 | S | S | S | S | S | 4 |
| 5 | S | S | S | S | RP5 | RP6 | RP6 | RP7 | S | RP5 | RP5 | S | RP7 | RP6 | RP6 | RP5 | S | S | RP5 | S | 5 |
| 6 | S | S | S | S | RP5 | RP6 | RP7 | RP7 | RP5 | RP6 | RP6 | RP5 | RP7 | RP7 | RP6 | RP5 | S | S | RP6 | RP5 | 6 |
| 7 | S | RP1 | S | S | RP6 | RP7 | RP7 | RP7 | RP6 | RP6 | RP6 | RP6 | RP7 | RP7 | RP7 | RP6 | S | S | RP7 | RP6 | 7 |
| 8 | RP1 | RP1 | S | RP1 | RP6 | RP7 | RP7 | 4 | RP6 | RP7 | RP7 | RP6 | 4 | RP7 | RP7 | RP6 | S | S | 4 | RP7 | 8 |
| 9 | RP1 | RP2 | RP1 | RP1 | RP7 | RP7 | 4 | 4 | RP7 | 4 | 4 | RP7 | 4 | 4 | RP7 | RP7 | S | S | 4 | 4 | 9 |
| 10 | RP2 | RP2 | RP1 | RP2 | RP7 | 4 | 4 | 3 | 4 | 3 | 3 | 4 | 3 | 4 | 4 | RP7 | S | S | 4 | 4 | 10 |
| 11 | RP2 | RP3 | RP2 | RP2 | 4 | 4 | 3 | 3 | 3 | 3 | 3 | 3 | 3 | 3 | 4 | 4 | S | S | 4 | 4 | 11 |
| 12 | RP3 | RP3 | RP2 | RP3 | 4 | 3 | 3 | 3 | 3 | 2 | 2 | 3 | 3 | 3 | 3 | 4 | RP1 | S | 3 | 4 | 12 |
| 13 | RP3 | 4 | RP3 | RP3 | 3 | 3 | 3 | 2 | 2 | 2 | 2 | 2 | 2 | 3 | 3 | 3 | RP2 | RP1 | 3 | 3 | 13 |
| 14 | RP4 | RP4 | RP4 | RP4 | RP8 | RP8 | RP8 | RP8 | RP8 | RP8 | RP8 | RP8 | RP8 | RP8 | RP8 | RP8 | RP4 | RP4 | RP8 | RP8 | 14 |
| 15 | 4 | 3 | RP3 | 4 | 3 | 2 | 2 | 2 | 2 | 2 | 2 | 2 | 2 | 2 | 2 | 3 | 4 | RP2 | 2 | 2 | 15 |

RP COLUMNS

| | 1 | 2 | 3 | 4 | |
|---|---|---|---|---|---|
| 1 | S | S | S | S | 1 |
| 2 | S | S | S | S | 2 |
| 3 | S | S | S | S | 3 |
| 4 | S | S | S | S | 4 |
| 5 | S | S | S | S | 5 |
| 6 | S | S | S | S | 6 |
| 7 | S | S | S | S | 7 |
| 8 | S | S | S | S | 8 |
| 9 | S | S | 4 | S | 9 |
| 10 | S | 4 | 4 | S | 10 |
| 11 | 4 | 4 | 4 | 4 | 11 |
| 12 | 4 | 3 | 3 | 3 | 12 |
| 13 | 3 | 3 | 3 | 2 | 13 |
| 14 | 2 | 2 | 2 | 1 | 14 |
| 15 | 1 | 1 | 1 | 0 | 15 |

FIVE-PIN SPLITS

| | 3-5-6-7-10 | | 3-6-7-8-9 | | 3-6-7-8-10 | | 3-6-7-9-10 | | 4-5-7-8-10 | 4-5-7-9-10 | 4-6-7-8-10 | 4-6-7-9-10 | 5-6-7-8-10 | 5-6-7-9-10 | |
|---|---|---|---|---|---|---|---|---|---|---|---|---|---|---|---|
| 1 | S | S | S | S | S | S | S | S | S | S | RP6 | RP6 | S | S | 1 |
| 2 | S | S | S | S | S | S | S | S | S | S | RP8 | RP8 | S | S | 2 |
| 3 | S | S | S | S | S | S | RP6 | S | S | S | RP7 | RP7 | S | S | 3 |
| 4 | RP5 | S | S | S | S | S | RP6 | RP6 | S | S | RP7 | RP7 | S | S | 4 |
| 5 | RP6 | RP5 | S | S | S | S | RP7 | RP6 | S | S | 4 | 4 | S | S | 5 |
| 6 | RP7 | RP6 | S | S | S | S | RP7 | RP7 | RP5 | S | 4 | 4 | S | RP5 | 6 |
| 7 | 4 | RP7 | S | S | RP1 | S | 4 | RP7 | RP5 | S | 3 | 3 | S | RP5 | 7 |
| 8 | 4 | 4 | RP1 | S | RP1 | RP1 | 4 | 4 | RP6 | RP5 | 3 | 3 | RP5 | RP6 | 8 |
| 9 | 4 | 4 | RP1 | RP1 | RP2 | RP1 | 4 | 4 | RP6 | RP5 | 3 | 3 | RP5 | RP6 | 9 |
| 10 | 3 | 4 | RP2 | RP1 | RP2 | RP2 | 3 | 4 | 4 | RP6 | 3 | 3 | RP6 | 4 | 10 |
| 11 | 3 | 3 | RP2 | RP2 | RP3 | RP2 | 3 | 3 | 4 | 4 | 3 | 3 | 4 | 4 | 11 |
| 12 | 3 | 3 | RP3 | RP2 | RP3 | RP3 | 3 | 3 | 3 | 4 | 2 | 2 | 4 | 3 | 12 |
| 13 | 2 | 3 | RP3 | RP3 | 4 | RP3 | 2 | 3 | 3 | 3 | 2 | 2 | 3 | 3 | 13 |
| 14 | RP8 | RP8 | RP4 | RP4 | RP4 | RP4 | RP8 | RP8 | RP8 | RP8 | 2 | 2 | RP8 | RP8 | 14 |
| 15 | 2 | 2 | 4 | RP3 | 3 | 4 | 2 | 2 | 3 | 3 | 1 | 1 | 3 | 3 | 15 |

RP COLUMNS

| | 5 | 6 | 7 | 8 | |
|---|---|---|---|---|---|
| 1 | S | S | S | S | 1 |
| 2 | S | S | 4 | S | 2 |
| 3 | S | S | 4 | S | 3 |
| 4 | S | 4 | 4 | 4 | 4 |
| 5 | S | 4 | 3 | 4 | 5 |
| 6 | 4 | 4 | 3 | 4 | 6 |
| 7 | 4 | 4 | 3 | 4 | 7 |
| 8 | 4 | 3 | 3 | 3 | 8 |
| 9 | 4 | 3 | 3 | 3 | 9 |
| 10 | 4 | 3 | 3 | 3 | 10 |
| 11 | 3 | 3 | 2 | 3 | 11 |
| 12 | 3 | 2 | 2 | 3 | 12 |
| 13 | 2 | 2 | 2 | 2 | 13 |
| 14 | 2 | 2 | 1 | 1 | 14 |
| 15 | 1 | 1 | 1 | 0 | 15 |

SIX-PIN SPLITS (More on SPARE BOARD B-2)

| | 1-2-3-4-5-10 | | 1-2-3-4-7-10 | | 1-2-3-4-8-10 | | 1-2-3-5-6-7 | | 1-2-3-6-7-9 | 1-2-3-5-7-10 | 1-2-3-5-8-10 | 1-2-3-6-7-9 | | 1-2-3-6-7-10 | | 1-2-3-7-8-10 | |
|---|---|---|---|---|---|---|---|---|---|---|---|---|---|---|---|---|---|
| 1 | S | S | S | S | S | S | S | S | S | S | S | S | S | S | S | S | 1 |
| 2 | S | S | S | S | S | S | S | S | S | S | S | S | S | S | S | S | 2 |
| 3 | S | S | S | S | S | S | S | S | S | S | S | S | S | S | S | S | 3 |
| 4 | S | S | S | S | S | S | S | S | S | S | S | S | S | S | S | S | 4 |
| 5 | S | S | S | S | S | S | S | S | S | S | S | S | S | S | S | RP12 | 5 |
| 6 | S | S | S | S | S | S | S | S | S | RP11 | S | S | S | S | S | RP12 | 6 |
| 7 | S | S | RP11 | S | S | RP10 | S | S | S | RP11 | S | RP10 | S | S | RP11 | RP12 | 7 |
| 8 | S | S | RP11 | RP12 | RP10 | RP10 | S | S | S | RP11 | S | RP10 | RP10 | RP12 | RP11 | RP12 | 8 |
| 9 | S | RP10 | RP12 | RP12 | RP10 | RP10 | RP10 | S | S | RP12 | S | RP10 | RP10 | RP12 | RP12 | RP14 | 9 |
| 10 | RP10 | RP10 | RP12 | RP14 | RP10 | RP10 | RP10 | RP10 | S | RP12 | S | RP10 | RP10 | RP14 | RP12 | RP14 | 10 |
| 11 | RP10 | RP10 | RP12 | RP14 | RP10 | RP11 | RP10 | RP10 | RP10 | RP12 | RP10 | RP11 | RP10 | RP14 | RP12 | RP14 | 11 |
| 12 | RP10 | RP10 | RP15 | RP16 | RP11 | RP11 | RP10 | RP10 | RP10 | RP12 | RP10 | RP11 | RP11 | RP16 | RP15 | RP14 | 12 |
| 13 | RP10 | RP11 | RP16 | 5 | RP11 | RP12 | RP11 | RP10 | RP11 | RP14 | RP11 | RP12 | RP11 | 5 | RP16 | RP15 | 13 |
| 14 | RP11 | RP12 | 5 | 5 | RP12 | RP12 | RP12 | RP11 | RP12 | RP15 | RP12 | RP12 | RP12 | 5 | 5 | RP15 | 14 |
| 15 | RP13 | RP13 | 5 | 4 | RP13 | RP13 | RP13 | RP13 | RP13 | RP16 | RP13 | RP13 | RP13 | 4 | 5 | RP16 | 15 |

SIX-PIN SPLITS (More on SPARE BOARD B-2)

| | 1-2-3-7-9-10 | | 1-2-4-5-7-10 | | 1-2-4-6-7-8 | | 1-2-4-6-7-9 | | 1-2-4-6-7-10 | | 1-2-4-6-8-10 | 1-2-4-6-9-10 | |
|---|---|---|---|---|---|---|---|---|---|---|---|---|---|
| 1 | S | | S | S | S | S | S | S | S | S | S | S | 1 |
| 2 | S | | S | S | S | S | S | S | S | S | S | S | 2 |
| 3 | S | | S | S | S | S | S | S | S | S | S | S | 3 |
| 4 | S | | S | S | S | S | S | S | S | S | S | S | 4 |
| 5 | RP12 | | S | S | S | S | S | S | S | S | S | S | 5 |
| 6 | RP12 | | RP12 | S | S | S | S | S | S | S | S | S | 6 |
| 7 | RP12 | | RP12 | RP11 | S | S | S | S | S | S | S | S | 7 |
| 8 | RP12 | | RP12 | RP11 | S | RP10 | S | RP10 | S | RP10 | S | S | 8 |
| 9 | RP14 | | RP14 | RP12 | RP10 | RP10 | RP10 | RP10 | RP10 | RP10 | RP10 | S | 9 |
| 10 | RP14 | | RP14 | RP12 | RP10 | RP10 | RP10 | RP10 | RP10 | RP10 | RP11 | S | 10 |
| 11 | RP14 | | RP15 | RP14 | RP10 | RP10 | RP10 | RP10 | RP10 | RP10 | 5 | S | 11 |
| 12 | RP14 | | RP16 | RP15 | RP10 | RP11 | RP10 | RP11 | RP10 | RP11 | 4 | RP10 | 12 |
| 13 | RP15 | | 5 | RP16 | RP11 | RP11 | RP11 | RP11 | RP11 | RP11 | 4 | RP10 | 13 |
| 14 | RP15 | | 4 | 5 | RP11 | RP12 | RP11 | RP12 | RP11 | RP12 | RP13 | RP11 | 14 |
| 15 | RP16 | | 3 | 4 | RP13 | RP13 | RP13 | RP13 | RP13 | RP13 | 3 | RP13 | 15 |

RP COLUMNS

| | 10 | 11 | 12 | 13 | 14 | 15 | 16 | |
|---|---|---|---|---|---|---|---|---|
| 1 | S | S | S | S | S | S | S | 1 |
| 2 | S | S | S | S | S | S | S | 2 |
| 3 | S | S | S | S | S | S | S | 3 |
| 4 | S | S | S | S | S | S | 5 | 4 |
| 5 | S | S | S | S | S | 5 | 4 | 5 |
| 6 | S | S | S | S | 5 | 4 | 4 | 6 |
| 7 | S | S | 5 | S | 4 | 4 | 4 | 7 |
| 8 | S | 5 | 5 | S | 4 | 4 | 3 | 8 |
| 9 | 5 | 5 | 4 | S | 4 | 3 | 3 | 9 |
| 10 | 5 | 4 | 4 | 5 | 3 | 3 | 2 | 10 |
| 11 | 4 | 4 | 3 | 4 | 3 | 3 | 2 | 11 |
| 12 | 4 | 3 | 3 | 3 | 3 | 2 | 1 | 12 |
| 13 | 3 | 3 | 3 | 2 | 2 | 2 | 1 | 13 |
| 14 | 3 | 3 | 2 | 1 | 1 | 1 | 1 | 14 |
| 15 | 2 | 2 | 1 | 0 | 1 | 1 | 0 | 15 |

FIG. 18B.

FIG. 18C.

| |
|---|
| FIG. 18A |
| FIG. 18B |

BOWLING GAME

This is a continuation of application Ser. No. 163,016, filed June 25, 1980, now abandoned.

BACKGROUND OF THE INVENTION

The present invention relates, in general, to board games, and more particularly to a bowling game which accurately simulates bowling matches between professional bowlers for whom actual statistics are available for use in preparing individual bowler cards. The use of statistically accurate game indicia for the bowler cards and the game boards provides realistic and accurate match results.

DESCRIPTION OF THE PRIOR ART

The applicant herein is the developer of a simulated football game, covered by his U.S. Pat. No. 3,043,594, a simulated golf game, covered by his U.S. Pat. No. 3,280,526, a simulated basketball game, covered by U.S. Pat. No. 3,545,763, and a simulated horse racing game, covered by U.S. Pat. No. 3,690,666. These games use player performance data to provide individual player cards, but the present invention is directed to bowlers, and to their performance in simulated bowling matches. These matches are carried out in such a way as to match professional bowlers against each other to produce a realistic representation of an actual match, taking into consideration the bowlers' ability and past performances. This is provided by means of various charts which cooperate with the individual bowler cards, and which are selected in accordance with the roll of dice, to produce statistically accurate match results.

SUMMARY OF THE INVENTION

Briefly, the bowling game of the present invention includes a plurality of bowlers' cards, each of which carries the name of a professional bowler together with several columns of data selected in accordance with that bowler's actual performance in tournament play. This data includes an identifier number column which includes the numbers 11 through 66, a strike (X) column, and a spare (S) column. The identifier numbers are obtained by rolling dice, with the rolled number thus indicating a corresponding number or letter in the X or S columns.

The strike column for each card carries a series of numbers and letters 1 to 14, T, Q, S, 01 and 02, all of which correspond to rows on a "strike" board. Similarly, the spare column for each card has a series of numbers 1 to 15 which refer to particular rows on "spare" boards.

The game includes a single strike board which has a plurality of rows identified by numbers and letters as stated above, and a series of columns, the columns being labeled by the frame numbers of a conventional bowling game, i.e., there are 10 columns labeled "first frame" through "tenth frame". A plurality of spare boards are provided, each including columns corresponding to the number of pins in the spare and including rows which are selected in accordance with the numbers found on the bowler card S column. The number of spare boards is sufficient to accommodate the large number of spare possibilities in an actual bowling game, with the various combinations being found from combining the results produced on the strike board with the numbers found on the bowler's cards. While the spare boards thus take into account all the possibilities of spares and splits that would appear in a normal game, the reference indicia on the bowler cards are selected in accordance with the ability of the bowler so that some spares and splits will turn up more frequently for some bowlers than for others.

In use, each player selects a bowler card from the number of cards provided with the game. Dice are then thrown by each player in turn, with each player rolling the dice one or more times to determine how many pins are "knocked down" in a frame. When all players have completed one turn, a single frame of the game is complete. During his turn, a player rolls the dice enough times to permit determination from the strike and spare boards the exact number of pins scored during that frame.

Because the roll of dice controls the making of strikes and spares, and the frequency of strikes and spares is in turn controlled by the particular indicia on the individual bowler cards, every game develops a different pattern as each frame unfolds. There is no predicting how well any particular bowler will do in a particular match, but over a period of games, the best bowlers will accumulate the best scores and the remainder will trail behind by the same rate of diminishing averages as they did in real life during the previous year's matches. Because the strike board gives different results for each of the ten frames in a match, the game takes into account the possibility of mounting tension as the game nears its finish so that similar rolls of the dice bring different results as the game progresses.

To add to the realism, the present game takes into account the possibility of even very rare spares and splits, as well as occasional foot faults, gutter balls and the like which may not occur over the course of playing many hundreds of games in a professional bowling situation, but which can occur. Although there are 1,023 mathematically possible spare leaves in bowling, a good number of these are in fact not physically possible, only mathematically possible. For example, a spare with only the five (middle) pin down and all the other pins standing is not physically possible. Many others are so rare that they may never occur for a bowler in his lifetime. The present game provides for a total of 467 different spare leaves, all of which occur in playing the present game with the same frequency as they are most likely to occur in professional bowling matches. This is accomplished by the method of playing the game, as will be described below, which reduces the percentage possibility for the rare spares and allows the more common ones to occur more frequently. All of the spare combinations are represented by individual columns on the playing boards, and these columns are used for obtaining the result of the dice roll when attempting to make a spare.

Because the indicia on the individual bowler cards are tailored to the actual performance of the bowlers, in playing this game the best bowlers will make the most strikes and also will have the best chance for a perfect game. The best will also convert their spare leaves most often. However, any bowler can have an unusually good game or a series of them, and any bowler can have a good performance, but over the long term, the best one will total the highest average. The present game is so detailed that it even takes into account which hand the bowler uses. Beause of the importance of angles in rolling for spares, certain shots are easier for right handed bowlers and more difficult for left handers. On other spares, the opposite is true, with the left hander being favored. This slight difference in difficulty, sometimes favoring a right hander and other times a left hander, is all taken into account in the present game so as to add to the realism.

The indicia on the spare boards is sufficiently detailed to insure that the degree of difficulty on split leaves is also taken into account, as it is on all spare leaves. Each one of the 467 spares is given a rating of easy to difficult on a 1 to 15 scale. The extremely difficult ones are given expanded ratings through additional dice rolls that may reduce the possibility of success as low as only 1 in 50. In the notorious 7-10 split, for example, it is just as difficult in the present game as it is in real life, although it can be made. It is possible, but the probability is just as low as in real life. Further, because of the extreme difficulty of some shots, the player is given options which allow him to decide to try for a sure pin rather than trying for a split that cannot be made. For example, if the player is confronted with a 4-6-7-10 split, the extreme two border pins on each side, it is very likely that the player will fail to knock down any of the pins in attempting to make the split. If the player is nearing the end of a close game when this split comes up, it might be more advisable to try for two sure pins rather than trying for all four and making none. In such a circumstance, the present game provides the option of allowing the player to try for either the 4-7 or the 6-10 pins, depending upon whether the bowler is right handed or left handed, and then making that particular attempt instead. The chances of making the two pin spare are about 8 out of 9, as opposed to 1 out of 50 for the split.

Thus, the present invention provides all of the features of bowling, including realistic strike frequency and having the commonly resulting spares occuring more often, as in a real life game. By the same token, the rare spares and splits seldom occur in this game, and a variation is available to distinguish between right and left handed bowlers. In addition, unusual events such as fouls and injuries are provided for, but since they rarely occur in actual bowling matches they are rare in this game so as to enhance the realism.

BRIEF DESCRIPTION OF THE DRAWINGS

The foregoing objects, features and advantages of the present invention will become apparent to those of ordinary skill in the art from a consideration of the following detailed description of the invention, taken in conjunction with the accompanying drawings, in which:

FIG. 1 is a diagram of a bowling pin set;

FIG. 2 is a diagrammatic illustration of dice and pin markers which are used in the preferred embodiment of the present game;

FIG. 3 is a segment of a bowling score sheet;

FIGS. 4–7 illustrate bowler cards for 4 selected bowlers;

FIG. 8 illustrates the strike board for the present game, which is used in scoring the first ball of each frame for each bowler;

FIG. 9 illustrates a first expanded strike board which may be referenced by the strike board to provide rare split spare leaves from the first ball of a frame;

FIG. 10 illustrates a second expanded strike board which may be referenced by the strike board to provide rare spare leaves and other unusual occurrences produced by or during the first ball of a frame;

FIGS. 11A and 11B illustrate a first spare board A-1 including one, two and three-pin spare leaves, and which provides second ball score values;

FIG. 11C represents the relationship between FIGS. 11A and 11B;

FIGS. 12A and 12B illustrate a second spare board A-2 including four, five, eight and nine-pin spare leaves, and which provides second ball score values;

FIG. 12C represents the relationship between FIGS. 12A and 12B;

FIGS. 13A and 13B illustrate a third spare board B-1, including six and seven-pin spare leaves, and which provides second ball score values;

FIG. 13C represents the relationship between FIGS. 13A and 13B;

FIGS. 14A and 14B illustrate a fourth spare board B-2, including rare two, three and four-pin spares as well as six-pin split spares, and which provides second ball score values;

FIG. 14C represents the relationship between FIGS. 14A and 14B;

FIGS. 15A and 15B illustrate a third split spare board S-1, which provides second ball scores for two and three pin splits;

FIG. 15C represents the relationship between FIGS. 15A and 15B;

FIGS. 16A and 16B illustrate a fourth split spare board S-2 which provides second ball score values for four-pin splits;

FIG. 16C represents the relationship between FIGS. 16A and 16B;

FIGS. 17A and 17B illustrate a fifth split spare board S-3 which provides second ball score values for four, seven and eight pin splits;

FIG. 17C represents the relationship between FIGS. 17A and 17B;

FIGS. 18A and 18B illustrate a sixth split spare board S-4 which provides second ball score values for five and six-pin splits; and FIG. 18C represents the relationship between FIGS. 18A and 18B.

DESCRIPTION OF THE PREFERRED EMBODIMENT

(a) Pins

Figure 13A:
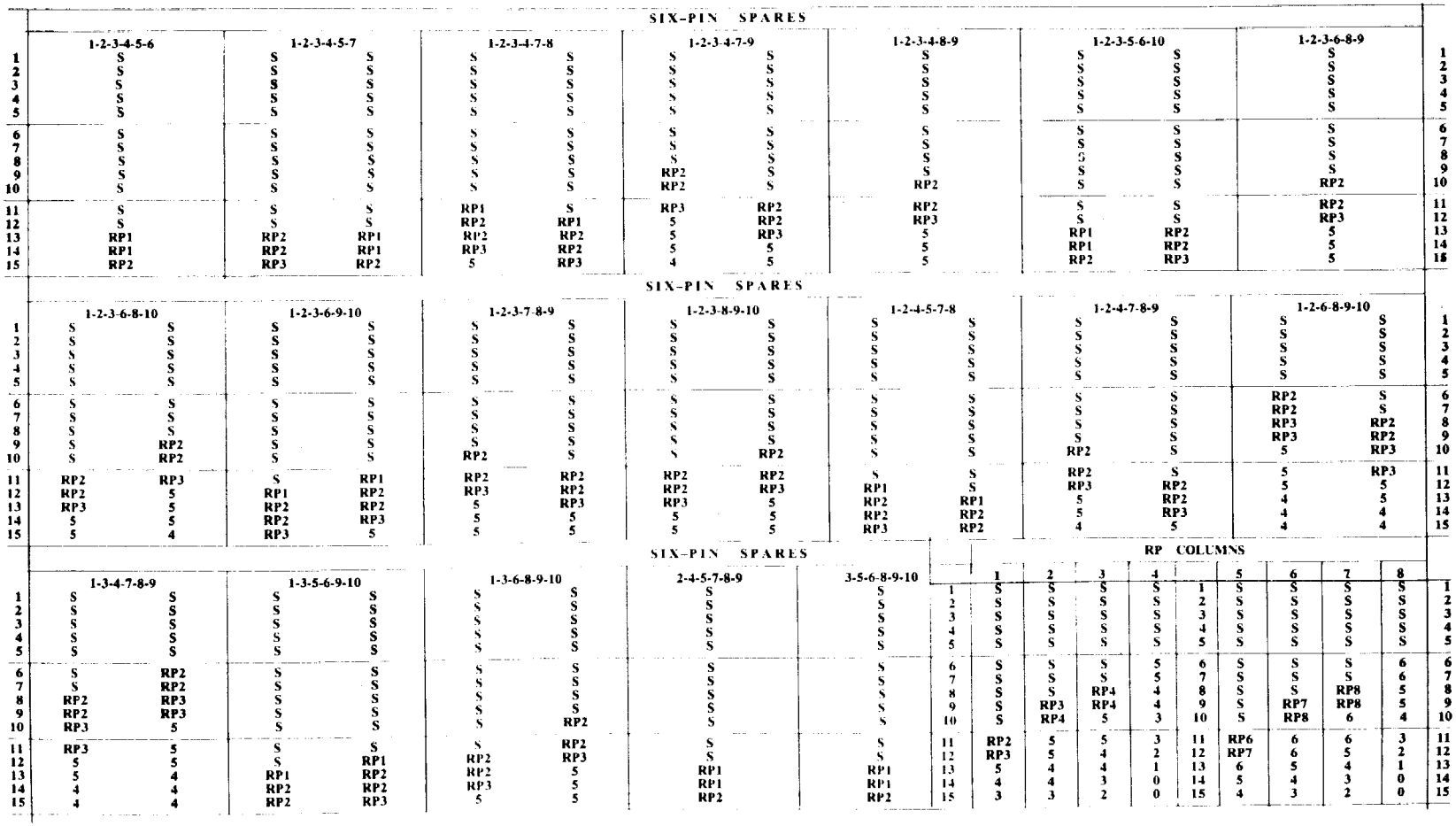

Referring now to FIG. 1 of the drawings, there is illustrated at 20 a conventional pin deck which indicates the location of each of the ten pins used in a bowling game, the pin deck 20 being used for visualization of the pins remaining in a spare leave to enable a player to obtain a better understanding of pin locations in a spare leave, particularly in a split. Suitable markers, such as colored discs 22 illustrated diagrammatically in FIG. 2, may be provided for placement on the pin deck to illustrate the pin numbers representing a spare leave designated by the strike board (to be described) after the rolling of dice. Such visualization gives the game a more realistic aspect, and also helps the player to analyze how difficult it may be to convert a particular spare leave. This is of particular value when situations occur in close scoring games where it might be advantageous to try for just one or two of the "sure" pins in a spare leave, rather than attempting to make what may be an impossible split.

(b) Chance Device

In addition to the pin markers 22, the game also utilizes a chance device such as a pair of dice 24 and 25, also illustrated in FIG. 2. These are conventionally marked dice, the difference being that the dice are not identical. This is done to differentiate between the two, so that the numbers obtained by the roll of the dice can be specifically identified. In the preferred form of the invention, the dice are of different sizes, as illustrated, but if desired they may be otherwise distinguished, as by color or markings. The numbers which show on the face of the dice are used in two different ways. In the first roll during a player's turn, which is called the strike roll, the dice are read sequentially, the number showing on the large die 24 being read first to produce the first digit of an identifier number to be used in conjunction with the bowler cards to be described, and the number showing on the smaller die 25 being read second to produce the second digit of the identifier number, so that rolls of the dice produce identifier numbers 11 through 66. If the first roll of the dice produces a strike, then no further rolls are required; however, if pins are left standing, a spare roll may be required, again requiring a sequential reading of the dice to provide another identifier number. On occasion the strike roll or the spare roll will result in a need for additional rolls to determine the spare leave or the exact scoring on the spare, and such additional rolls of the dice may require an additive reading of the dice to produce row selector totals which include the numbers 2 through 12 and which are used in locating scoring indicia on specific boards.

(c) Scoring

FIG. 3 illustrates a portion of a conventional bowling score sheet 30 having a left-hand column for listing of the players' names and additional columns for scoring each frame in turn, in conventional manner. This score sheet is used in the present game, with each player's score being kept in accordance with usual score-keeping procedures. However, the number of pins knocked down by each ball is determined in this game from indicia obtained from the game boards (to be described). The present game utilizes first ball result boards which provide the number of pins scored on the first ball of a frame, and second ball result boards, which provide the number of pins scored on the second ball. As in conventional bowling, a game consists of ten frames, and each bowler rolls one or two balls in each of the first nine frames. If the bowler knocks all ten pins down on the first ball, a strike is scored, the frame is complete for that bowler, and an X is placed within the left-hand small box 32 for that frame and bowler. If the bowler does not knock down all of the pins on the first ball, a second ball is allowed. In this case, the number of pins made on the first ball is written in the box 32. If the remaining pins are knocked down on the second ball for that frame, the bowler scores a spare, and a diagonal line (/) is placed in the right-hand small box 34.

A strike is worth 10 pins plus the number of pins knocked down on each of the bowler's next two balls, so the bowler must then roll two more balls before he can enter his score in the large box 36 representing the particular frame being bowled. If the bowler were to score a strike on each of the next two balls, the total for the original plus these additional balls would be 30 and the number 30 would be entered in box 36. This is the maximum score for each frame. If the bowler scores a strike in the tenth and final frame, he is allowed two additional balls so that if he scores all strikes, nine in the first nine frames and three in the tenth frame, he will have a perfect game of 300, produced by a score of 30 for each of the ten frames.

A spare, in which all ten pins are knocked down with two balls, is worth ten pins plus the number of pins knocked down with the next ball. If that next ball is a strike, the score for the frame in which the spare was obtained would be 20, including 10 for the spare and 10 for the score produced by the next ball.

If the bowler fails to knock down all ten pins with both balls in a frame, the bowler adds to his previous total the number of pins he did knock down. For instance, if the bowler makes a strike in frame 1 and then scores a total of 9 pins on the next two balls, the score for frame 1 would be 19 (10 for the strike plus the total of the next two balls) and for the second frame the nine pins scored in that frame would be added to the previous total of 19 to show a score of 28. Thus, the total accumulated score is entered in each large box for each frame as the game progresses, although the actual score in a particular frame might not be determined until two frames later if the bowler happens to make a string of strikes.

When a bowler fails to make a strike or a spare in a frame, it is referred to as an "open frame" and a straight line (-) is entered in the right hand small box 34, with the total score being entered in the large box 36.

In playing the simulated bowling game of the invention, one or more rolls of the dice are required to obtain the score for each ball that would be rolled in a conventional game. This is done to provide variations in the probabilities of getting certain spare leaves and of making the more difficult ones, thereby providing for degrees of difficulty in scoring that makes the game more realistic. These variations are obtained through the use of bowler cards and game boards.

(d) Bowler Cards

The game includes a plurality of bowler cards, such as the cards 40 to 43 illustrated in FIGS. 4 through 7 respectively. In the preferred form of the invention, each card represents a specific professional bowler and for purposes of illustration these cards are identified by the names "Anthony", "Bill", "Carl" and "Dan", as indicated on the cards and on the score sheet of FIG. 3. Each bowler card includes identifier numbers 11 through 66 arranged in three columns, these numbers corresponding to the identifier numbers provided by rolling the dice. Following each identifier number are two indicators, one being a strike indicator, and the other being a spare indicator. The strike indicators are listed in three columns, each being headed by an X, and include the numbers 0 through 14, the letters T, Q and S, and the numerals 01 and 02, each of which correspond to a row or series of rows on the stroke board illustrated in FIG. 8. These numbers, letters and numerals are listed in the left-hand column of the strike board of FIG. 8.

The second indicator is a spare indicator, one corresponding to each of the identifier numbers 11 through 66, the spare indicators being listed in three columns each headed by the letter S. The spare column indicators include the numbers 1 through 15 which refer to specific rows found on the various spare boards illustrated in FIGS. 9 through 18.

It will be noted that the strike and spare indicia under columns X and S for each of the bowler cards is different so that when the dice are rolled to produce a particular identifier number, for example, the number 52, each bowler card will refer to different strike and spare indicators and thus will produce different scoring results for the four bowlers. The indicator numbers will thus produce, for a given sequence of dice rolls, different scores for each bowler, and by adjusting the particular indicators in accordance with the probability of certain identifier numbers being turned up by the roll of the dice, the frequency at which certain spares and strikes are obtained by a given bowler card can be adjusted to produce, on the average, a score equal to the average that a particular professional actually has obtained over a period of time. In the preferred form of the invention, these numbers are adjusted to produce in the course of a number of games the actual score obtained by a specific professional bowler in the past year. Of course, the rolling of the dice to obtain these scores will produce variations from the average in particular games, so that every game will develop a different pattern as each frame unfolds and the score of a particular game cannot be predicted. However, by proper adjustment of the strike and spare indicators, the best bowlers will accumulate the best scores over a period of games, and the remaining bowlers will trail behind by the same rate of diminishing averages as they did in real life. Although only four bowler cards are illustrated in FIGS. 4 through 7, it should be understood that any number of cards may be provided, and in the preferred form of the present game, 48 cards are provided, one for each of the top 48 professional bowlers of the preceding bowling season.

In playing the present bowling game, the player or players select one or more bowler cards representing the professional bowlers that are to be matched against each other. For purposes of explaining the present game, it will be assumed that four players each select a single bowler card corresponding to the four cards illustrated in FIGS. 4 through 7 and that the players will take turns in the sequence indicated on the score sheet of FIG. 3. Each player then rolls the dice in turn to complete a single frame, until all of the players have completed the first turn. Thereafter, the second frame is played in order, and so on until all ten frames are complete.

To start the game, the first player rolls the dice 24 and 25 and obtains therefrom a two digit number, the large die giving the first number and the small die giving the second number. If, for example, the dice land in the configuration illustrated in FIG. 2, the indicated number will be 43, and this will be the identifier number for the simulated first ball of the bowling game. Referring then to the bowler card for the first player, which in this case is card 40 of FIG. 4, the identifier number 43 corresponds to a strike indicator number 14 in the strike column X.

(e) First Ball Result Boards

1. Strike Board

The first ball (or first dice roll) of each frame always produces an identifier number which refers to a strike indicator, and this strike indicator always refers to a corresponding row or group of rows on the strike board illustrated in FIG. 8, which is one of three "first ball" boards, and to which reference is now made. The strike board is divided into ten columns which correspond to the ten frames of a bowling game, and each column is divided into rows. The topmost rows are identified by the numbers 1 through 14 on the left side of the strike board (and for convenience on the right side also) while the remaining rows are sectioned into additional groups of 11 rows, section T having rows 2 through 12, section 01 having rows 2 through 12, and section 02 having rows 2 through 12, respectively. The strike indicators in the X columns of the bowler cards refer either to the first rows 1 through 14 by specific row number or to the remaining sections by letter or numeral.

When the dice roll for the strike indicator of the bowler's card produces any of the numbers 1 through 14, the result of that roll is found simply by finding that numbered row under the frame column in which the particular player is rolling at that time. Thus, in the example, where the rolling of dice 24 and 25 produced an identifier number 43, which in turn referred to a strike indicator number 14, reference is immediately made to row 14 of the strike board. If this dice roll is the for the first frame, the player refers to the first column of the strike board (FIG. 8) and finds that the roll produced a spare leave of the pins 6 and 10. This direct reading of the spare leave enables the player to proceed directly to the second roll of the frame, corresponding to a bowler's second ball, to obtain a second identifier number which will produce a spare indicator number in the S column of the bowler card and which will refer to one of the spare boards to be described.

If the first ball had not produced one of the strike indicator numbers 1 through 14 to give a direct indication of the number of pins knocked down, but instead had produced one of the strike indicator letters or numerals T, Q, S, 01 or 02, then at least one additional roll of the dice would be required to find the spare leave resulting from the bowler's first ball, for a second roll would be needed to ascertain which row within the section is to be selected. Thus, for example, if the strike indicator had been the letter T, then a second roll of the dice would be required to select a row of the T section. In this second roll, the dice numbers are added to produce one of the row numbers 2 through 12. In the example, if the second roll of dice produced the sum 6, reference to the strike board under section T, the 6th row indicates a spare leave of pins 3, 6 and 10 for a left-handed bowler, and a spare leave of pins 2, 4 and 7 for a right-handed bowler. Since the bowler card 40 indicates that the bowler is right-handed, the spare leave 2, 4 and 7 would be indicated in this case.

As a general overview of the strike board, it will be seen that the first 14 rows of this board include indicia which directly result in strikes, single pin spares or two-pin spares, the most common pin falls in professional bowling. Three-pin spares result from dice rolls that produce strike indicators which refer to the T section of the strike board, while four-pin spares result from a dice roll that produces the letter Q on the bowler card. The S section of the strike board is used when the strike indicator obtained from the X column of a bowler card is an S, and this section produces split spare leaves, or, by reference to one of two expanded strike boards, infrequently occurring split spare leaves. The 01 and 02 sections of the strike board produce 5, 6, 7, 8 and 9 pin spares as well as rarely-occurring 2, 3 and 4 pin splits, either directly or by reference to the second expanded strike board, and further produces rarely occurring events such as injuries, forfeits, gutter balls, and the like through multiple rolls of the dice in conjunction with the second expanded strike board.

Before considering in detail the expanded strike boards, it should be observed that the results produced by the game boards of the invention are weighted to take into account factors such as the increased tension that occurs during a game, and which results, for example, in a decreasing frequency of strikes. This may be illustrated by the first 8 indicator numbers on the strike board. The first four strike indicator numbers each indicate a first ball strike in the first frame, while the next four indicator numbers (5 through 8) indicate single pin spares. This scoring pattern holds true for the first seven frames on the strike board, although for the single pin spares the pin left standing may vary from frame to frame. Note, however, that in the eighth, ninth and tenth frames, the chances of obtaining a strike are significantly reduced until only the strike indicator 1 will produce a strike in the tenth frame, whereas the strike indicators 2 through 8 will produce a single pin spare. This variation in the probability of obtaining a strike on the first ball makes the game more realistic, for it often happens that in the course of a bowling match strikes become more difficult to obtain.

As a further accomodation to realism, it will be noted that in the tenth frame the spare leaves indicated in rows 2, 3 and 4 are specially marked. This is to indicate that these particular spares are to be scored as a strike if the bowler's first roll of the tenth frame was also a strike or if both the first and second rolls of the tenth frame were strikes. This takes into account the increased probability of a bowler getting additional strikes in the tenth frame if he gets a strike on the first ball. Note that if a strike is made on the first roll of the tenth frame, the strike board is used again for the second roll of the frame, and if the second roll is also a strike, the strike board is used a third time for the final roll.

2. Expanded Strike Board

Although most of the indicia on the strike board produce direct readings of pin fall for the first ball, either as a strike or a spare leave, some of the indicia found in sections S, 01 and 02 refer to one or the other of two "expanded" strike boards, illustrated in FIGS. 9 and 10, and labelled "RP Split Board" and "RPO Board", respectively. These references to the expanded boards indirectly provide unusual pin falls or other occurrences through additional rolls of the dice. These unusual occurrences requiring multiple rolls of the dice, and this reduces the probability that they will happen in a given game, for the more rolls of the dice required to reach a particular first ball result, the less likely it is to occur.

An example of a strike board reference to the expanded strike boards is found in section S, row 2, in the first frame, where the reference is to "RPS Column 8*". The asterisk indicates that the "RP Split" board of FIG. 9 is to be used, at column 8 thereof. Where a specific column of the RPS board is referred to, that column is used; however, if the reference is to plural columns (e.g., "RPS Column 1–6"), then an additional roll of a single die is required to pinpoint the exact column to be used.

Additional examples of references to the expanded strike boards are found in sections 01 and 02, where numerous listings of "RPO Column 1" are found.

The RP Split Board, which is shown in FIG. 9 includes eight columns each having indicia arranged in rows 11 through 66. All of the spare leaves in these columns are splits, and may indicate from two to eight pins still standing. To determine which spare leave will be the result of the first ball, the proper column is found from the strike board, or from the strike board and the roll of one die, and then the dice 24 and 25 are rolled again to find a two digit number defined by the number showing on the large and small dice respectively. This two digit number defines the row in the already-selected column which gives the first ball spare result. Thus, for example, if the stroke board reference is to RPS column 1–6, and the roll of one die turns up a 1, then column 1 of the RPS Split Board is selected. If the next roll of the two dice then produces the digits 3 and 6, row 36 of column 1 of the RP Split Board will produce a split spare leave of pins 3, 5, 6, 7, 9 and 10, and this will be the first ball result.

When the strike board refers the player to "RPO Column 1", the double asterisk refers the player to the RPO Board of FIG. 10**, and another roll of the dice is required to find which row in Column 1 is to provide the spare results. It will be noted, however, that many of the indicia in RPO column 1 do not indicate spare leaves, but rather provide instructions to use column 2 and roll the dice again. When this occurs, the dice are rolled again to indicate a row of RPO column 2 which will provide either a spare leave or a further reference to column 3. If the latter reference occurs a still further roll of the dice is required to locate the desired row in that column. Again, some of the rows in column 3 will provide spare leaves, while others will make further reference to RPO column 4, again requiring a roll of the dice to obtain a row number to finally determine the results of the first ball of the frame.

Since it may take six rolls of the dice to obtain a first ball result from RPO column 4, it is clear that the results indicated there are extremely rare in an actual professional bowling game. Column 4 thus includes results such as gutter balls, injuries to the bowler, spectator interference, fouls, and the like, which infrequently happen. The consequences of these occurrences are described in notes 1–5 accompanying the RPO Board. Thus, if a gutter ball is indicated, the notes provide that the stroke board is to be used for the bowler's second (spare attempt) ball of the frame. If there is spectator interference or if the bowler is distracted by a moving object, Note No. 1 provides the option of accepting the resulting pin fall or of discounting the first roll and rebowling. If it is desired to accept the pin fall, the dice are rolled again in order to determine the pin fall for that roll, again using the strike board. The player then has the option of accepting this result, or of rolling again and accepting the second result for better or for worse.

If the RPO column 4 produces an injury such as a finger blister (see row 25), then Note 2 to the RPO Board provides instructions for reducing the bowler's effectiveness for the remainder of the game and for the remainder of the tournament. This is accomplished by decreasing the strike indicator numbers 3 through 10 which appear in the bowler's strike (X) column by two points and by decreasing the spare indicator numbers 1 through 10 in the spare (S) column by two points. All other numbers remain the same on the bowler's card.

If the result obtained from RPO column 4 indicates an increase in the bowler's efficiency (as indicated, for example, in row 16), then Note 3 to the RPO Board states that the strike indicator numbers 6 through 10 on the bowler card are to be increased by one point and the spare indicator numbers 5 through 10 are to be increased by one point for the remainder of this game and for the next game only, with all other numbers remaining the same. An increase in the bowler's efficiency as indicated in row 31 of the RPO column 4 refers to Note No. 4, wherein the strike indicator numbers 4 through 12 on the bowler card are increased by two points and the spare indicator numbers 5 through 10 are also increased by two points for the ongoing game and for the next two games only, with all other numbers remaining the same. Note No. 5 results from row 54 of RPO column 4 and produces an increase in the bowler's efficiency by increasing the strike indicator numbers 3 through 14 in the strike (X) column of the bowler card by two points and by increasing the spare indicator numbers 3 through 11 in the spare (S) column of the bowler card by two points for the remainder of the current game and for the next four games only, with all other numbers remaining the same. It should be noted that if an efficiency increase number should happen to come up while one is already in effect, the second one must be ignored.

3. Second Ball Result Boards

Once the scoring for the first ball of a frame has been completed and the spare leave has been determined from either the strike board, the RP Split Board or the RPO Board in FIGS. 8, 9 and 10, the player then must refer to one of the spare boards illustrated in FIGS. 11 through 18 where the player will find a column corresponding to the spare leave produced on the first ball. If the results obtained from the first ball result boards indicate a spare leave of 1, 2 or 3-pin spares, the results of the second ball in the frame will be obtained from spare board A-1 illustrated in FIGS. 11A and 11B. If a four pin spare is produced by the first ball result boards, the results of the second ball are obtained from spare board A-2, illustrated in FIGS. 12A and 12B.

Spares produced by the S section of the strike board, either directly or through reference to the expanded strike board "RP Split" of FIG. 9, are found on the split boards S-1, S-2, S-3 and S-4 which are illustrated in FIGS. 15A and B, 16A and B, 17A and B, and 18A and B, respectively.

If the first ball of the frame has referred the player to sections 01 or 02 of the strike board, the resulting spare leaves will be found on spare board A-2, illustrated in FIG. 12, which contains the 5, 8 and 9 pin spares, on spare board B-1, illustrated in FIG. 13, which contains the 6 and 7 pin spares, and to the upper half of spare board B-2, illustrated in FIG. 14, which contains the less frequent multiple-pin spares. Many of these rare spares and splits are found by first referring to specified columns of the RPO Board illustrated in FIG. 10, as explained above.

For example, if the first ball produces a two-pin spare leave such as pins 3 and 6, spare board A-1 in FIG. 11A is used, since this board includes the two-pin spares. The group of columns headed "Two Pin Spares" includes a plurality of subheadings with the pin numbers being listed, and by looking first for the lowest numbered pin, 3, then for the next high numbered pin, 6, the column headed 3-6 is located. As a further example, if a five pin spare leave has been indicated, for example 3-5-6-8-10 for the first ball, then spare board A-2 on FIGS. 12A and 12B is used, and under the heading "Five Pin Spares" in FIG. 12B, the subheading 3-5-6-8-10 is found in an appropriate column. It will be noted in this particular case that two results are listed for this five-pin spare leave, the left-hand column being for left-handed bowlers and the right-hand column providing results for right-handed bowlers. If the spare leave is a split, then the appropriate column will be found on the split boards S-1 through S-4 in FIGS. 15 through 18. The same procedure for locating the appropriate column for any spare leave is followed, and spares are always identified in numerical order.

Since not all of the 1,023 mathematically possible spare leaves in bowling are physically possible, and since many others are so rare that they may never occur for a bowler in his lifetime, it has been found that a realistic bowling game need only provide for a total of 467 different spare leaves. The spare leaves selected for this game occur with the same frequency that they are most likely to occur in professional bowling matches.

After the proper spare column has been found on one of the spare boards, the player is ready to roll the dice 24 and 25 again for the second ball of the game. The dice are rolled, and an identifier number is obtained having a first digit corresponding to the digit appearing on the larger of the two dice and a second digit corresponding to the number appearing on the smaller of the two dice. This identifier number, which will be between the numbers 11 and 66, is then located on the player's bowler card, and the corresponding spare indicator is then obtained from the S column. Thus, for example, if the player obtains the number 35 from the dice, reference to identifier number 35 on card 40 (FIG. 4) produces the spare indicator 4. In the case of the previous example, where a spare leave 6-10 was indicated, reference to spare board A-1 reveals that in the column headed 6-10, the spare indicator 4 results in a reference to row 4, which contains an S, indicating that the bowler has completed the spare; i.e., in an actual game all of the standing pins would have been knocked down by the bowler's second ball. In this particular column, and in others, the indicia are shown in two sub-columns under the heading 6-10. The left-hand subcolumn provides the results for a left-handed bowler, and the right-hand column provides the results for a right-handed bowler.

If a number had appeared in the selected row of the 6-10 column, instead of an S, the bowler would not score a spare, but would be credited with only the number of pins indicated.

If the selected row of the 6-10 column had contained an "RP" indicator, such as those found in rows 13, 14 and 15 of the 6-10 column, then another roll of the dice is needed to find the second ball scoring results. This RP reference is in each case followed by a number (for example RP3), and refers the player to a specific column of an "RP" chart found elsewhere on the same spare board. For example, spare board A-1 (FIGS. 11A and 11B) has nine RP columns, spare board A-2 (FIG. 12) has ten RP columns, spare board B-1 (FIG. 13) has eight RP columns, etc.

After locating the referenced RP column on the same spare board, the player rolls the dice again to obtain a two-digit identifier number between 11 and 16 which is used in conjunction with the player's bowler card to obtain from the S column a spare indicator number. The spare indicator number is then used to find the correspondingly numbered row in the already located RP column to again obtain one of three possible results. If the designated row of the selected column contains an S, then the player has made a spare. If the designated row and column is a number, then that number indicates the number of pins knocked down on the spare attempt. Finally, if another RP column is referenced then the dice are rolled again and the process is repeated, again by obtaining a spare indicator from the bowler card and using that indicator to find the appropriate row in the second indicated RP column. The second RP column will always give a final result, so that there will never be more than three dice rolls needed to get the final result of a spare (second ball) attempt.

As noted above, in some of the spare columns on the various spare boards there are two columns of results under the same column designation. Whenever two such columns appear, the left-hand column is used when the bowler is left-handed and the right-hand column is used when the bowler is right-handed.

Although the second ball result boards normally are used in the manner indicated, in some situations, such as a close scoring game, the player may modify their use in recognition of the degree of difficulty of a split, for example; thus, it may be advantageous to try for just one or two sure pins in a spare leave, rather than attempting to make an extremely difficult split. The extremely difficult spares are those which result in references to various RP columns and which, through the necessity of additional dice rolls, may reduce the possibility of success to as low as 1 in 50. For example, the notorious 7-10 split is just as improbable in the present game as in real life, although it is possible to make it. In the present game, the player has the option of either attempting to make all of the pins in a spare leave or in a difficult split by simply following the normal sequence as explained above, or may try for only some of the pins to increase the chances of success. In such circumstances, the player may simply declare that he will try for only part of the split and then by using the appropriate board roll the dice for the reduced number of pins. For example, if the player is confronted with a 4-6-7-10 split, the player may decide to try for either the 4-7 or 6-10 pins, depending upon whether the bowler is right-handed or left-handed. The chances of making a two pin spare are about 8 out of 9, as opposed to about 1 out of 50 for the split. If the player selects the 6-10 pins and makes both of them, he scores a 2 for that ball, and in all probability produces a higher score than could have been obtained by trying for the split.

In accordance with the foregoing procedures, therefore, each player in turn rolls the dice a sufficient number of times to obtain a scoring result for the frame being played. Each player completes his turn to complete a first frame, and the sequence is repeated for the next and following frames in the normal manner of a bowling game. The provision of rare pin (RP) boards or charts which are referenced by the strike and spare boards is a unique provision of the present invention and serves to decrease the chances of a bowler making certain spare leaves by requiring several rolls of the dice to accomplish the scoring results. The rare pin boards and charts add to the realism of the game by removing certain scoring combinations from the ordinary statistical changes of a single roll of the dice, thereby providing more realistic results.

Although the present invention has been described in terms of a preferred embodiment, variations and modifications may be made therein without departing from the true spirit and scope thereof as defined in the following claims.

What is claimed is:

1. A bowling game for realistically simulating the scoring obtained in each frame of a conventional bowling game, the scoring results being separately obtained for the first ball of a frame and for the second ball of the frame when the first ball does not result in a strike, including:

bowler card means having a series of identifier indicia and corresponding strike indicators and spare indicators;

chance means for providing identifier number corresponding to said identifier number indicia on said bowler card means, said chance means identifying, by means of said identifier numbers and corresponding identifier number indicia, a corresponding strike indicator for a first ball in a frame and a corresponding spare indicator for a second ball in a frame, and providing row selector totals for specifying scoring results;

a plurality of first ball result boards incorporating strike and spare leave indicia representing the number of pins scored on the first ball of a frame, at least one of said first ball result boards having columns of indicia corresponding to the particular frame being bowled and adapted to produce different results for different frames, and having rows corresponding to the strike indicators on said bowler card, at least another of said first ball result boards having columns of indicia corresponding to selected results obtained from said at least one first ball result board and having rows of indicia corresponding to row selector totals provided by said chance means; and a plurality of second ball result boards incorporating spare scoring indicia representing the number of pins scored on the secoond ball of a frame, the indicia of said second ball result boards being arranged in columns corresponding to said spare leave indicia from said first ball result boards and in rows corresponding to said spare indicators from said bowler card, said second ball result indicia representing the number of pins scored on the second ball of a frame.

2. The bowling game of claim 1, wherein said chance means comprises a pair of dice, said dice being nonidentical whereby one die will provide the first of a two digit identifier number, and the other die will provide the second digit of said identifier number.

3. The bowling game of claim 1, wherein said bowler card means comprises a plurality of bowler cards, one for each bowler in the game, said bowler card carrying different combinations of strike indicators and spare indicators, whereby said identifier number indicia produce different scoring results for each bowler.

4. The bowling game apparatus of claim 3, wherein each bowler card carries a combination of strike indicators and space indicators which will produce over a series of bowling games an average score approximately the actual average score of a professional bowler.

5. The bowling game of claim 1, wherein said at least one of first ball result board comprises a strike board including strike indicia and spare leave indicia; and wherein the remainder of said plurality of first ball result boards comprise first and second expanded strike boards including additional spare leave indicia and unusual occurrence indicia arranged by columns corresponding to selected spare leave indicia on said strike board and by rows corresponding to row selector totals provided by said chance means, whereby multiple operation of said chance means may be required to obtain first ball scoring.

6. The bowling game of claim 5, wherein said first expanded strike board is a split spare board including split spare leave indicia.

7. The bowling game of claim 6, wherein said second expanded strike board provides indicia corresponding to rare pin leaves and unusual occurrences.

8. The bowling game of claim 5, wherein said plurality of second ball result boards includes a plurality of spare boards and a plurality of split spare boards, said second ball result boards including expanded spare charts and expanded split spare charts, respectively, which provide scoring results for difficult spare leaves.

9. The bowling game of claim 1, said plurality of second ball result boards comprising:

a plurality of spare boards having spare scoring indicia arranged in columns corresponding to first ball spare leave results as determined by said first ball result boards and in rows corresponding to said spare indicators from said bowler card; and a plurality of expanded spare charts having additional spare scoring indicia arranged in columns corresponding to selected scoring indicia on said spare boards and in rows corresponding to said spare indicators from said bowler card, said rows on said spare boards being selected by a first spare operation of said chance means and said rows on said expanded spare charts being selected by one or more subsequent spare operations of said chance means, as required, whereby multiple operations of said chance means may be required to obtain second ball scoring.

10. The bowling game of claim 9, wherein at least a part of said spare scoring indicia is divided into columns representing left-handed and right-handed bowlers.

11. The bowling game of claim 9, wherein said at least one first ball result board comprises a strike board including strike indicia and spare leave indicia, and wherein the remainder of said plurality of first ball result boards comprise first and second expanded strike boards including additional spare leave indicia and unusual occurrence indicia, said additional spare leave indicia being arranged by columns corresponding to selected spare leave indicia on said strike board and by rows corresponding to row selector totals provided by said chance means, whereby multiple operation of said chance means may be required to obtain first ball scoring.

12. The bowling game of claim 11, wherein said unusual occurrence indicia are arranged in columns corresponding to selected indicia on said expanded strike boards and in rows corresponding to row selector totals provided by said chance means, whereby multiple operation of said chance means is required to select said unusual occurrence indicia, the most unusual occurrence requiring the largest number of operations of said change means.

13. The bowling game of claim 12, wherein said scoring indicia on said first ball result boards may require up to six operations of said chance means to obtain first ball scoring results, and wherein said scoring indicia on said second ball result boards may require up to three operations of said chance means to obtain second ball scoring results.

14. The bowling game of claim 13, wherein said scoring indicia on said first ball result boards is arranged in ten columns representing the ten frames of a bowling game, and is adapted to produce lower scoring results in the higher frames than in the lower frames.

* * * * *

UNITED STATES PATENT AND TRADEMARK OFFICE

CERTIFICATE OF CORRECTION

PATENT NO. : 4,501,426

DATED : 26 February 1985

INVENTOR(S) : John R. Seitz

It is certified that error appears in the above-identified patent and that said Letters Patent is hereby corrected as shown below:

Claim 4, line 3, change "space" to --spare--.

Signed and Sealed this

*Sixth* Day of *August 1985*

[SEAL]

*Attest:*

DONALD J. QUIGG

*Attesting Officer*

*Acting Commissioner of Patents and Trademarks*